US006802433B2

(12) United States Patent
Leykin et al.

(10) Patent No.: US 6,802,433 B2
(45) Date of Patent: Oct. 12, 2004

(54) FOOD DISPENSING MACHINE AND METHOD OF USE

(75) Inventors: Leon Leykin, Baltimore, MD (US); Leonid Khodor, Orange, OH (US); Alex Kofman, Rockville, MD (US)

(73) Assignee: LHD Vending, Inc., Owings Mills, MD (US)

( * ) Notice: Subject to any disclaimer, the term of this patent is extended or adjusted under 35 U.S.C. 154(b) by 0 days.

(21) Appl. No.: 10/238,605

(22) Filed: Sep. 11, 2002

(65) Prior Publication Data

US 2004/0045975 A1 Mar. 11, 2004

(Under 37 CFR 1.47)

(51) Int. Cl.[7] ..... G07F 11/72
(52) U.S. Cl. ..... 221/30; 221/150 A
(58) Field of Search ..... 221/2, 3, 7, 13, 221/15, 30, 26, 150 R, 150 A, 150 HC, 157; 99/357, 326, 334; 219/679, 680, 739

(56) References Cited

U.S. PATENT DOCUMENTS 3,467,275 A * 9/1969 Vaughan et al. ..... 221/197
5,400,699 A 3/1995 Cailbault
5,873,299 A 2/1999 Leykin
6,383,542 B1 5/2002 Khodor et al.
6,518,553 B1 2/2003 Leykin et al.

OTHER PUBLICATIONS

Leykin, et al., U.S. 20033/0052134 A1, Mar. 20, 2003.
Declaration of Leon Leykin with attachment 1 (pp. 3–8)(Jul. 19, 2002).

* cited by examiner

*Primary Examiner*—Kenneth Noland
(74) *Attorney, Agent, or Firm*—Piper Rudnick LLP; Steven B. Kelbert

(57) ABSTRACT

A food dispensing machine and method of use that includes separately loaded, conveyed, and heated first and second food portions. A first food portion, such as a hot dog, is dispensed from a chain of portions in an sealing film via a first dispensing device, which slices the film and expels the food portion. The first food portion is loaded onto a projecting component, which transports the first food portion to a first heating device and rotates the food portion during heating. Second food portions, such as buns, within containers attached to a film so as to form a chain, are dispensed by a second dispensing device, which separates each container from the film for placement onto a tray. The tray conveys the second food portions to a second heating device, and the heated first and second food portions are combined and dispensed.

78 Claims, 51 Drawing Sheets

FOOD DISPENSING MACHINE AND METHOD OF USE

BACKGROUND OF THE INVENTION

1. Field of the Invention

The present invention relates to a food dispensing machine and method of use, and in particular to a machine for cooking, assembling, and dispensing uniformly shaped foods, such as hot dogs, sausages, or other meats in buns.

2. Background of the Technology

Machines for dispensing food items, such as for dispensing hot dogs, are known in the art. One such machine is disclosed in U.S. Pat. No. 5,873,299 to Leonid Leykin ("the '299 Patent"). In the machine of the '299 patent, a hot dog or sausage is removed from a standard package, placed on a fork holder, and then heated by an infrared oven. Individual buns are conveyed from boxes, and the heated sausage or hot dog is placed in the bun. The bun together with the sausage or hot dog is then warmed in a microwave oven, and the finished food item is dispensed.

However, there remain a number of problems with existing combined food dispensing device technology. For example, the use of infrared heating for the sausage/hot dog via the fork holding device of the '299 Patent, as well as use of a microwave oven for heating the combined sausage/hot dog and the bun, results in both a slow process and uneven heating of the food. The use of standard packages of hot dogs, from which sausages/hot dogs are individually withdrawn following opening, can result in staleness of sausages/hot dogs that are not immediately removed, as well as producing a potentially dangerous food situation (e.g., bacterial growth in sausages/hot dogs remaining in unsealed packages). Further, the pushing devices of the prior art used to individually remove sausages/hot dogs from containers introduce spillage and bacterial growth from, for example, leakage of juices from the containers, and the complexity of the pushing devices can produce jams or other problems in the devices.

There remains an unmet need to provide food cooking devices that overcome the problems with the prior art.

SUMMARY OF THE INVENTION

The present invention includes a food dispensing machine and method of use that includes separately loaded, conveyed, and heated first and second food portions, such as interior and exterior food portions (e.g., hot dog wieners and buns), which are combined after heating for dispensing to a customer.

In an embodiment of the present invention, a first food portion, such as a hot dog, sausage, hamburger, or other generally uniform food portion, is dispensed from a chain of portions formed using a sealing film. The portions are dispensed using a first dispensing device, which slices open the film and expels the first food portion. The first food portion is loaded onto a projecting component, which, via a first conveying device, transports the first food portion to a first heating device, such as a combined infrared and microwave oven. In an embodiment of the present invention, the projecting component rotates the first portion during heating.

In an embodiment of the present invention, second food portions, such as buns, are contained in containers forming a chain of portions via attachment to a second film. Each container containing a second food portion is dispensed by a second dispensing device, which separates the container and food portion from the film and places the container onto a specialized tray, such as a tray including one or more projections for engaging openings in each container. The tray is conveyed, via a second conveying mechanism, to a second heating device, such as a microwave oven, for heating of the second food portion. The heated first and second food portions are then combined and conveyed to a dispensing location.

Other features of embodiments of the present invention include the following: containers for containing the chains of first and second food portions, the containers being optionally located within refrigerated sections of the machine; various vending features, as are known in the art, such as product selection buttons, payment acceptance features, and change dispensing features; condiment and other feeding mechanisms within the machine and ports for dispensing such items from the machine; appropriate electrical and/or electronic control elements for controlling operation of the machine; a test operation panel for testing operation; and various features to facilitate access, cleaning, and maintenance.

Additional advantages and novel features of the invention are set forth in the attachments to this summary, and in part will become more apparent to those skilled in the art upon examination of the following or upon learning by practice of the invention.

DETAILED DESCRIPTION

References will now be made in detail to embodiments of the present invention, examples of which are illustrated in the accompanying drawings.

Figure 1:
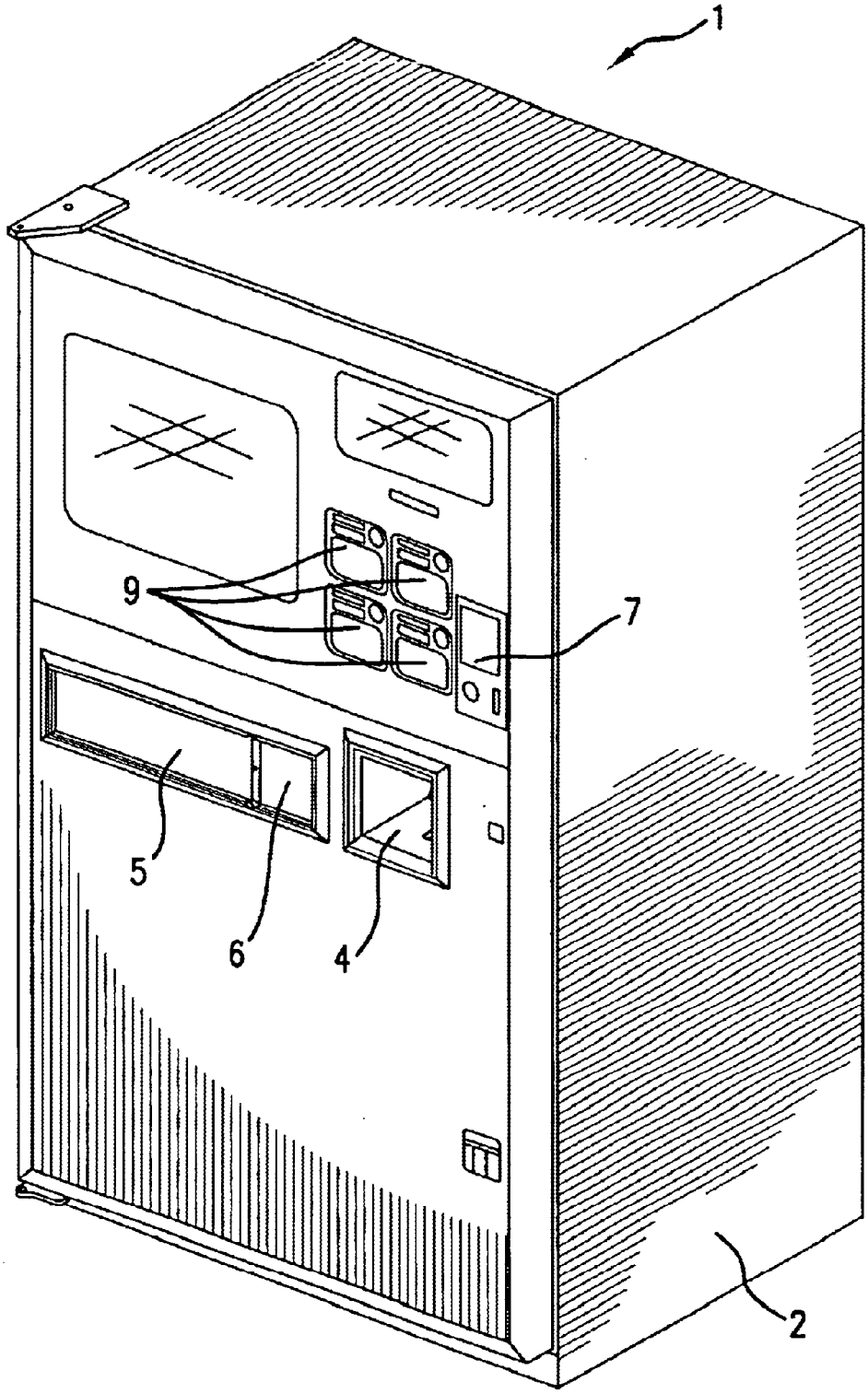
FIG. 1 presents a perspective view of an example food dispensing machine, in accordance with an embodiment of the present invention.

FIG. 1 presents a perspective view of an example food dispensing machine, in accordance with an embodiment of the present invention. As shown in FIG. 1, the machine 1 includes a housing 2. A food dispensing port 4 accommodates the finished food product dispensed, a condiments port 5 accommodates condiments, and a supplemental port 6 accommodates supplemental dispensed items, such as napkins.

The example machine 1 of FIG. 1 further includes a bill/coin accepting mechanism 7 and a change dispenser 8. In addition, the machine 1 includes a plurality of food item selection buttons 9. Near each button is included, for example, an inscription or a picture identifying a different type of food item selectable via each of the buttons 9. The selectable food items include, for example, hot dogs, sausages, hamburgers, and other generally uniformly shaped food items, including food items that include both a first portion (e.g., interior food portion, such as hot dog wiener) and a second portion (e.g., bun) that require differing cooking requirements.

Figure 2:
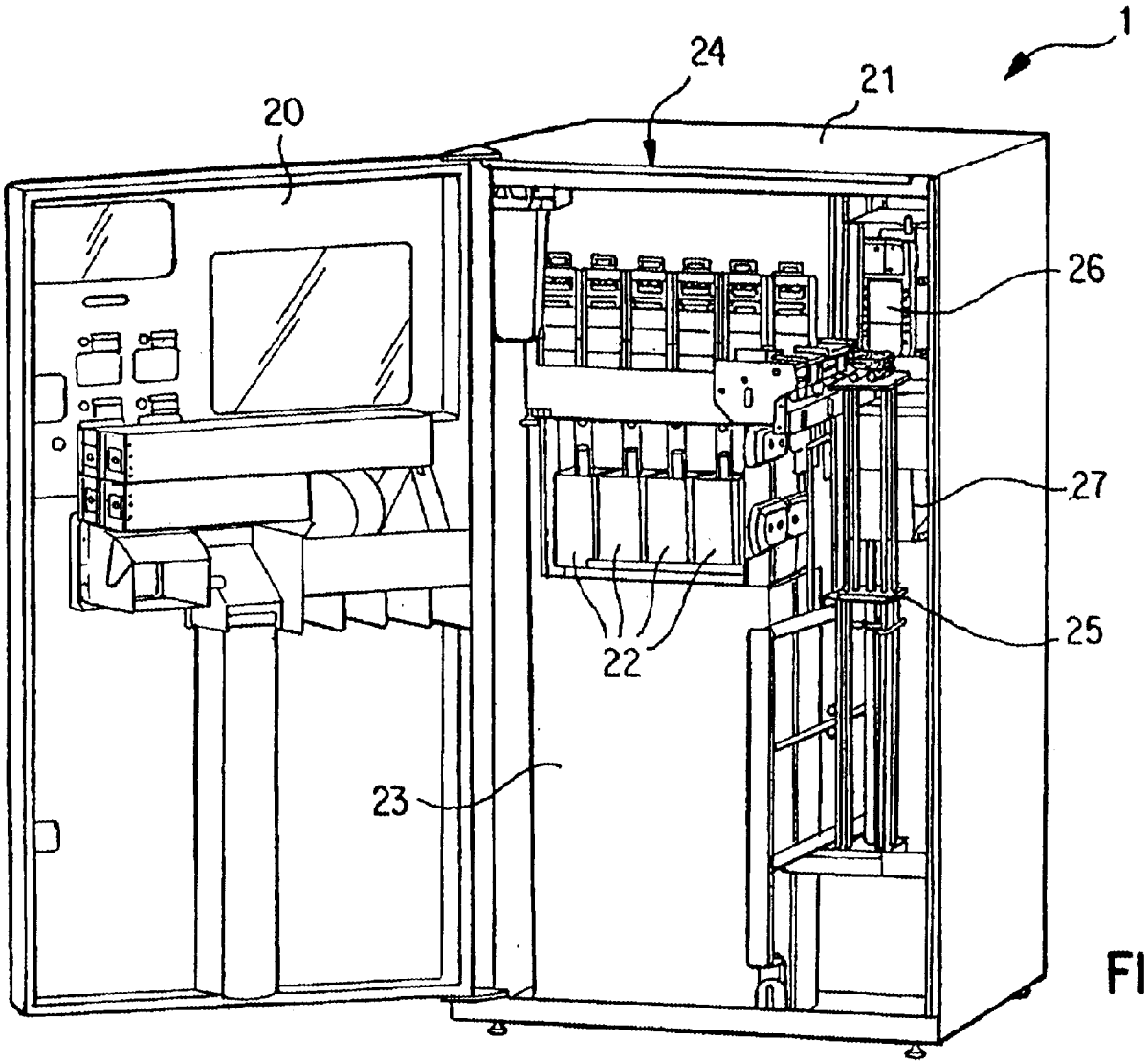
FIG. 2 shows a view of the example food dispensing machine of FIG. 1 with the front door of the machine opened.

FIG. 2 shows a view of the example food dispensing machine of FIG. 1 with the front door of the machine opened. As shown in FIG. 2, the door 20 of the machine 1 is openable via, for example, hinges attaching the door 20 to the machine body 21. In embodiments of the present invention, the interior of the body 21 includes several components that work in conjunction to produce the finished food product. As shown in FIG. 2, these components include one or more first food portion storage and dispensing devices 22, one or more second food portion storage and dispensing devices 23, a conveyance device or devices 24, 25 for conveying the food portions, for combining the food portions, for delivering the food portions to and removing the food portions from first and second heating components 26, 27, and for dispensing the finished food portions. In an embodiment of the present invention, the first food portion storage and dispensing devices 22 are enclosed or include a refrigerated section for maintaining the first food portion in a refrigerated condition until dispensing.

Figure 3:
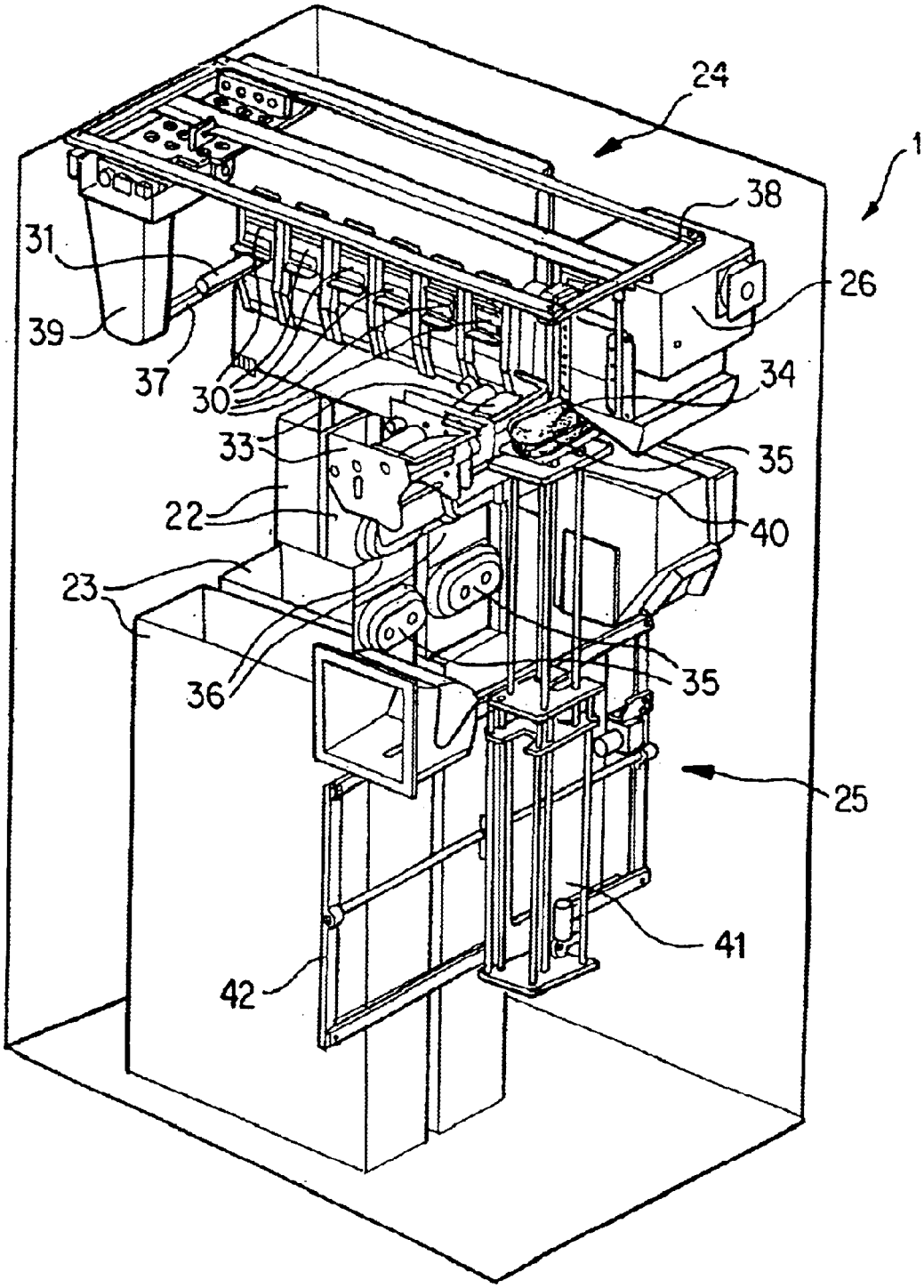
FIGS. 3, 4, 5 and 7 present cutaway views of the example food dispensing machine of FIG. 1.

FIGS. 3, 4, 5 and 7 present cutaway views of the example food dispensing machine of FIG. 1. As shown in FIG. 3, each of the first food portion storage and dispensing devices 22 is associated with a first food portion deployment device 30. As will be described further below, each serving of a first food portion 31, such as hot dogs, sausages, hamburgers, or other generally uniformly shaped food portions, is individually sealed within a connected film, which forms a chain of first food portions. During the preparation and dispensing of food products by the machine 1, each first portion deployment device 30 expels a single first food portion 31 for incorporation into a food product. In an embodiment of the present invention, the dispensing devices 22 for the first food portions are housed within a refrigerated portion of the device 1 until expelled.

Similarly, each of the second food portion storage and dispensing devices 23 is associated with a second food portion deployment device 33. As will be described further below, and as described further in applicants copending U.S. patent application Ser. No. 09/953,747 of Leonid Leykin, et al., filed Sep. 17, 2001, which is hereby incorporated by reference, each serving 34 of the second food portions is individually contained within a second food container 35 attached to a continuous film 36, which forms a chain of second food portions within containers. During the preparation of food products, each second portion deployment device expels a single second food portion 34 for incorporation into a food product. In an embodiment of the present invention, each second food portion 34 is also contained within a refrigerated section of the device 1 until dispensing.

In an embodiment of the present invention, the second food portion deployment device or devices 33 are attached to a frame that is swingably, such as by hinges or other pivoting mechanisms, or otherwise movable so as to allow access to components within the machine 1 that are located behind the second food portion deployment device or devices 33.

As further shown in FIG. 3, in an embodiment of the present invention, the first conveying portion 24, as described further below and as described further in applicants' copending U.S. patent application Ser. No. 09/953,745 of Leonid Leykin, et al., filed Sep. 17, 2001, which is hereby incorporated by reference, includes a first food portion receiving component 37 for receiving an expelled first food portion 31, a track component 38, and a first food portion conveying component 39. The conveying component 39 transports the first food portion receiving component 37 with the expelled first food portion 31 received thereon via the track component 38 to a first heating component 26, such as a combined infrared and microwave oven, as further described below and as also further described in applicants' copending U.S. patent application Ser. No. 09/953,745 of Leonid Leykin, et al., filed Sep. 17, 2001.

Figure 4:
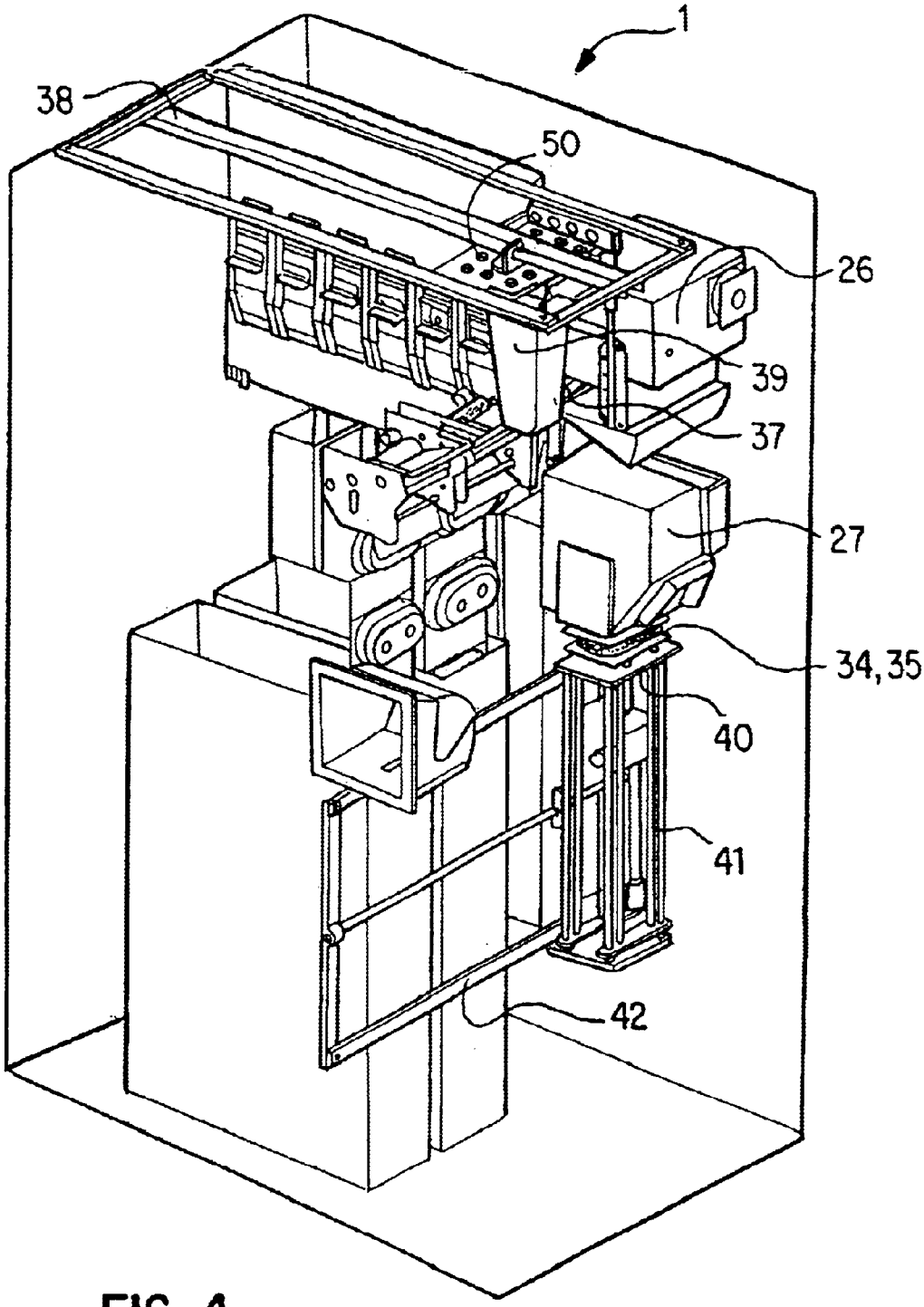

FIG. 4 contains a cutaway view of the example food dispensing machine 1 of FIG. 1, in which the conveying component 39 has transported the first food portion receiving component 37 via the track component 38 to the first heating component 26, such as a combination microwave and infrared oven. As shown in FIG. 4, a lateral movement portion 50, attached to the first food portion receiving component 37 and/or the conveying component 39, has laterally moved the first food portion receiving component 37, relative to the direction of motion of the conveying component 39 along the track component 38 (i.e., conveying component 39 has moved in a generally perpendicular direction relative to direction of motion of the conveying component 39 along track component 38), so as to place the first food portion receiving component 37 with the first food portion 31 within the heating component 26 for heating.

As shown in FIGS. 3 and 4, in an embodiment of the present invention, the second conveying portion 25 includes a tray component 40 and first and second tray transporting components 41, 42. As shown in FIG. 3, in operation, each second food container 35, containing a serving of a second food portion 34, is separated from the film 36 and placed on the tray component 40.

Figure 5:
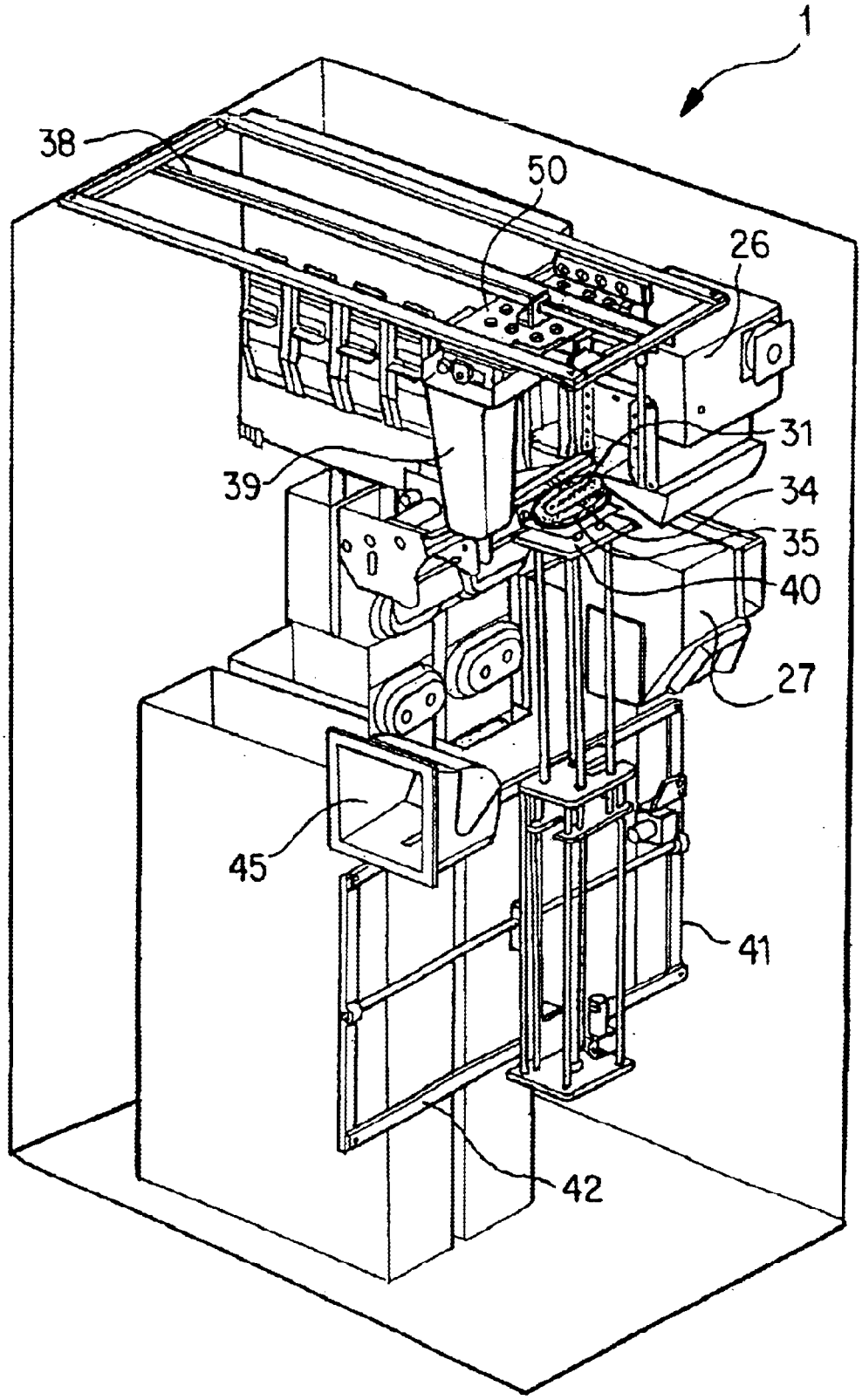
Figure 6:
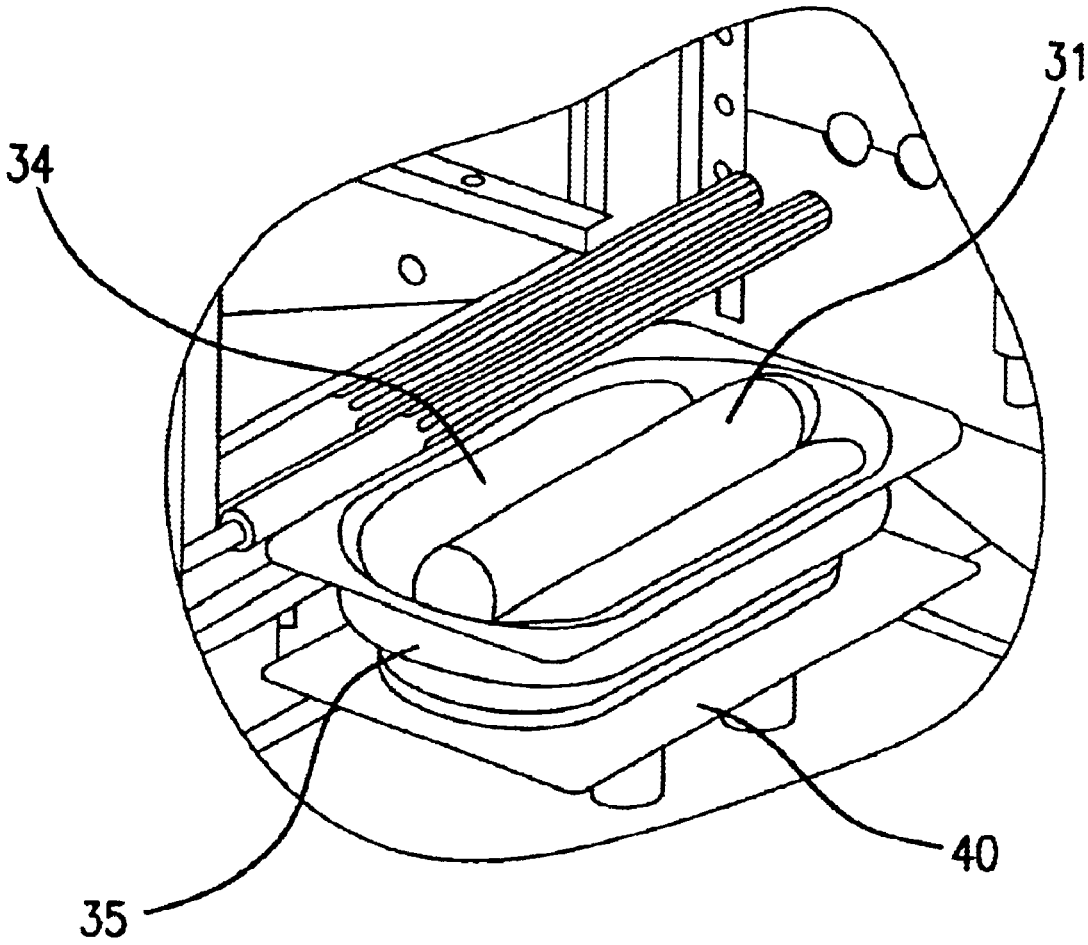
FIG. 6 shows a closeup of the combined first and second food serving, in accordance with an embodiment of the present invention.

As further shown in FIG. 4, the tray component 40 with the second food container 35 and second food portion serving 34 is transported by the transporting components 41, 42 to the second heating component 27, such as a microwave oven, for heating. Following heating of both the first food serving 31 and the second food serving 34, the second food container 35 and second food serving 34 are combined and then transported via the transporting components 41, 42 to a food combining location. As is discussed in greater detail below, for combining, the first food serving 31 is transported to the food combining location via the projecting component 37, the track component 38 and the conveying component 39 for combining of the first food serving 31 and the second food serving 34, as shown in FIG. 5. FIG. 6 shows a closeup of the combined first food serving 31 and second food serving 34, such as a hot dog placed in a bun, in second food container 35 on tray 40.

Figure 7:
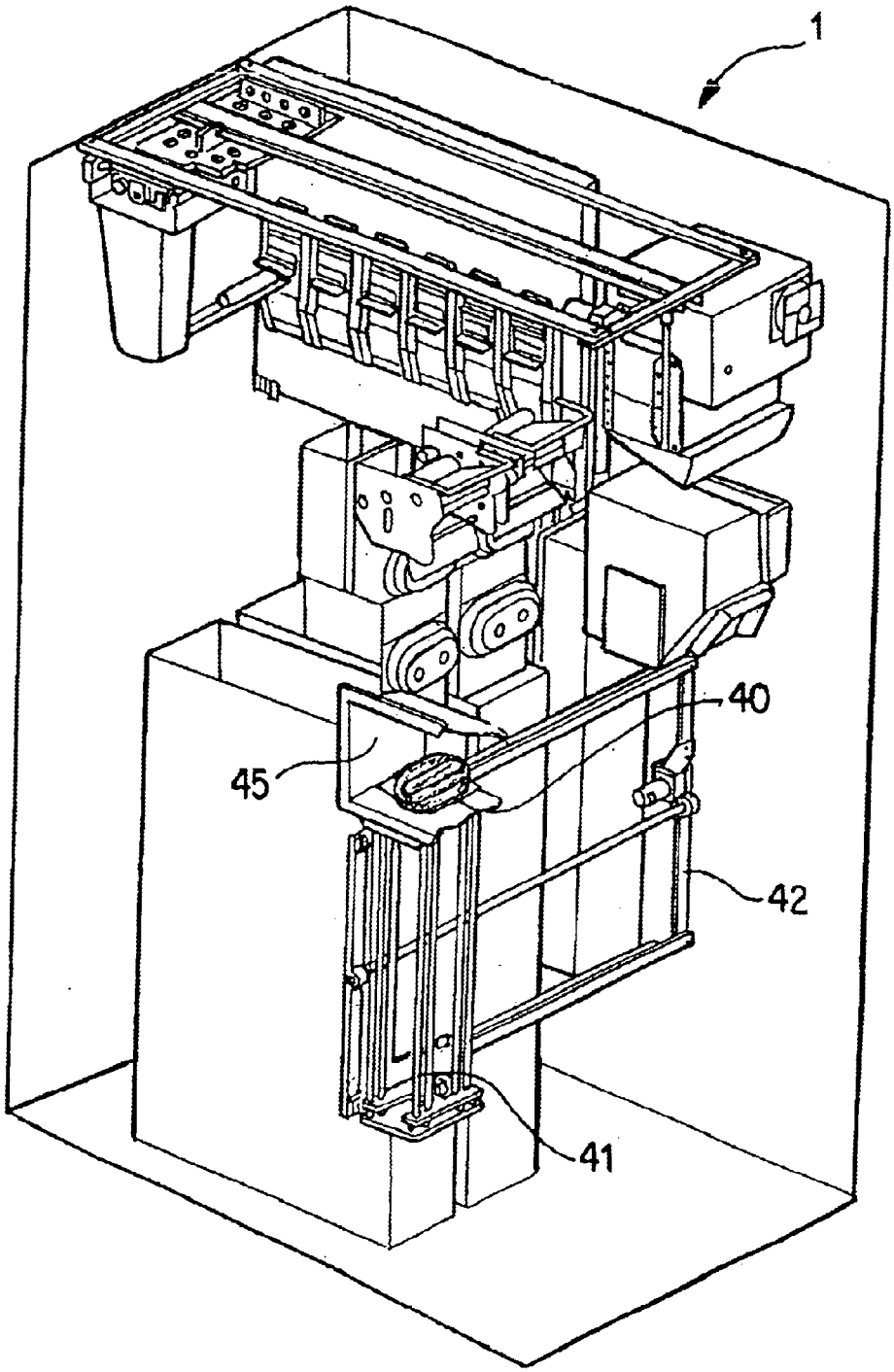

The second food container 35, containing the combined first food serving 31 and second food serving 34, is then transported via tray 40 and transporting components 41, 42 to food delivery compartment 45, as shown in FIG. 7, for dispensing of food via food dispensing port 4, as shown in FIG. 1.

Figure 8:
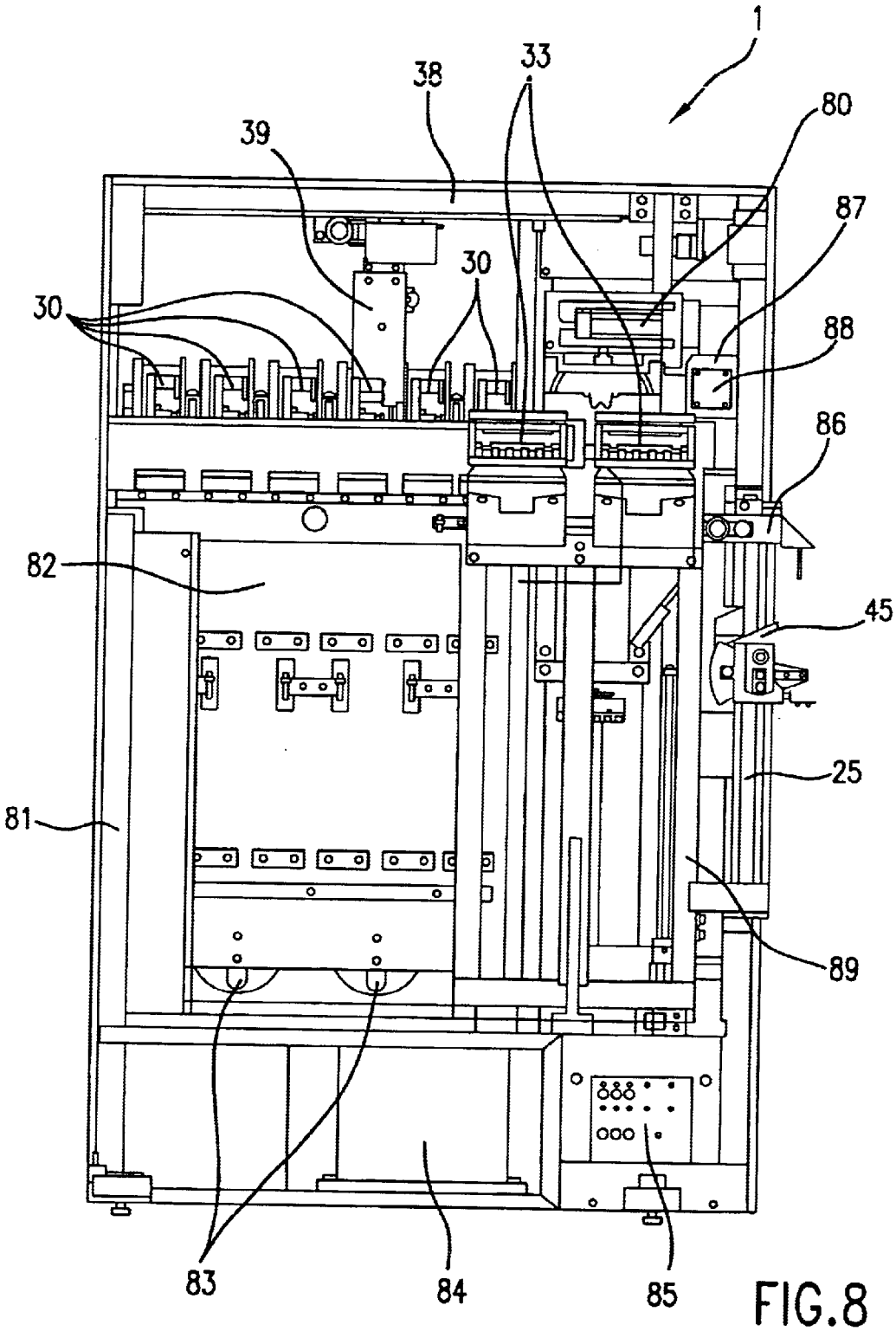
FIG. 8 is a view of another example vending machine, in accordance with an embodiment of the present invention.

Another embodiment of the vending machine 1 of the present invention is shown in FIG. 8. As shown in FIG. 8, the machine 1 of this embodiment, which is similar to the embodiment shown in FIG. 1, includes the following features: a display 80 for displaying information relating to dispensing of products,; a refrigerated section door 81, shown in FIG. 8 in an open position, for selectively enclosing first food servings stored in a refrigerated section 82; fans 83 utilized in the refrigerated section 82; a compressor 84 for use in conjunction with the refrigerated section 82; a distribution panel 85 usable to monitor various vending machine functions; a latch 86 for closeably latching the vending machine door 20, as shown in FIG. 2; a control panel 87 with keypad 88; and a second food portion storage and dispensing device holder 89.

An embodiment of the machine 1 includes electrical and electronic control equipment for controlling operation, including logic or other features known in the art for causing all operation of the machine 1 in response to input of money and selection of a food item for dispensing. In an embodiment of the present invention, the control panel 87 allows an operator to operate selectively the various components contained in the machine 1, such as for testing purposes. In an embodiment of the present invention, the control panel 87 is swingably, such as via hinges or other pivoting mechanisms, or otherwise movably attached within the machine 1, so as to allow the operator to move the control panel 87 to a convenient location during testing of components so as to allow viewing of operation of the components and so as to allow access to components within the machine 1 that are located behind the test operation control panel.

Figure 9:
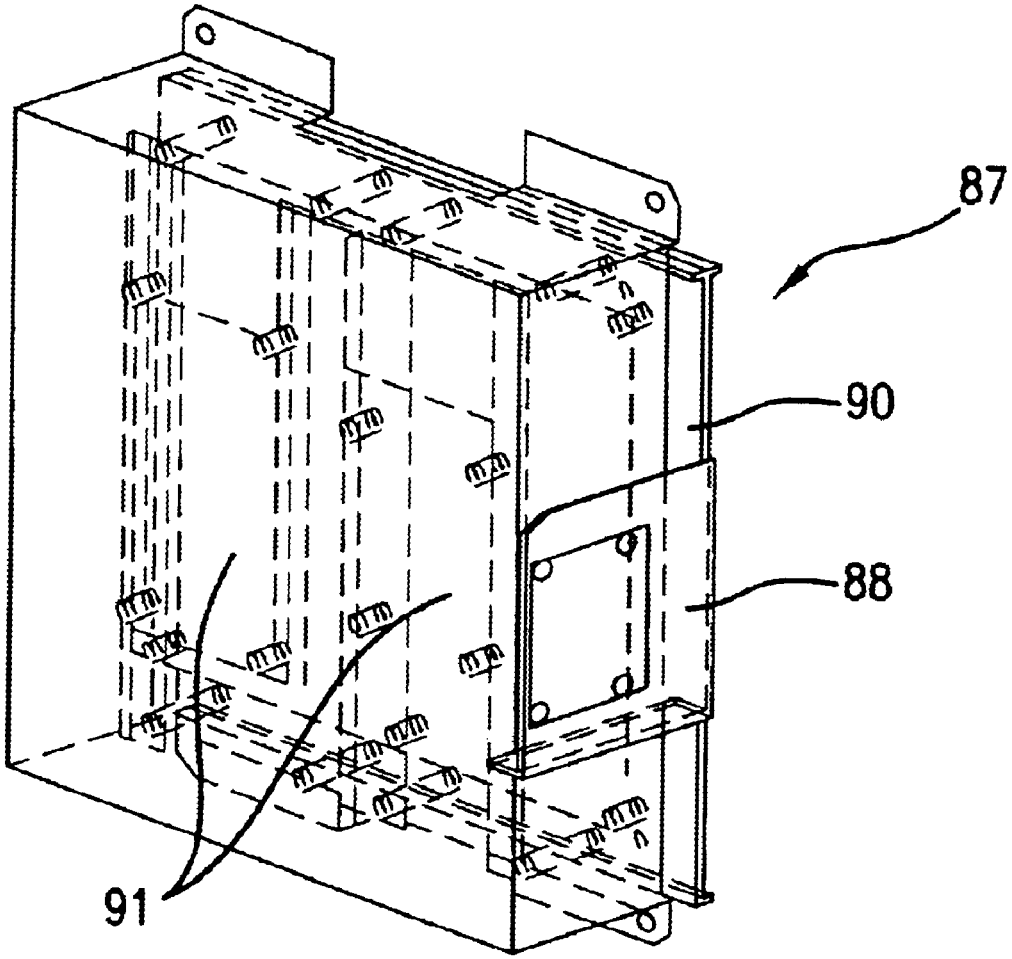
FIG. 9 shows an example control panel for use in accordance with the example vending machine embodiment of FIG. 8.

FIG. 9 presents a cutaway view of the control panel of the machine shown in FIG. 8, in accordance with an embodiment of the present invention. As shown in FIG. 9, the control panel 87 includes the keypad 88, frame 90, and one or more interface processor boards 91.

Figure 10:
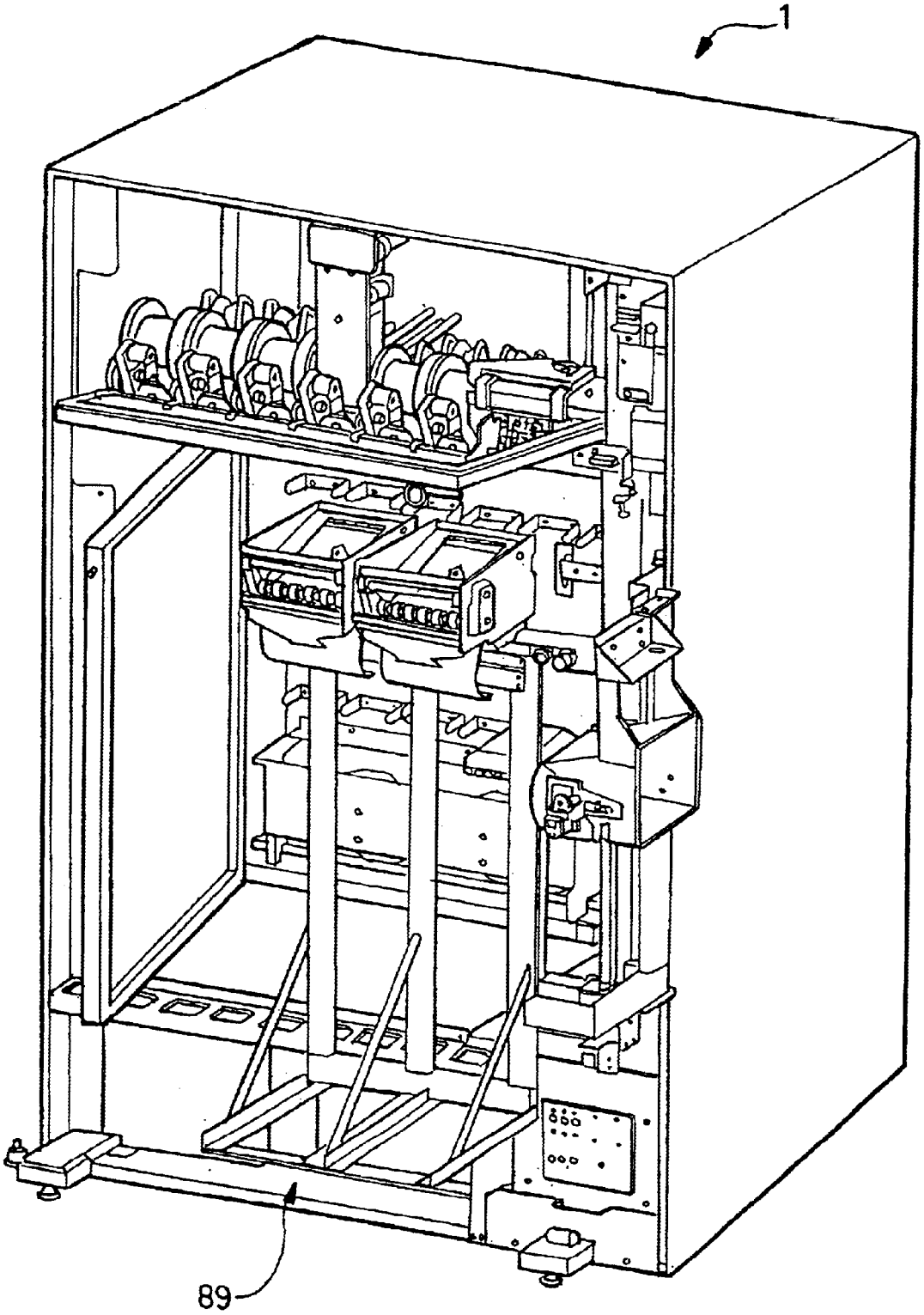
FIG. 10 shows a perspective view of the vending machine of FIG. 8, further including a second food portion storage and dispensing device holder, in accordance with an embodiment of the present invention.
Figure 11:
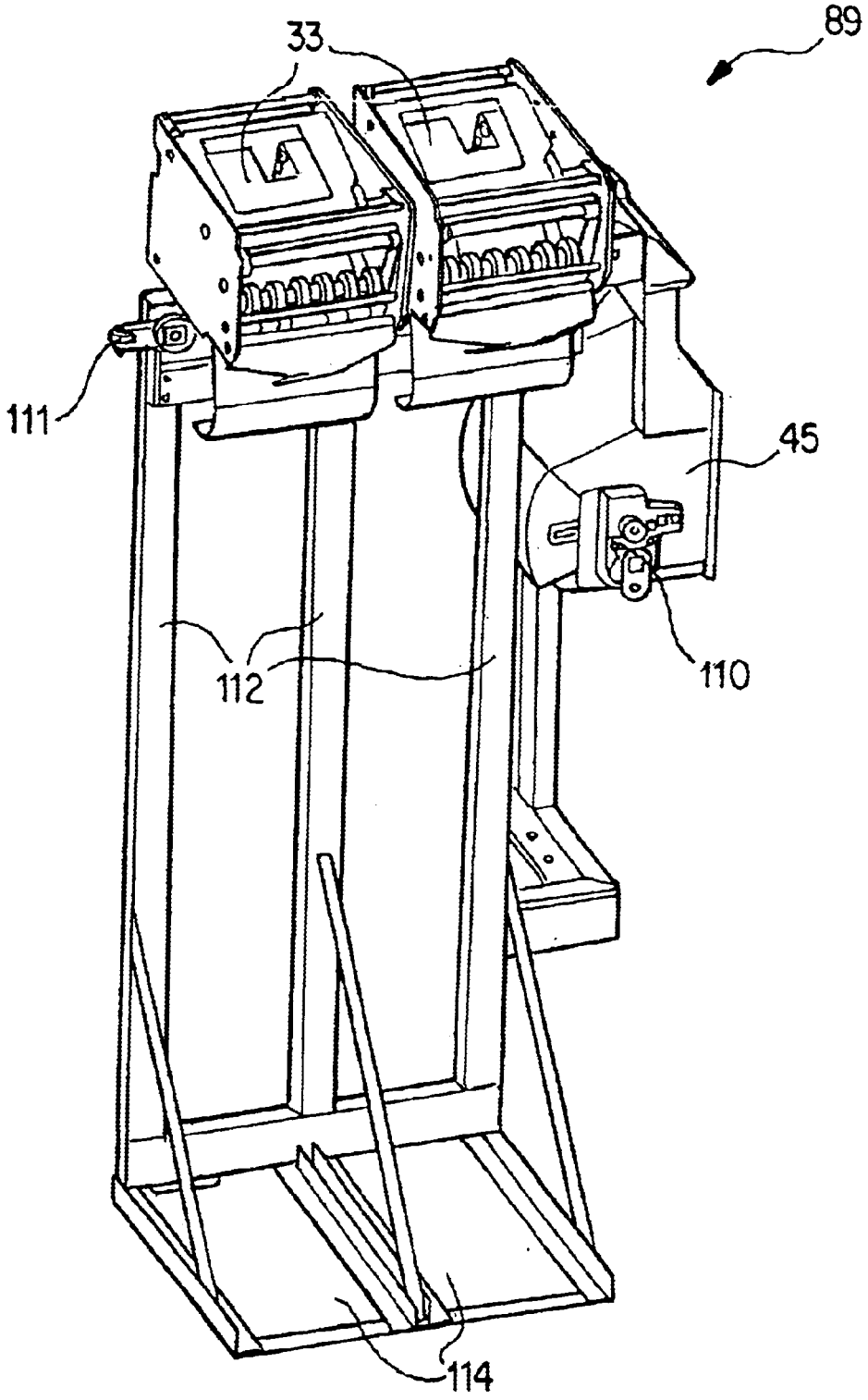
FIG. 11 is a closeup view of various components of the second food portion storage and dispensing dispenser holder shown in FIGS. 8 and 10.

FIG. 10 shows a perspective view of the vending machine 1 of FIG. 8, further including a view of a second food portion storage and dispensing device holder 89, in accordance with an embodiment of the present invention. FIG. 11 is a closeup view of various components of the second food portion storage and dispensing device holder 89 shown in FIGS. 8 and 10. As shown in FIG. 11, the holder 89 is attached or placed (e.g., fixed or selectively fixable) in close proximity to second food portion deployment devices 33 and food delivery compartment 45, which in this embodiment includes tray transporter device 110, such as an electric motor for transporting a tray 40 via transporting components 41, 42 to food delivery compartment 45, as shown in FIG. 7. In an embodiment of the present invention, the holder 89 is slidably or swingably movable, for example, to facilitate replacement of second food portion storage and dispensing devices and access of components of the vending machine 1 located behind the holder 89, as shown in FIGS. 8 and 10. Also shown in FIG. 11 are a frame latching mechanism 111 for selectively latchably fixing the holder 89 within the machine 1, vertical frame portions 112 of holder 89, and second food portion storage and dispensing device shelves 114 for supporting second food portion storage and dispensing devices 23 placed in holder 89.

Figure 12:
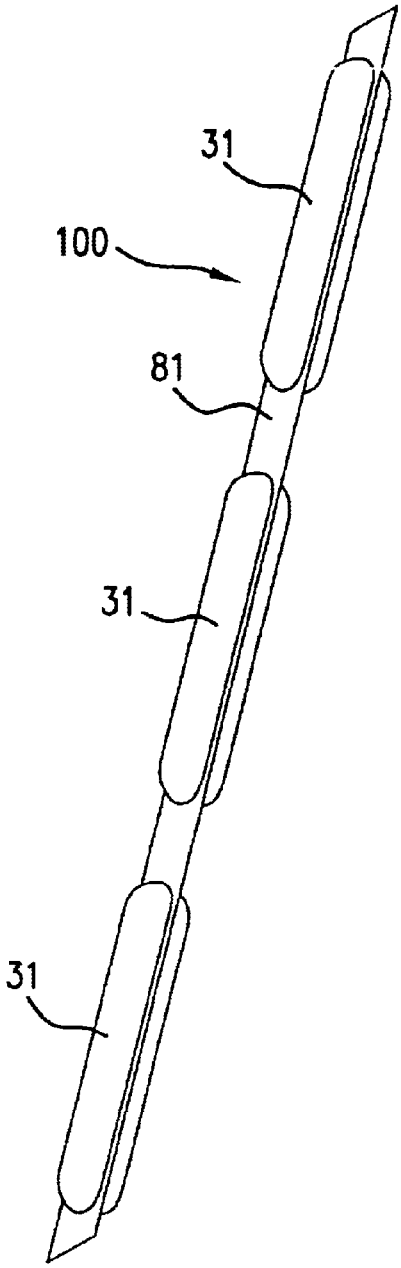
FIGS. 12 and 13 show views of an example chain of first food portion items, in accordance with an embodiment of the present invention.
Figure 13:
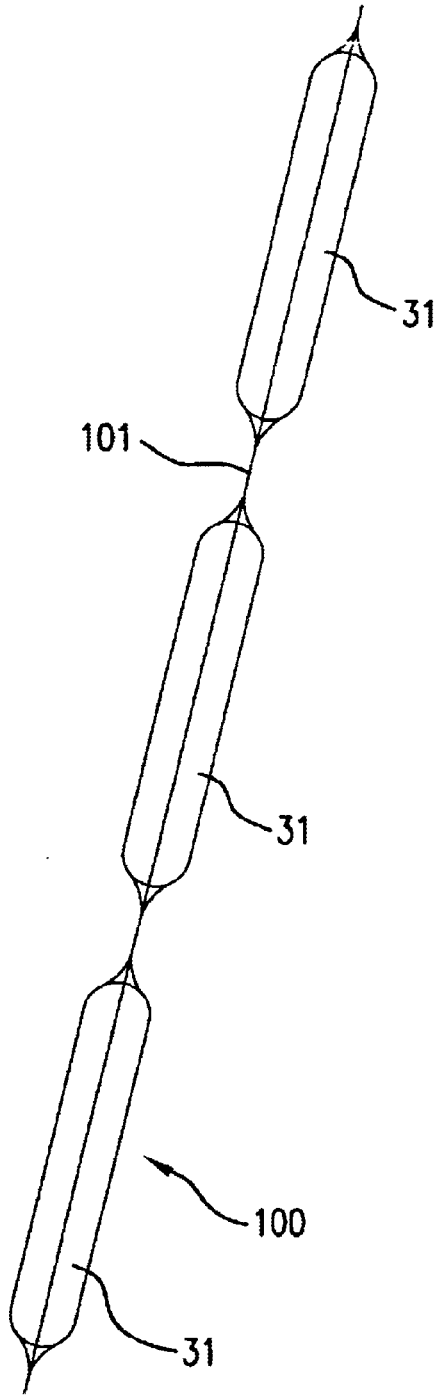

FIGS. 12 and 13 show views of an example chain of first food portion items, in accordance with an embodiment of the present invention. As shown in FIGS. 12 and 13, the chain of first food portion items 100 includes a series of individually sealed first food portions 31, such as hot dogs, sausages, hamburgers, or other generally uniformly shaped food portions, sealed and connected by a film 101. In an embodiment of the present invention, the chain is made by sandwichably enclosing each first food portion 31 between two halves of the film 101, the two halves then being bonded together, such as by gluing or heat welding, so as to seal each first food portion 31 within the film 101.

Figure 14:
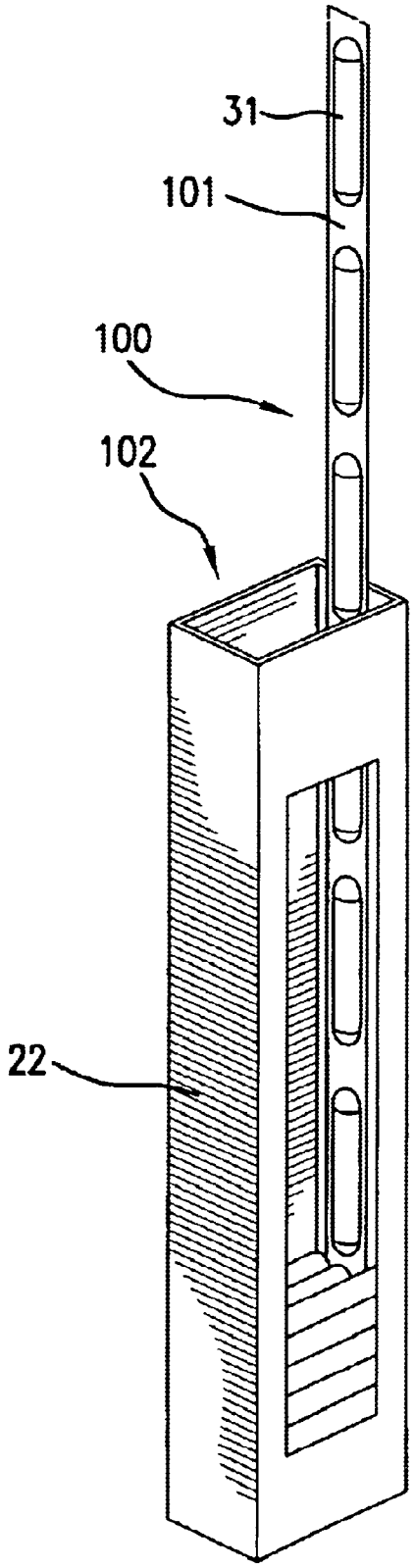
FIG. 14 is a perspective view of an example dispensing device for first food portions, in accordance with embodiments of the present invention.

FIG. 14 is a perspective view of an example dispensing device for first food portions, in accordance with embodiments of the present invention. The dispensing device 22 contains the chain of first food portions 100, which are dispensed from the device 22, such as via a top end 102 of the device 22.

The first food portion storage and dispensing device and the second food portion storage and dispensing device, each being self-contained and preloaded, allow easy replenishment within the food dispensing machine by replacement of each first food portion storage and dispensing device with a full food portion storage and dispensing device, as well as feeding of the chains of food portions into the dispensing mechanisms, as described further herein.

Figure 15:
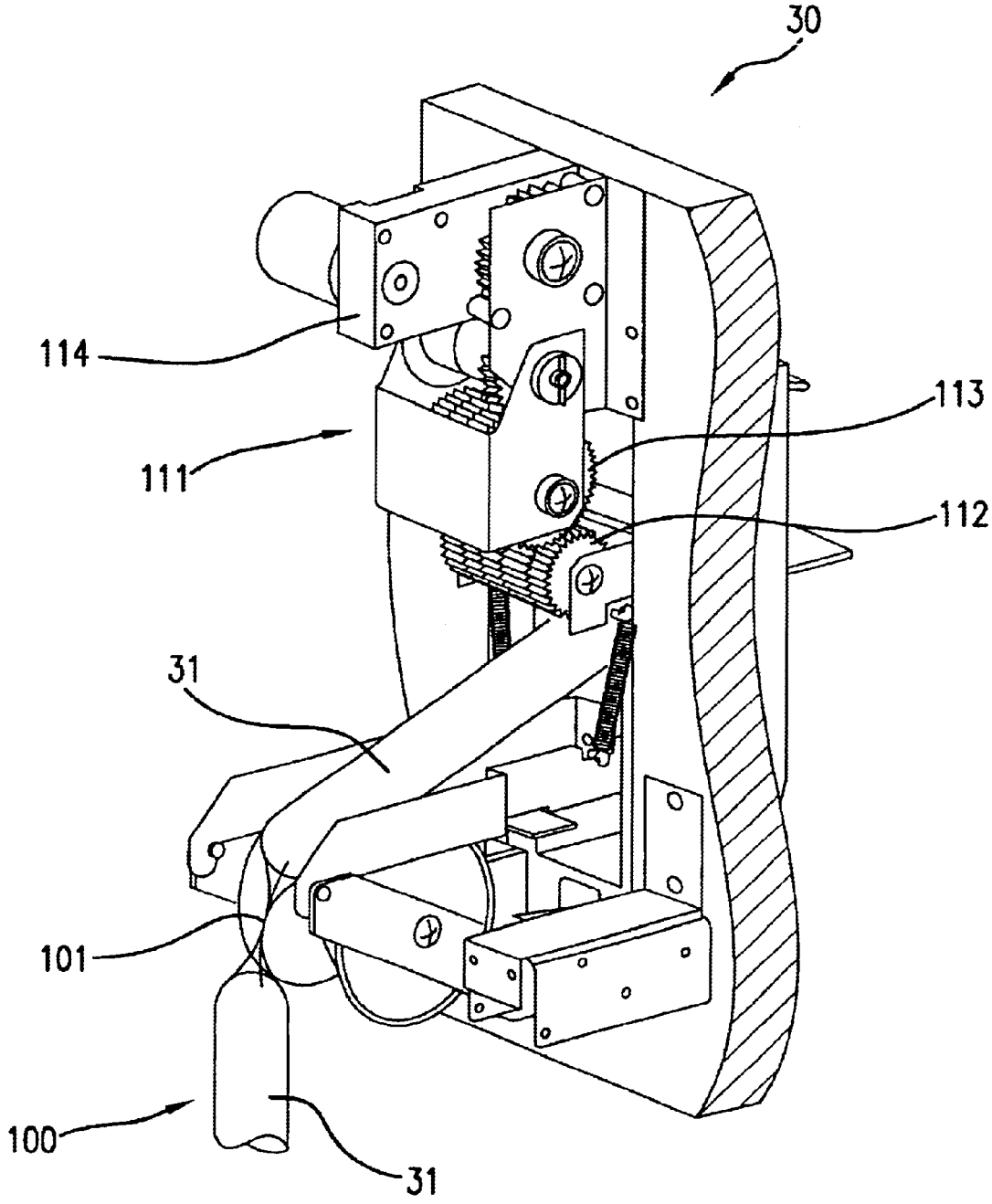
FIG. 15 presents a view of a first embodiment of the first food portion deployment device receiving a first food portion from a chain of first food portions, in accordance with the present invention.

FIGS. 15–32 present various views and closeups of components relating to the first food portion deployment device, in accordance with the present invention. As shown in FIG. 15, the first food portion deployment device 30 of the present invention receives first food portions 31 from a chain of first food portions 100, which includes a connecting and enclosing film 101. In an embodiment of the present invention, the chain of first food portions 100 is received from a dispenser, as, for example, is shown in FIG. 14.

The first food portion deployment device 30, in accordance with the present invention, includes a pulling component 111. In one embodiment of the present invention, the pulling component 111 includes first and second wheels 112, 113 which engage the film 101 of the chain of first food portions 100. In this embodiment, the second wheel 113 is driven through a transmission from a motor 114. The first and second wheels 112, 113 are engageably connected, such as via teeth.

Figure 16:
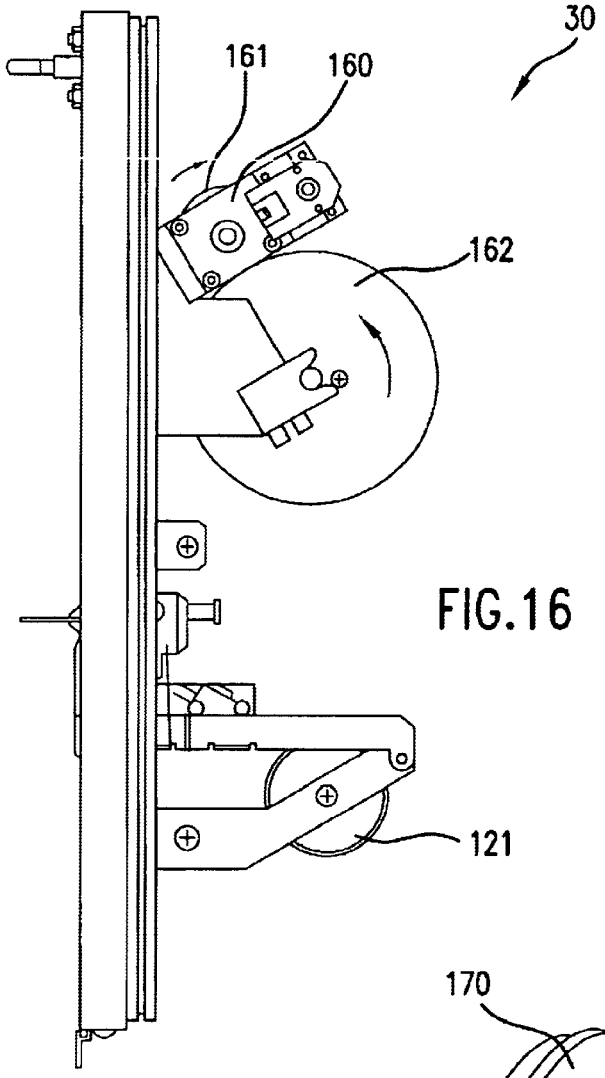
FIG. 16 presents a view of a second embodiment of the first food portion deployment device, in accordance with an embodiment of the present invention.
Figure 17:
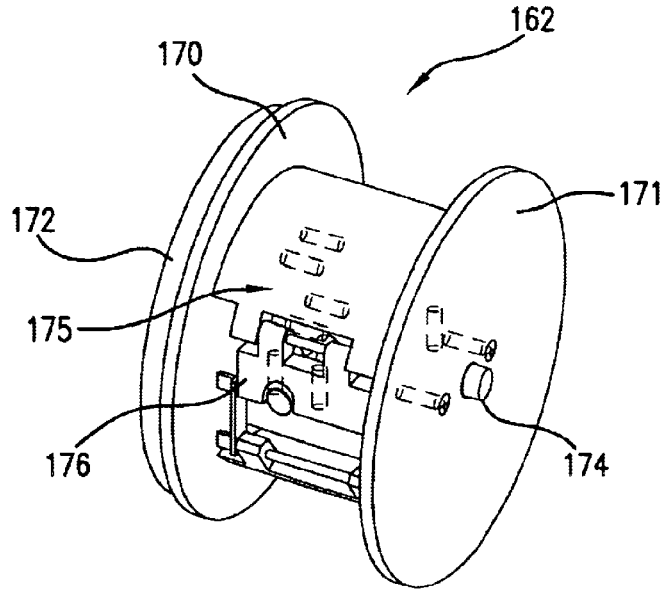
FIG. 17 is a closeup of a generally spool shaped wheel portion of the embodiment of the first food portion deployment device of FIG. 16.
Figure 18:
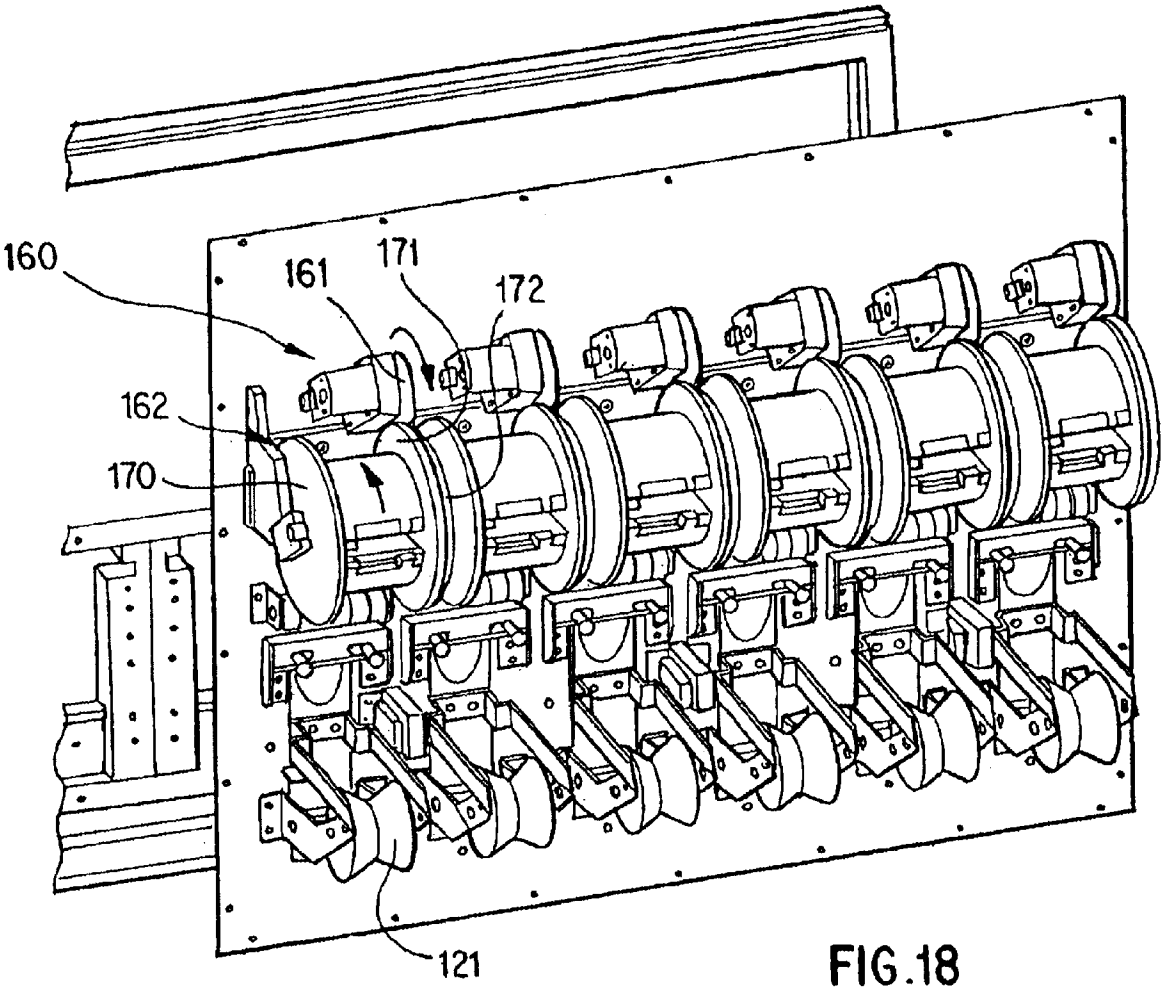
FIG. 18 contains a perspective view of a plurality of first food portion deployment devices, in accordance with the embodiment of FIG. 16.

In another embodiment of the present invention, as shown in FIGS. 16–18, a pair of wheels 161, 162 frictionally or otherwise engaged with one another are used in lieu of the first and second toothed wheels 112, 113 shown in FIG. 15. In an embodiment of the present invention, as shown in FIG. 16, a pulling component 160, including, for example, a first wheel 161, is frictionally or otherwise engaged with a second wheel 162. In one embodiment, as shown in FIG. 17, the second wheel 162 is generally spool-shaped and, via rotational motion about, for example, axle 174, storably takes up film 101, which wraps about interior spool portion 175, which includes, for example, film end engagement and release mechanism 176. In this embodiment, the second wheel 162 has, for example, first and second rim portions 170, 171, with first rim portion 170 including frictional engagement extension 172 for frictionally engaging with first wheel 161, as shown in FIG. 18.

In another embodiment of the present invention, at least one of the wheels of the first food portion deployment device 30 includes a non-rigid outer surface, such as a surface that comprises rubber or other soft material, for engaging the film 101. In this embodiment, the first wheel has a much larger diameter than the second wheel, and the film 101 wraps around the first, larger diameter wheel as the film 101 is pulled. Because of the larger diameter of the wheel taking up the film 101, as the film wraps around the larger diameter wheel, the effective diameter of the larger diameter wheel with the wrapped film 101 varies little relative to the larger diameter wheel without the wrapped film 101. As a result, a large amount of film 101 can be wrapped around the larger diameter wheel before removal of the film 101 from the wheel is required.

Figure 19:
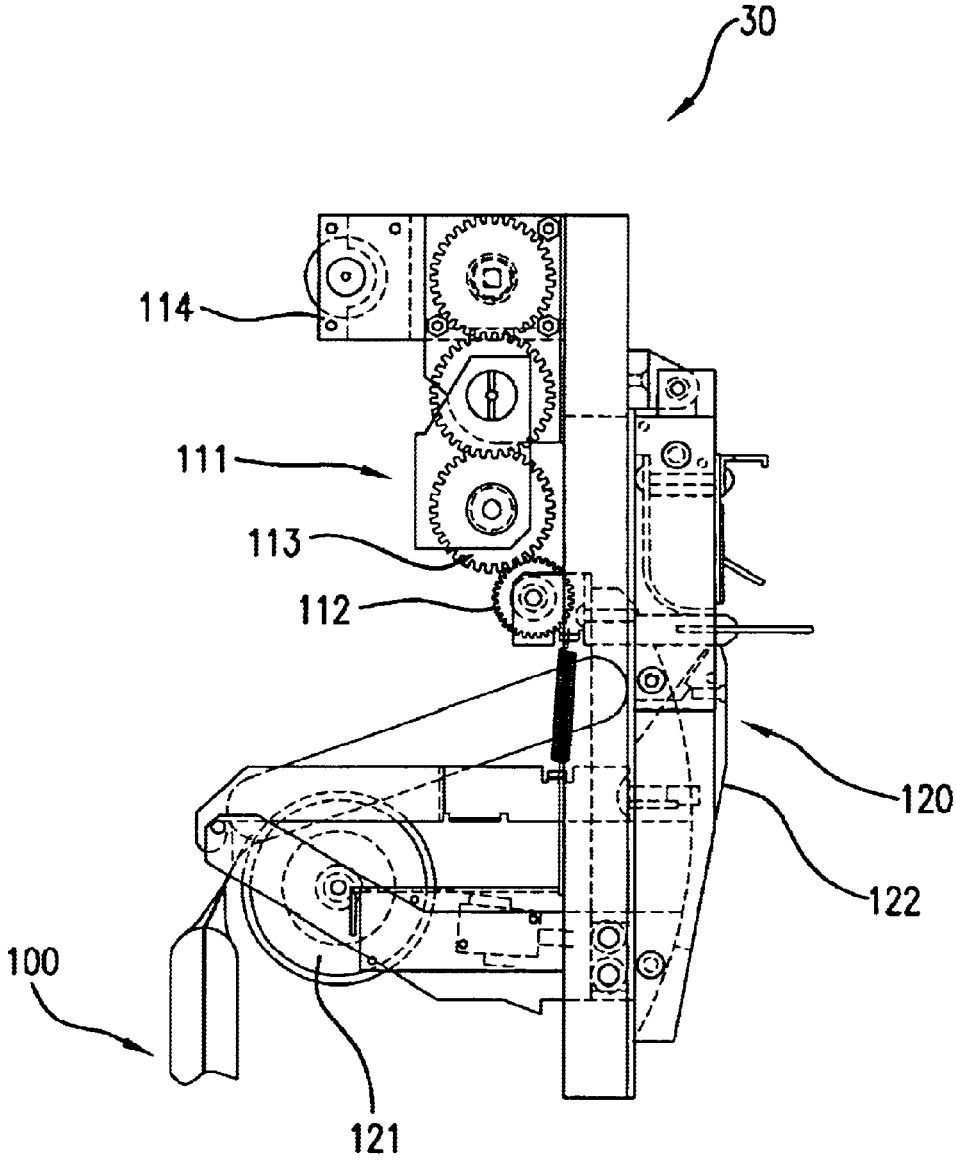
FIGS. 19 and 20 show the first food portion deployment device of FIG. 15 and a closeup of the cutter component, in accordance with an embodiment of the present invention.
Figure 20:
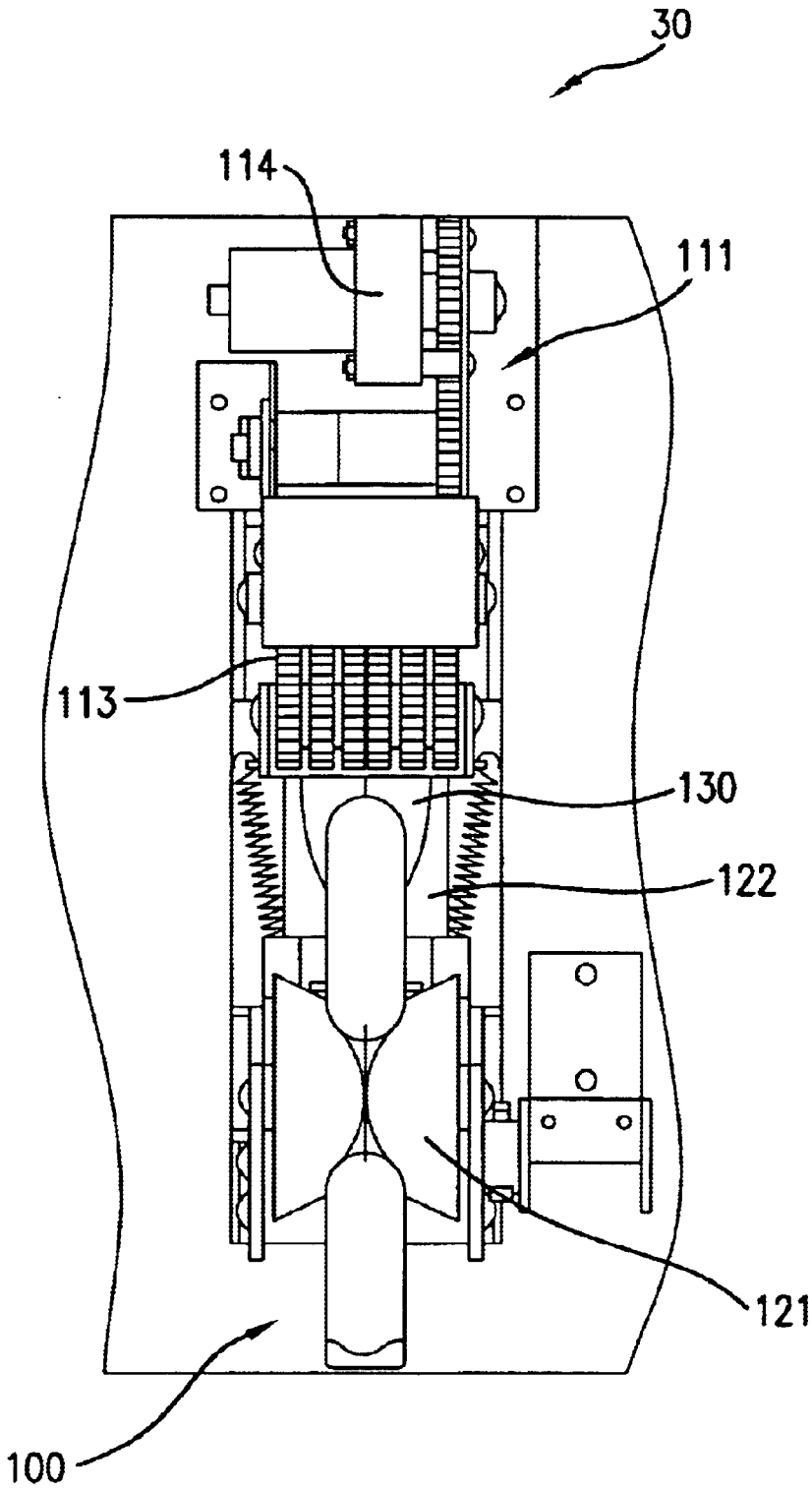
Figure 21:
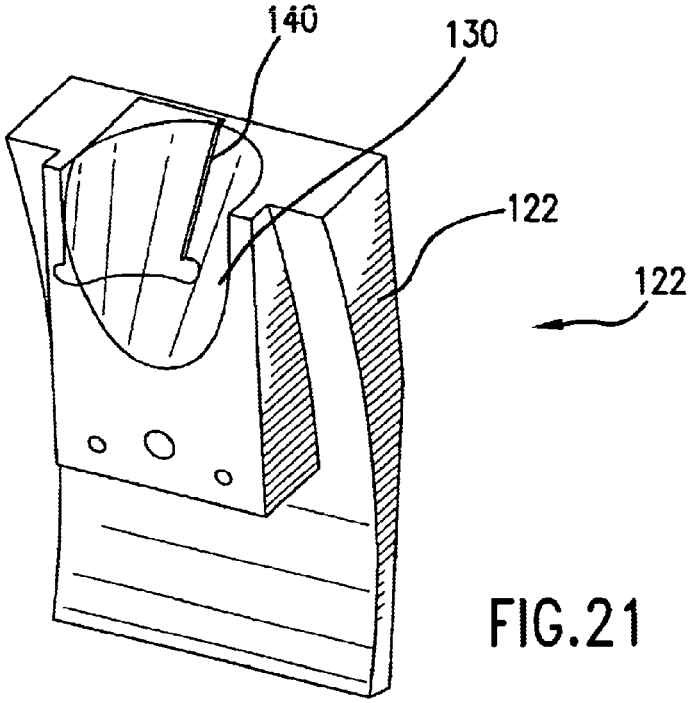
FIG. 21 presents a close up view of the holder, showing the ramp portion with a generally concave surface, in accordance with an embodiment of the present invention.

As shown in FIGS. 19 and 20, the first food portion deployment device 30 further includes a cutter component 120. As further shown in FIG. 19, in an embodiment of the present invention, the first food portion deployment device 30 also includes directing features, such as a wheel or wheels 121 for guiding the first food portions 31 into the cutter component 120.

The cutter component 120 includes a holder 122, which, as is shown in FIG. 20, is provided with a ramp portion 130. In an embodiment of the present invention, as shown in the close up view of the holder 122 presented in FIG. 21, the ramp portion 130 has a generally concave surface. A cutter 140, such as a blade, is located on the ramp portion 130 and, in an embodiment of the present invention, projects slightly from the surface of the ramp portion 130. As is further shown in the cross-sectional view of the holder 122 shown in FIG. 22 and the closeup A shown in FIG. 23, in operation, a first component food portion 31 is frictionally drawn past ramp 130, resulting in cutter 140 cutting through film portion 180 of film 101.

In one embodiment of the present invention, the cutter 140 is easily replaceable, such as when dull. In another embodiment of the present invention, the cutter 140 is attached to an easily removable plate or insert to facilitate replacement.

FIGS. 24–27 show various views and closeups of features of the cutter component and cutter, in accordance with embodiments of the present invention.

Figure 28:
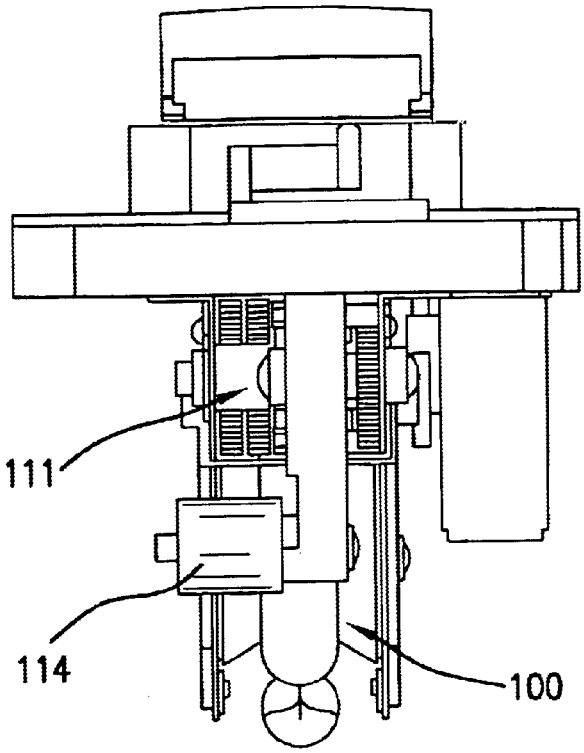
FIG. 28 contains an overhead view of the first food portion dispensing device of FIG. 15.
Figure 29:
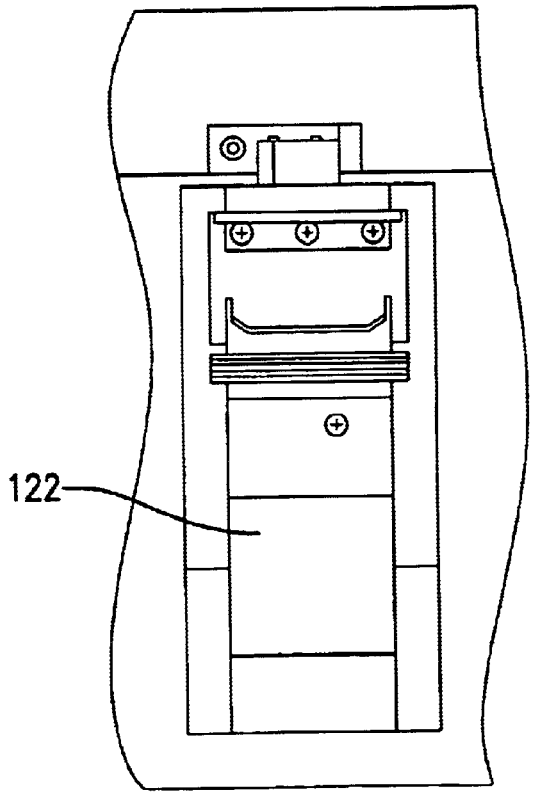
FIG. 29 shows an expelling side view of the first food portion dispensing device of FIG. 15.

FIG. 28 contains an overhead view of the first food portion dispensing device of FIG. 15. FIG. 29 shows an expelling side view of the first food portion dispensing device of FIG. 15.

Figure 30:
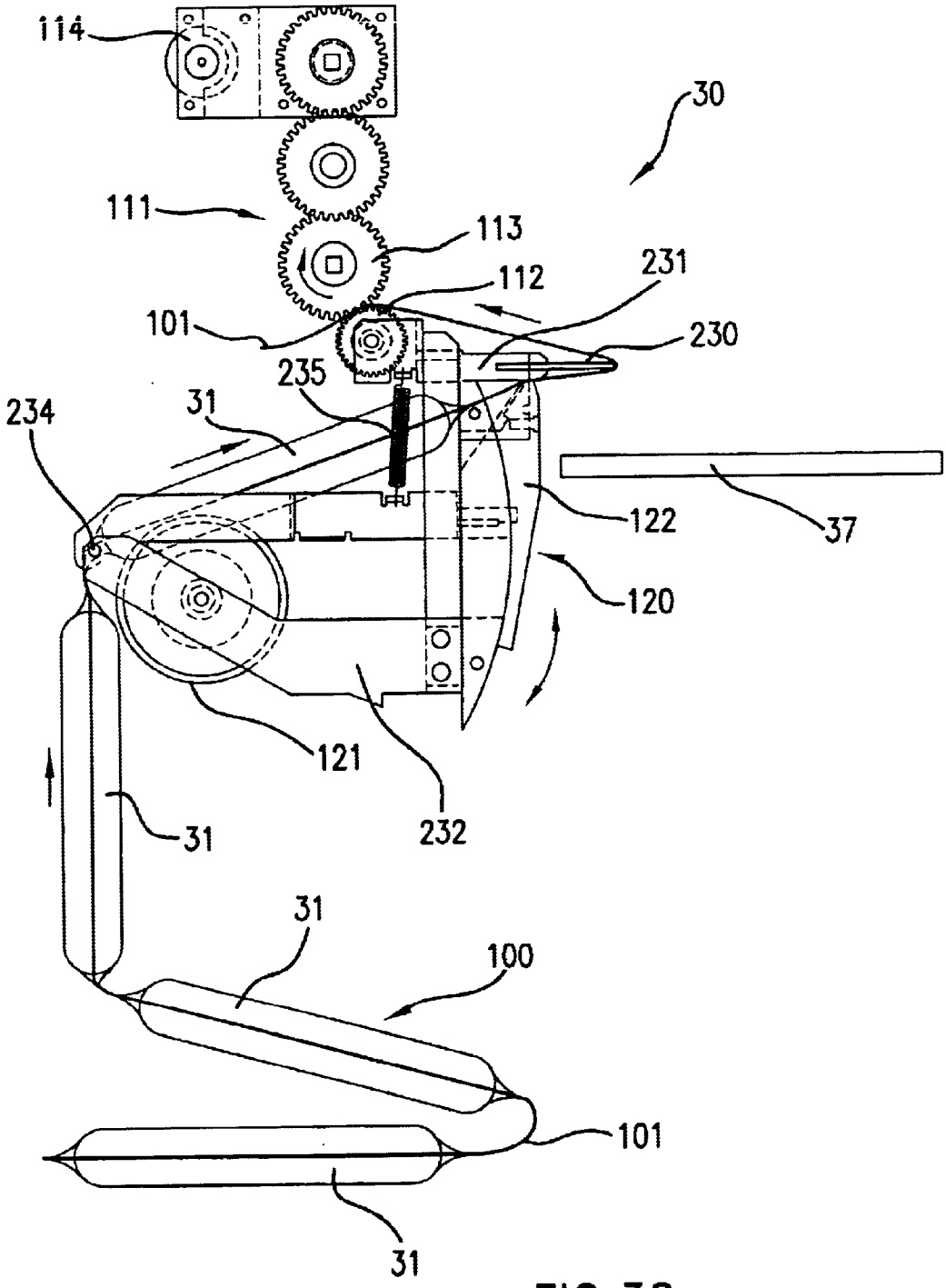
FIGS. 30–32 illustrate operation of the first food portion dispensing device, in accordance with embodiments of the present invention.
Figure 31:
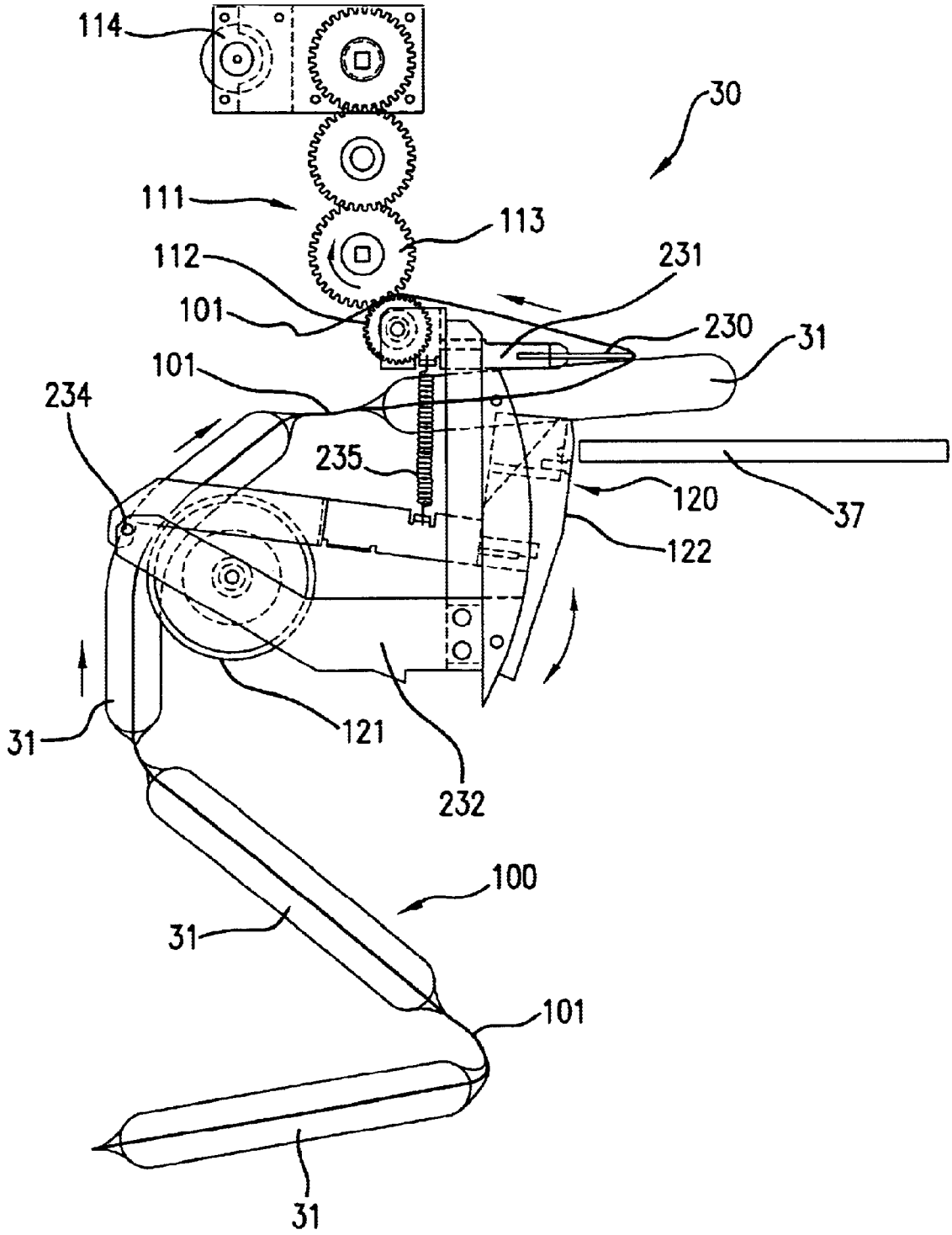
Figure 32:
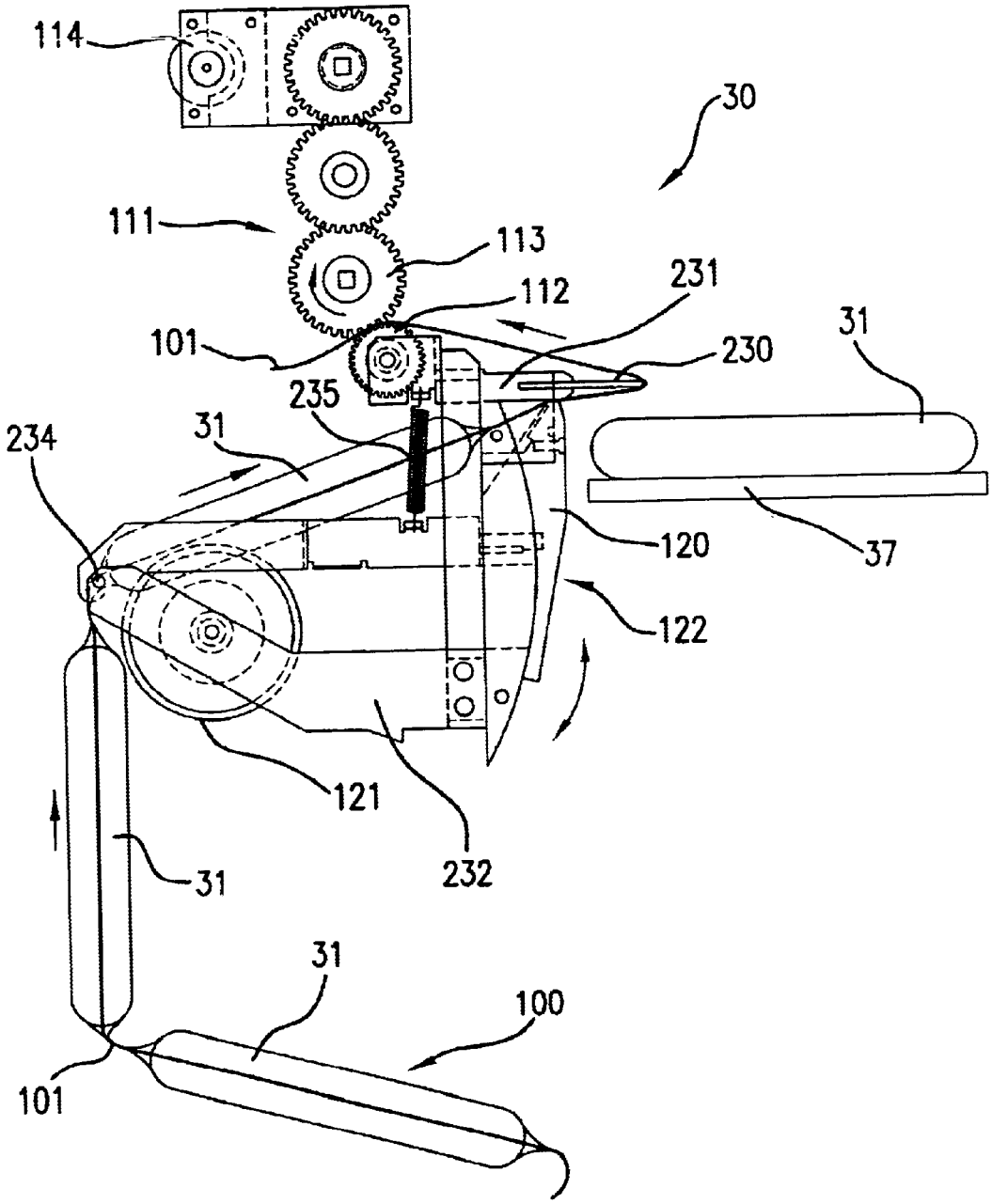

FIGS. 30–32 illustrate operation of the first food portion dispensing device, in accordance with embodiments of the present invention. As shown in FIG. 30, a first food portion 31 is drawn via pulling of the film 101 by the first and second wheels 112, 113. In an embodiment of the present invention, the film is also drawn past a projection 230, such as an attached plate with a straight edge, such that the film 101 generally reverses direction. For example, the film 101 is pulled generally toward the right, as shown in FIG. 30, below the projection 230, and is pulled generally to the left, as shown in FIG. 30, above the projection 230.

In an embodiment of the present invention, the holder 120, containing the cutter component 122, is adjustably positionable relative to an abutting feature 231, such as a support for or attachment to the projection 230. In one embodiment of the present invention, the holder 120 is pivotably attached to the first food portion deployment device 30 via an arm 232 attached at a pivot point 234, the holder 120 and arm 232 being biased toward the abutting feature 231, such as via a spring or springs 235.

Figure 22:
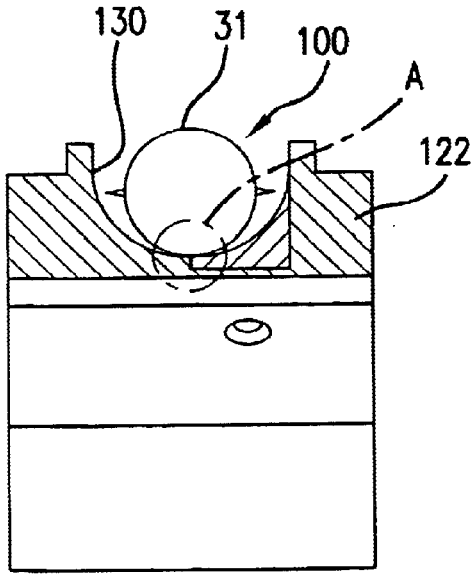
FIG. 22 is a cross-sectional view of the holder of FIG. 21.
Figure 23:
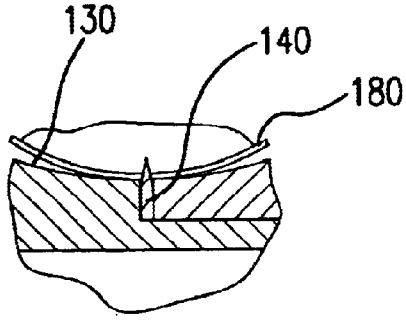
FIG. 23 contains a view of the closeup A of the holder and cutter, in accordance with an embodiment of the present invention.
Figure 24:
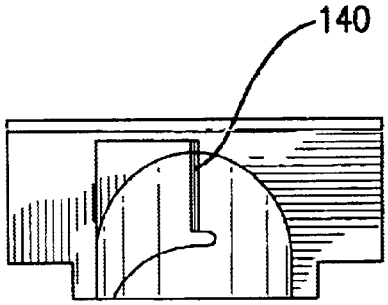
FIGS. 24–27 show various views and closeups of features of the cutter component and cutter, in accordance with embodiments of the present invention.
Figure 25:
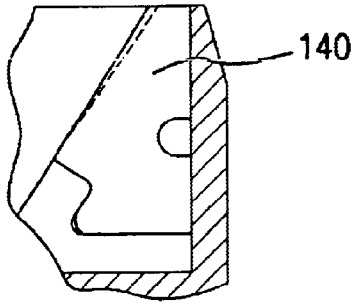
Figure 26:
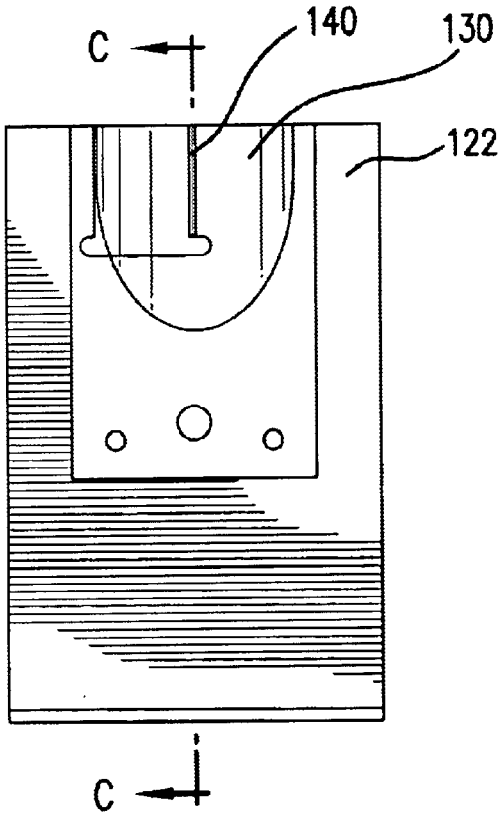
Figure 27:
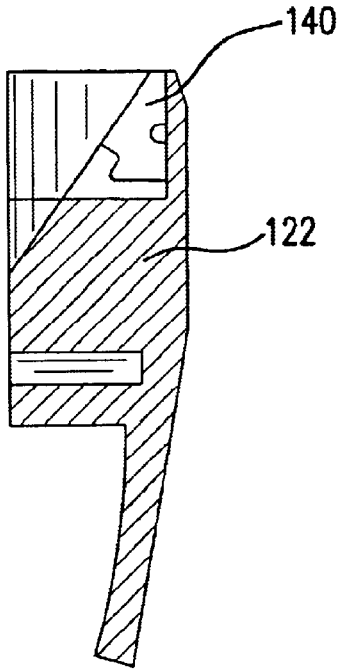

Operation of the first food portion deployment device 30 is further shown in FIG. 31. As shown in FIG. 31, as the film 101 is pulled by the pulling component 111, a first food portion 31 slidably engages the ramp 130 of the holder 122 and the cutter 140, as shown in FIGS. 22 and 23. The bottom portion of the film 101 about the first food portion, as shown in FIG. 30, about the first food portion 31 is sliced by the cutter 140. As the film 101 continues to be pulled by pulling component 111 and the film 101 is generally reversed in direction about the projection 230, the film 100 is separated from the first food portion 31, and the first food portion 31 slidably passes between the cutter component 121 and the abutting feature 231. The operation of the film 101 being pulled in conjunction with cutting by the cutter 140 in the holder 122 causes the first food portion 31 to be expelled from the film 101.

As shown in FIG. 32, the film 101 is continually pulled until the first food portion 31 is fully separated from the film 101 and has passed the cutter component 121 and the abutting feature 231. In an embodiment of the present invention, the separated first food portion 31 is then received by the first food portion receiving component 37.

FIGS. 33–46 present views of the first heating component and the conveying component, as well as features and subparts thereof and interactions therebetween, in accordance with embodiments of the present invention.

Figure 33:
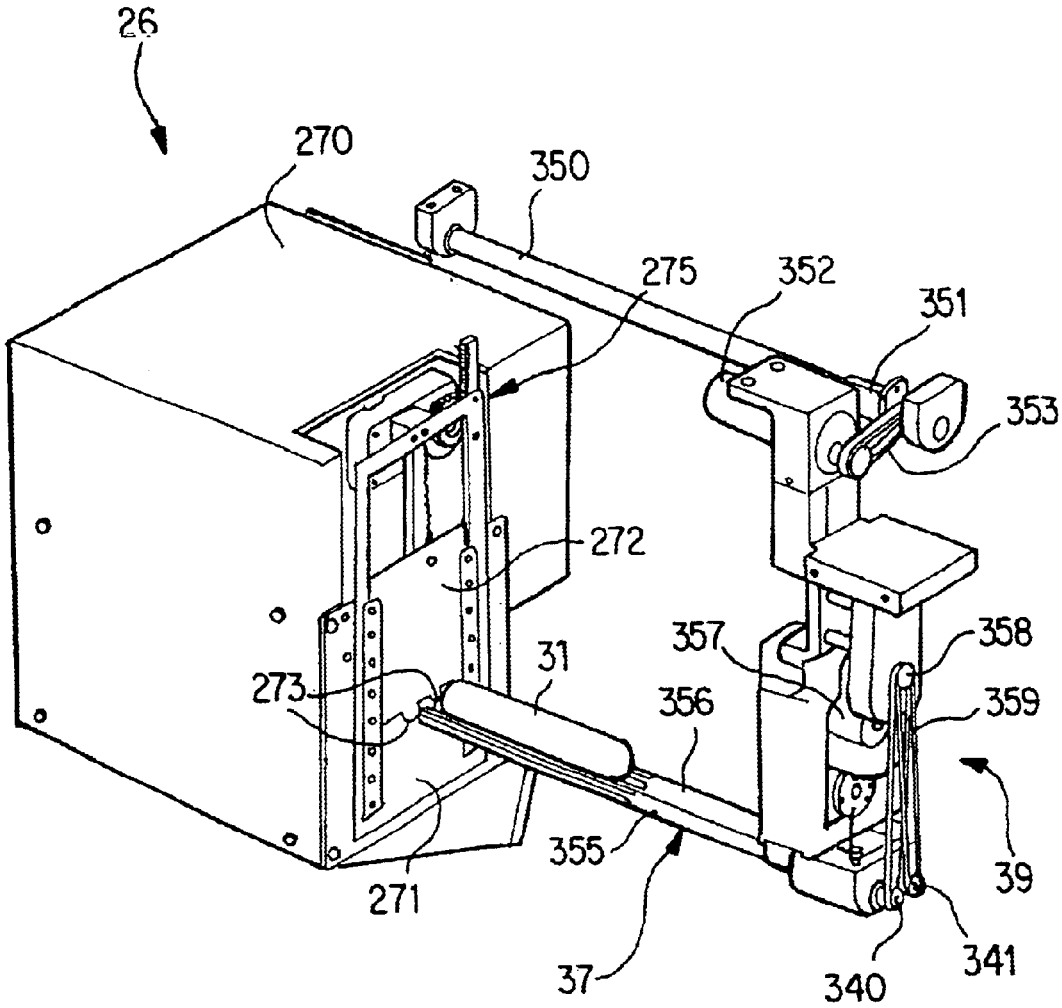
FIG. 33 presents an overview of the various components of an exemplary first heating device, in accordance with an embodiment of the present invention.

As shown in FIG. 33, in one embodiment of the present invention, the first heating component 26, which is used, for example, to heat the first food portion 31 via infrared and microwave heating, includes an exterior housing 270, a fixed door portion 271, a movable door portion 272, openings 273 for receiving the first food portion receiving component 37, and door mover device 275. In one embodiment of the present invention, openings 273 are formed by arced recesses in the fixed door portion 271 and the movable door portion 272.

Also as shown in FIG. 33, the conveying component 39 is movable in axial direction Q so as to allow movement of the first food portion receiving component 37 into and out of the first heating component 26. This movement may be accomplished via a number of mechanisms known in the art, which are included in or make up the lateral movement portion 50. For example, as shown in FIG. 33, one embodiment of the conveying component 39 includes or is attached to a fixed portion 350 parallel to axial direction Q. A driven portion 351 is movable along the fixed portion 350. For example, in one embodiment, fixed portion 350 comprises a cylindrically shaped rod having an external thread. Driven portion 351 comprises a movable and drivable portion having an internal thread matable with the external thread of the fixed portion 350. In operation, to cause movement of the attached first food portion receiving component 37 into and out of the first heating component 270, a driving device 352, such as a motor, drives the driven portion 351, such as via a belt or other mechanism known in the art for coupling a motor to a rotatable member, so as to rotate the driven portion 351, producing axial motion along the fixed portion 350 via the mated threads.

In an embodiment of the present invention, the first food portion receiving component 37 includes a pair of cylindrical extensions 355, 356 operatively connected to driving and moving features of the conveying component 39. In an embodiment of the present invention, the cylindrical extensions 355, 356 include exterior friction portions, such as grooves, and are rotatable by features of the conveying component 39 so as to turn the first food portion 31 placed thereupon, such that the turned first food portion 31, while placed inside the first heating component 270, is uniformly heated. In addition, the conveying component 39 also includes moving features capable of separating the pair of cylindrical extensions 355, 356, as discussed further below, so as to allow the first food portion 31 placed thereupon to be deposited (e.g., dropped) to a location below the first food portion receiving component 37.

In an embodiment of the present invention, the conveying component includes a second driving device 357, such as a motor, connected to an output shaft 358, in turn coupled, such as via a belt or belts 359, to extending shafts 340, 341 of the cylindrical extensions 355, 356, respectively, so as to allow rotation and relative motion (e.g., separation) of the cylindrical extensions 355, 356.

Figure 34:
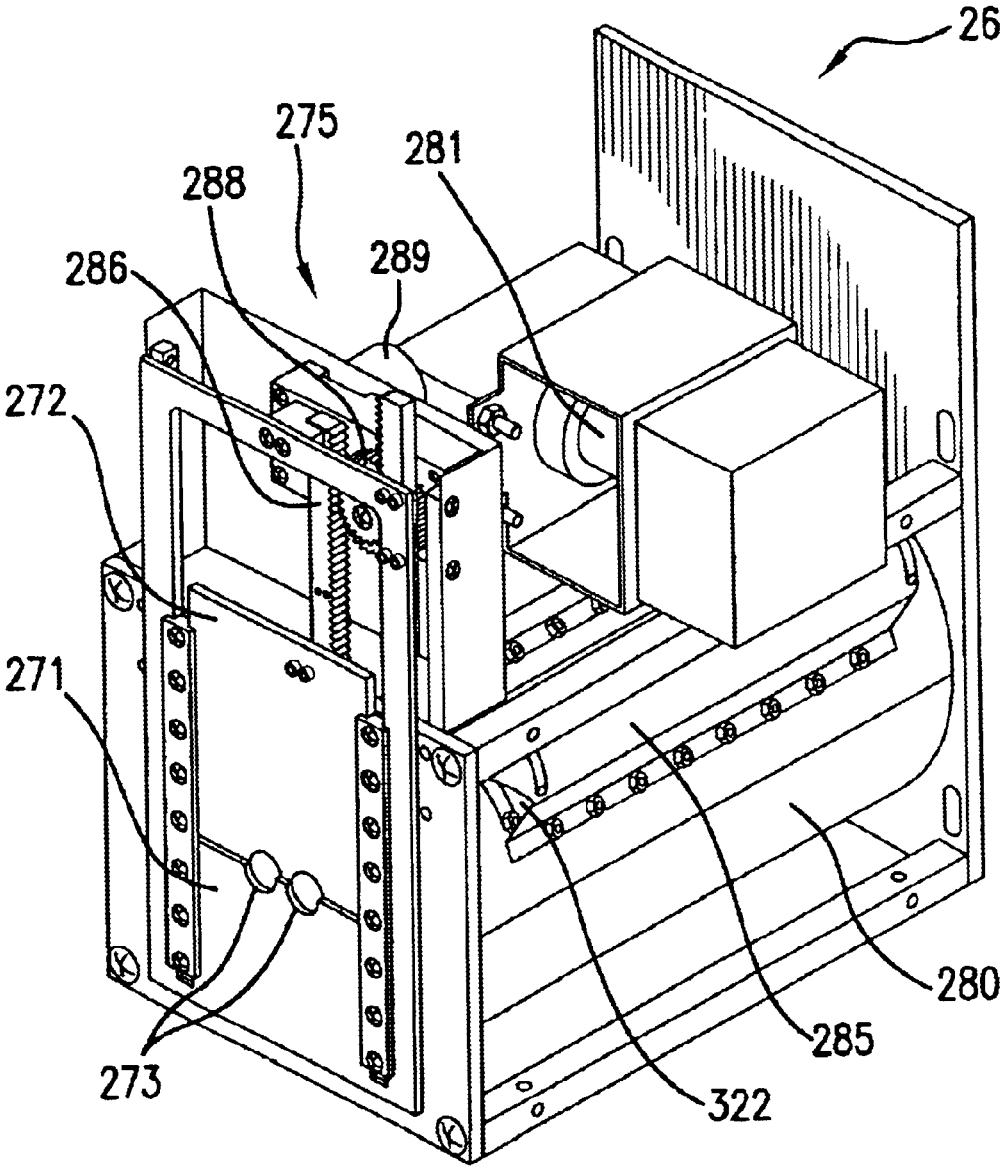
FIGS. 34–37 present various views and closeups of features of an exemplary first heating device, in accordance with an embodiment of the present invention.

FIGS. 34–37 present various views and closeups of features of an exemplary first heating device, in accordance with an embodiment of the present invention. As shown in FIG. 34, the example first heating device 26 includes a substantially cylindrical chamber 280 for containing a received first food portion 31.

Figure 35:
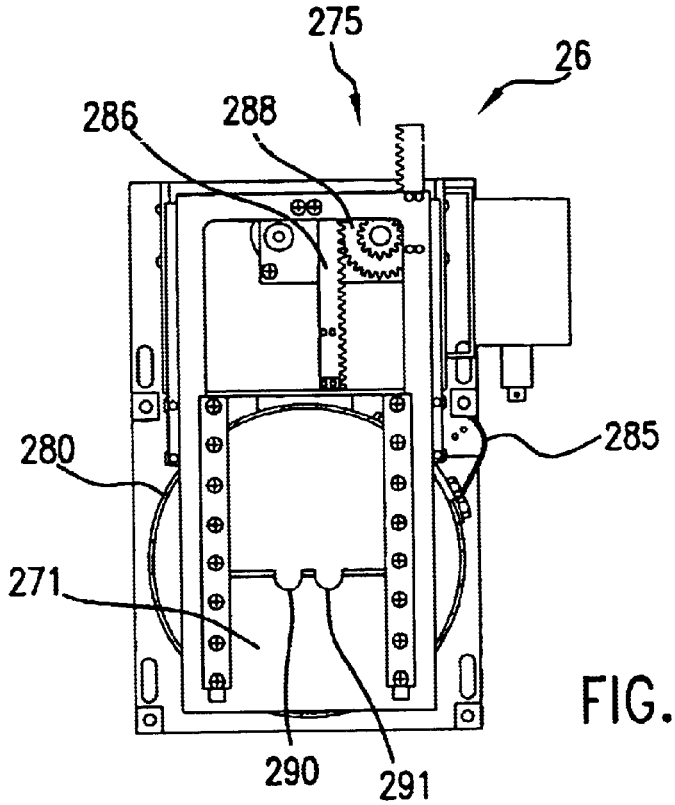

As further shown in FIG. 34, in an embodiment of the present invention, the first heating device 26 includes a microwave emitter 281 for emitting microwave radiation into the cylindrical chamber 280. The first heating device 26 also includes an infrared heater 285, such as a heat lamp, for transmitting infrared heat to the interior of the cylindrical chamber 280. As shown in FIG. 35, in one embodiment of the present invention, the door mover device 275 includes, for example, a door toothed rack portion 286, a fixed rack portion 287, and a toothed gear 288, one or more sets of teeth of the gear 288 being engageable with the teeth of the door toothed rack portion 286 and with the teeth of the fixed rack portion 287. In an embodiment of the present invention, the movable door portion 272 is opened or closed by motion transmitted to the toothed wheel portion 288, such as via a door motor 289.

FIG. 35 presents a cutaway end view of the first heating component of FIG. 34 for the embodiment in which the movable door portion is moved by a toothed rack and gear portions. The movable door portion 272 is not shown in FIG. 35, so as to provide a cutaway view of the various components of the door mover device 275 of this embodiment. As also shown in the embodiment presented in FIG. 35, the openings 273 include arced recesses 290, 291 in the fixed door portion 271.

Figure 37:
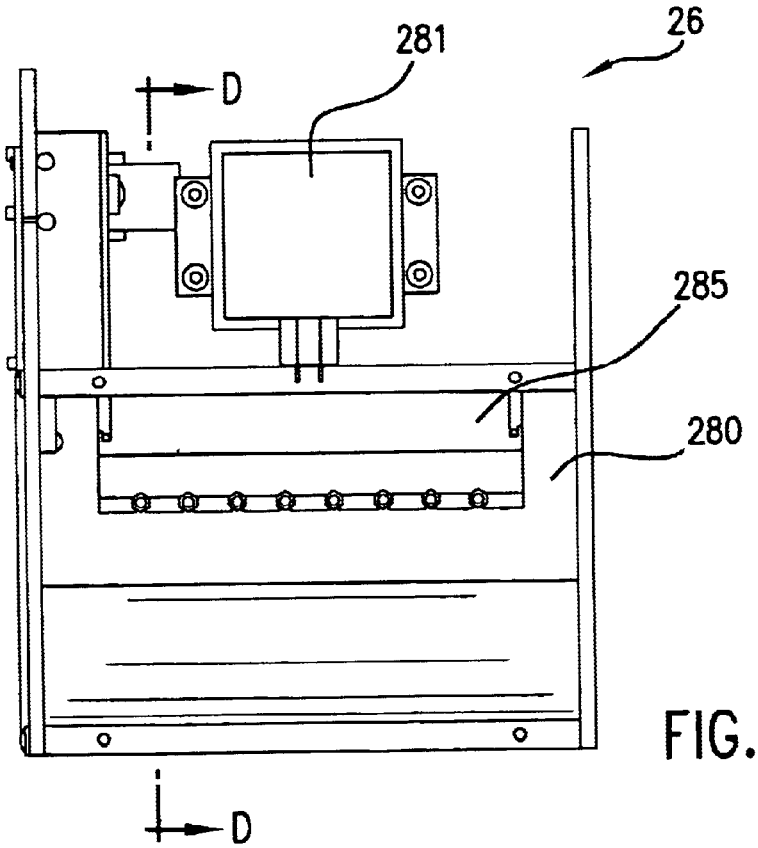
Figure 36:
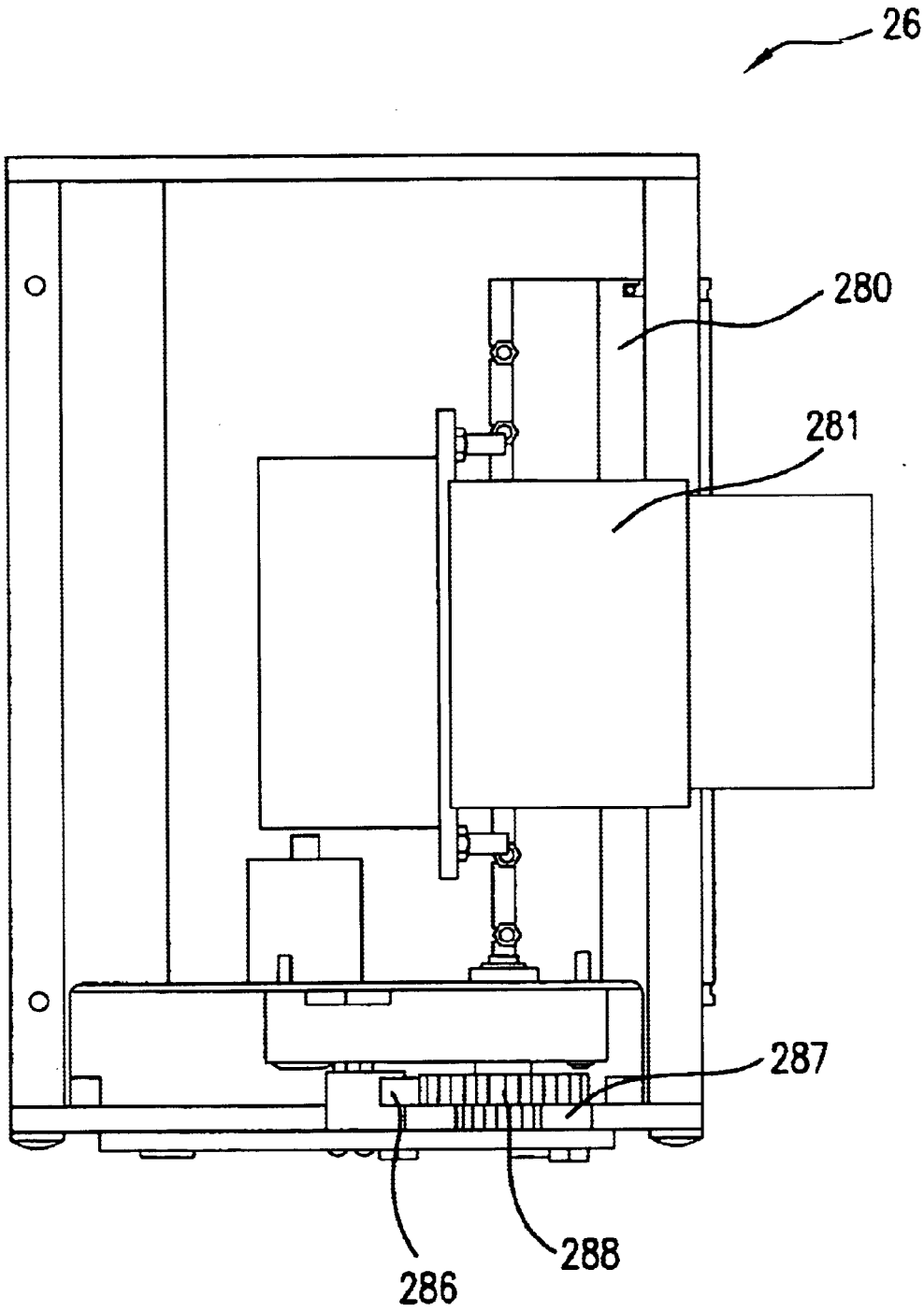

FIG. 36 contains an overhead view of the first heating component of FIG. 35, and FIG. 37 shows a side view of the first heating component of FIG. 34.

Figure 38:
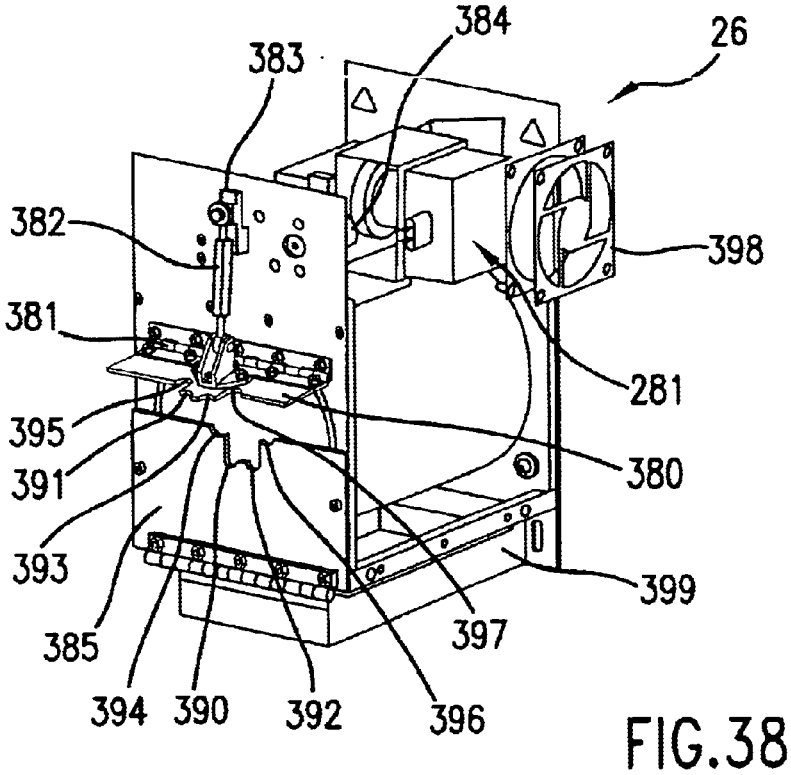
FIG. 38 is a view of an embodiment of a first heating component having a pivotably movable door, in accordance with an embodiment of the present invention.
Figure 39:
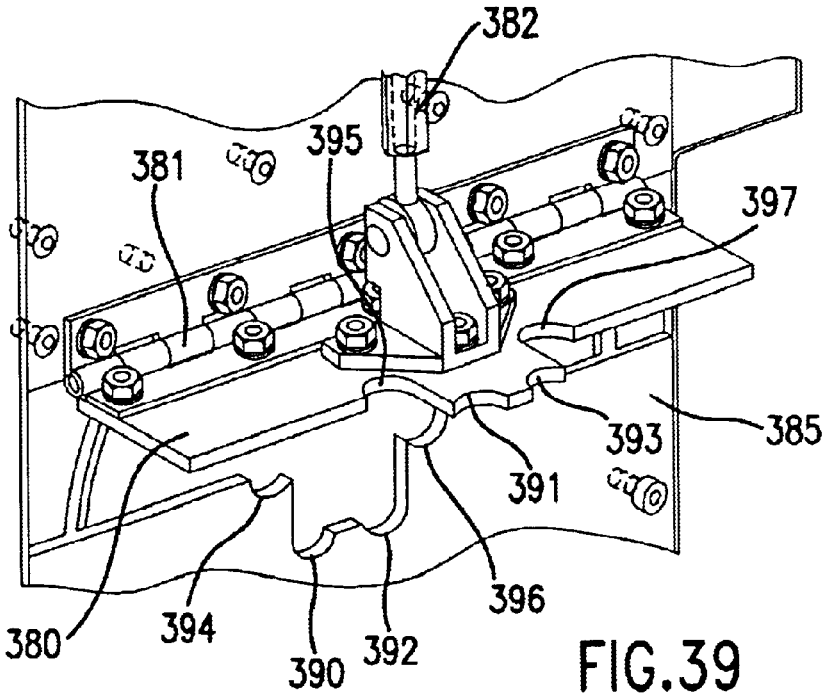
FIG. 39 presents a closeup view of the door portions of the first heating component for the embodiment of FIG. 38.

In another embodiment of the present invention, as shown in FIGS. 38 and 39, a movable door portion 380 is pivotably attached to the first heating device 26, via pivoting mechanisms 381, such as hinges. In one embodiment, additional features or devices as are known in the art, including but not limited to motors, arms, and pivoting devices are used to open and close the movable door portion 380. As further shown in FIGS. 38 and 39, movable door portion, when in a closed position, mates with fixed door portion 385. In the embodiment shown in FIGS. 38 and 39, when cylindrical extension 355, 356, as shown, for example, in FIG. 33, are insertably engaged with the first heating device with movable door portion 30 in the closed position, the cylindrical extensions 355, 356 freely rotate within circular openings formed either by arced recess portion pairs 390, 391 and 392, 393 or pairs 394, 395 and 396, 397. In the embodiment of FIGS. 38 and 39, the circular openings formed by each of the sets of pairs are similar to the openings 273, 273 formed from the closed position of doors 272, 273, as shown in FIG. 34.

As shown in FIGS. 38 and 39, door portion 381 is pivotably movable, for example, via extension link 382 coupled, for example, to a rotatable arm 383. Rotation of the rotatable arm 383, using features known in the art, such as coupling to an electric motor 384, causes linear motion of extension link 382, thereby causing pivoting motion of the door portion 381 about pivot devices 381.

Other features of the embodiment of the first heating device 26 shown in FIG. 38 include a fan 398 used in conjunction with the microwave emitter 281 and a waste collector 399, such as a removable tray or pan for collecting grease, juice, oil, and other first food portion emitted material.

Figure 40:
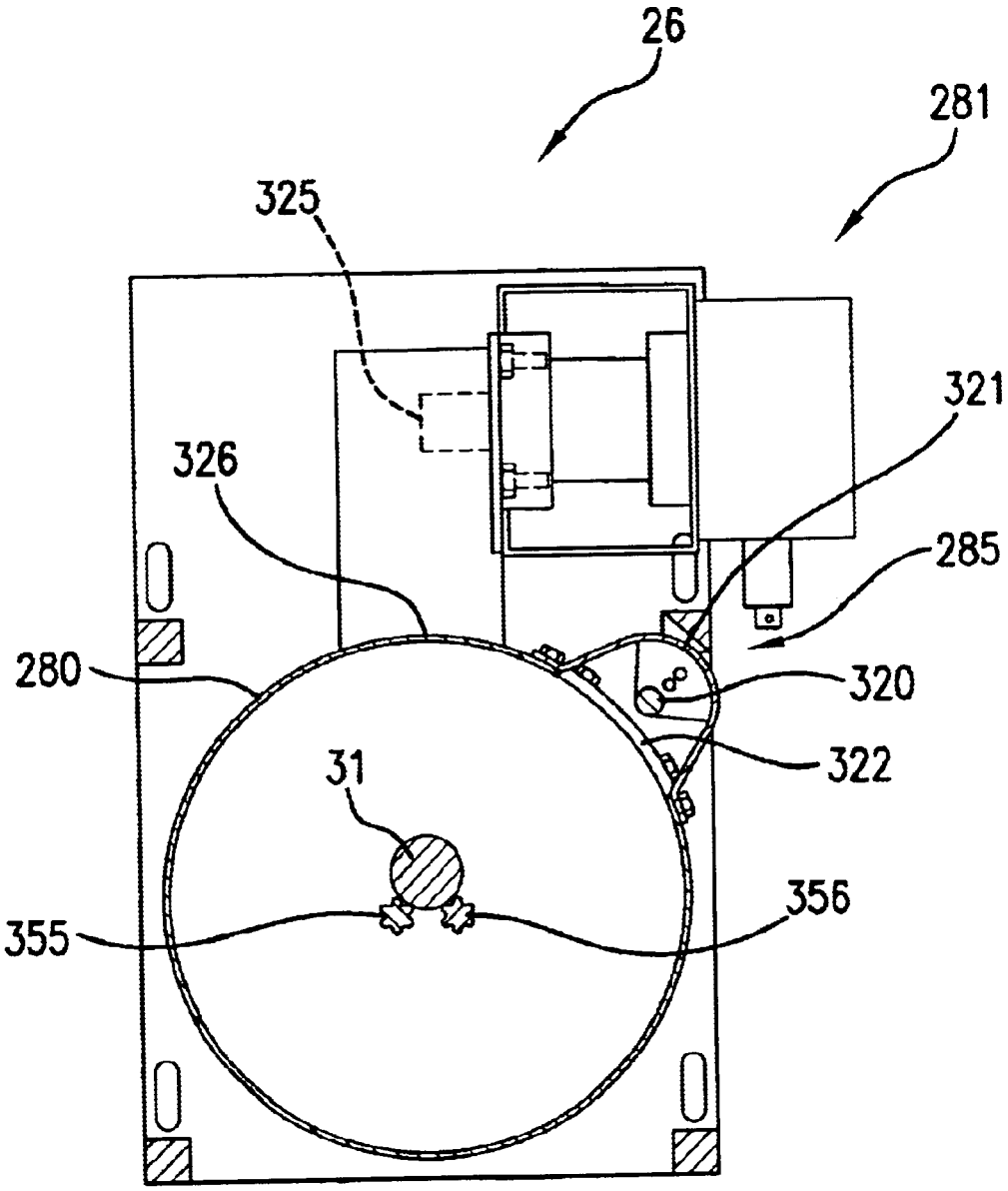
FIG. 40 is a cutaway view along the line D—D of FIG. 37 for the first heating component of FIG. 34.

FIG. 40 is a cutaway view along the line D—D of FIG. 37 for the first heating component of FIG. 32 and similarly for the embodiment of FIGS. 38 and 39. As shown in FIG. 40, in an embodiment of the present invention, the infrared heater 285 includes lamp portion 320 and lamp housing portion 321. In an embodiment of the present invention, the lamp housing portion 321 includes reflective surface on the inner part of the housing 321. In the embodiment shown in FIG. 40, the cylindrical chamber 280 includes an opening 322 for receiving infrared radiation from the infrared heater 285.

As further shown in the embodiment of the first heating device 26 of FIG. 40, the microwave emitter 281 includes, for example, a magneton antenna 325. The cylindrical chamber 280 includes a microwave radiation opening 326 for receiving microwave radiation emitted via the magneton antenna 325.

FIG. 40 also shows a cross-sectional view of the interior of the cylindrical chamber 280, showing cross-sectional views of the cylindrical extensions 355, 356 and first food portion 31 placed thereon. The cylindrical extensions 355, 356 rotate simultaneously and at approximately the same rotational velocity in the same rotational direction so as to turn the first food portion 31 for uniform exposure of the first food portion 31 to radiation for heating while within the cylindrical chamber 280.

In an embodiment of the present invention, the first heating component 26 further includes a waste collection container located within the exterior housing 270 below, for example, the cylindrical chamber 280, so as to allow collection of waste products produced by operation of the first heating component 26, such as grease, juice, and oils emitted by the first food portions 31 during heating. In an embodiment of the present invention, the cylindrical chamber 280 includes a drain opening for draining the waste products into the waste collection container. In an embodiments of the present invention, the waste collection container is also locatable in various other locations within the first heating component 26, such as within the cylindrical chamber 280. In an embodiment of the present invention, the waste collection container is easily removable from the first heating component so as to allow removal of collected waste and cleaning of the container.

Figure 41:
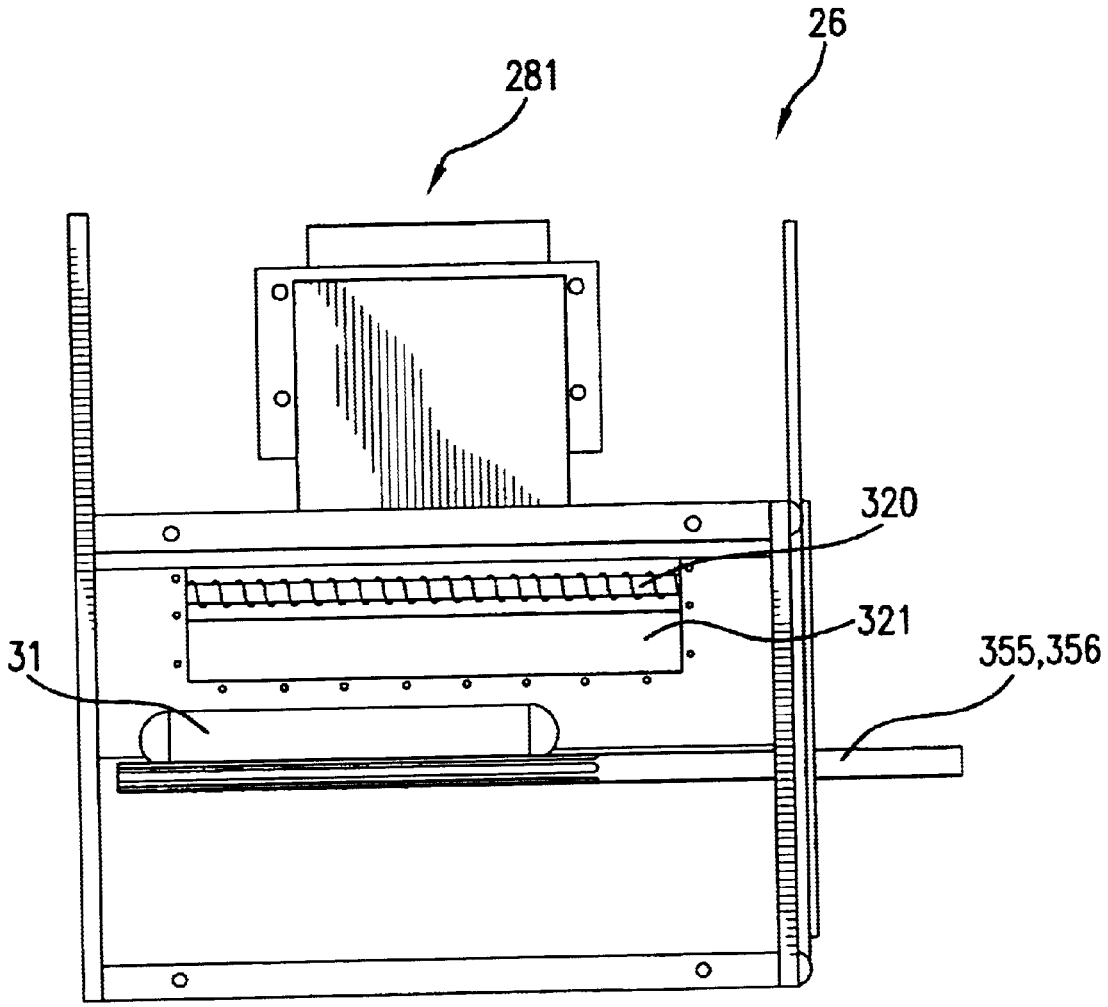
FIG. 41 presents a first cutaway side view of the first heating device of FIG. 34.
Figure 42:
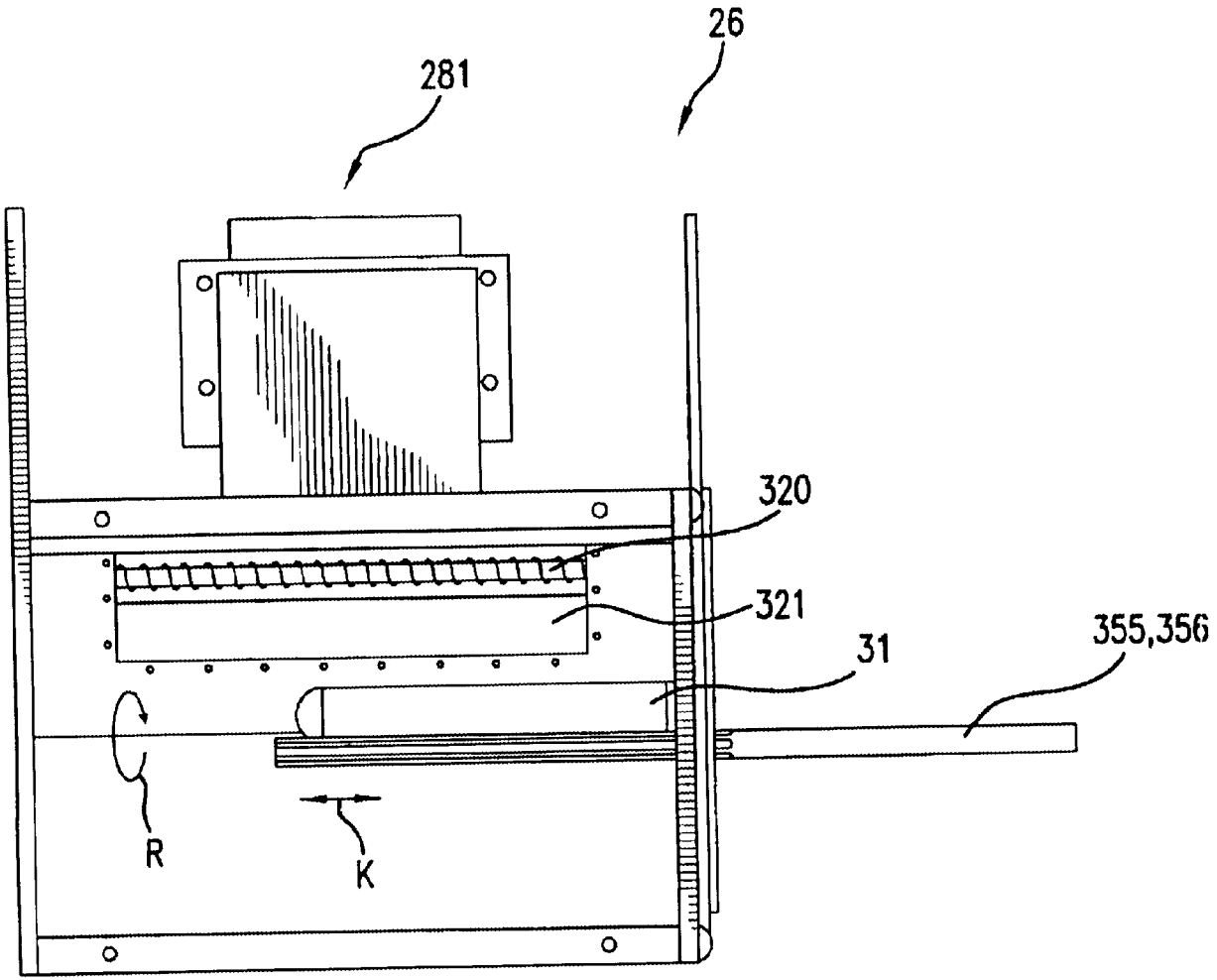
FIG. 42 contains a second cutaway side view of the first heating component of FIG. 34.

FIG. 41 presents a first cutaway side view of the first heating device 26 of FIG. 34. FIG. 42 contains a second cutaway side view of the first heating component of FIG. 34. As shown in FIG. 42, rotational motion R of the first food portion 31 occurs via rotation of the cylindrical extensions 355, 356. The cylindrical extensions 355, 356 are movable in direction K, as shown in FIG. 42, into and out of the heating device 26.

Figure 43:
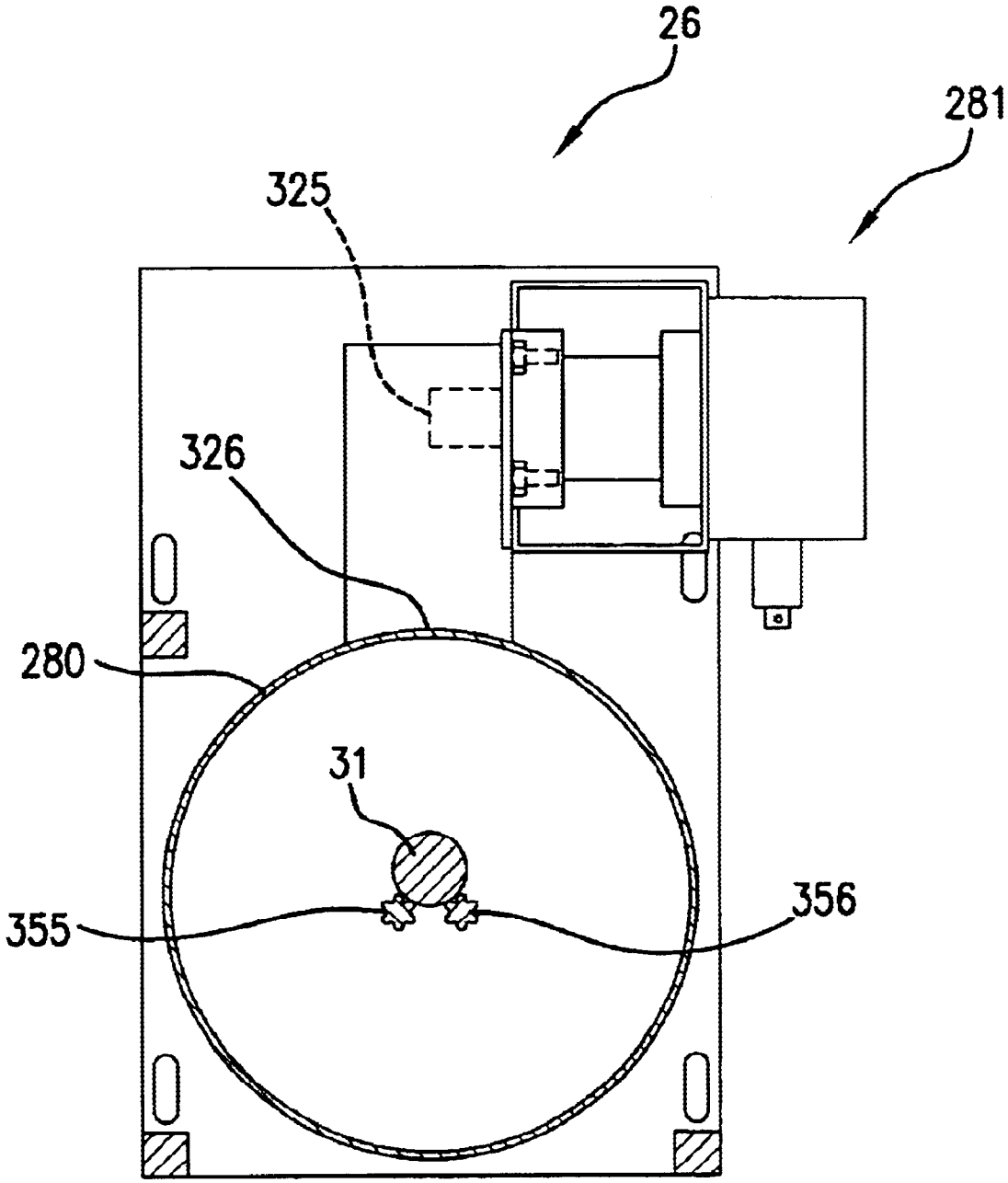
FIG. 43 shows another embodiment of the first heating device, in accordance with an embodiment of the present invention.

FIG. 43 shows another embodiment of the first heating device 26, in accordance with an embodiment of the present invention. The heating device 26 of this embodiment includes microwave emitter 281, similar to that described in conjunction with, for example, the heating device 26 for the embodiment of FIG. 34. However, instead of infrared heater 285 of the heating device 26 for the embodiment of FIG. 34, the heating device 26 in the embodiment of FIG. 43 includes rods 355, 356 comprising or coated with a specialized material that emits heat in the presence of microwave radiation, the resulting heat from the rods 355, 356 then transferring to the first food portion 31 via the exterior surface of the first food portion 31. For example, in an embodiment of the present invention, the rods 355, 356 comprise or are coated with a ferrite material, along with an optional outer coating of a buffer material, such as Teflon® made by E.I. du Pont de Nemours and Company of Wilmington, Del., which prevents sticking of the first food portion 31 to the rods 355, 356 as the specialized composition material becomes heated.

Figure 44:
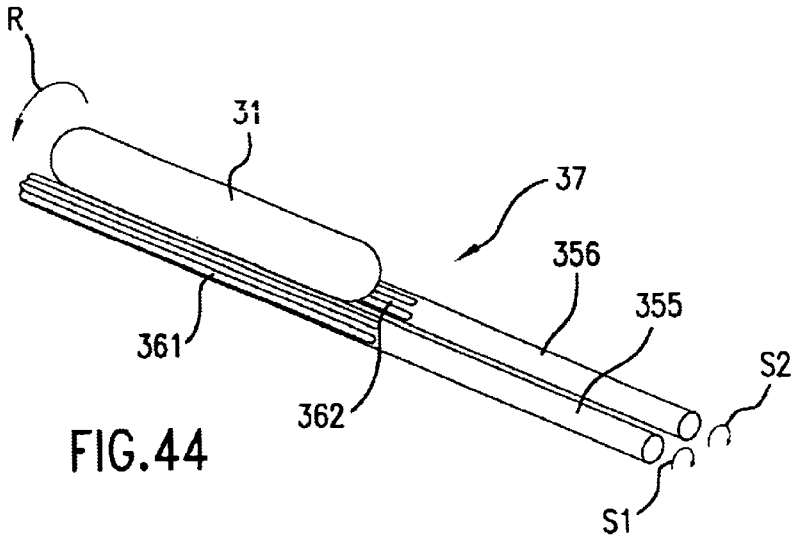
FIGS. 44–46 present views of the first food portion receiving component and first food portion placed thereupon, in accordance with an embodiment of the present invention.
Figure 45:
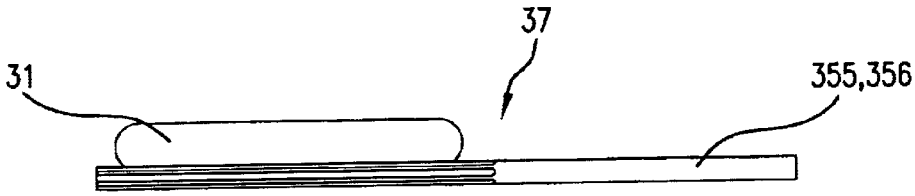
Figure 46:
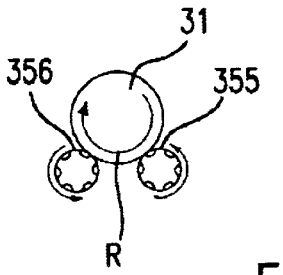
Figure 47:
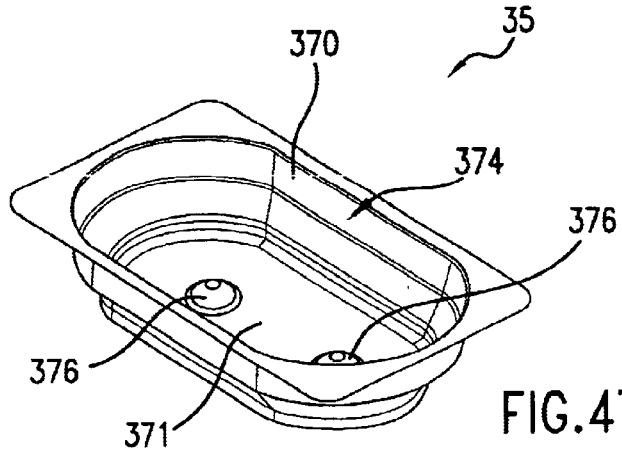
FIGS. 47–51 present various views of the second food portion container, in accordance with an embodiment of the present invention.

FIGS. 44–46 present views of the first food portion receiving component and first food portion placed thereupon, in accordance with an embodiment of the present invention. As shown in FIG. 44, rotational motion S1, S2 of the cylindrical extensions 355, 356, respectively, causes rotation R of the first food portion 31 placed thereupon, so as to allow uniform heating via, for example, the microwave emitter 281 and the infrared heating device 320. In an embodiment of the present invention, each of the cylindrical extensions 355, 356 includes increased frictional sections 361, 362, respectively, such as grooved sections, for increased frictional engagement of first food portion 31 placed thereupon.

Figure 48:
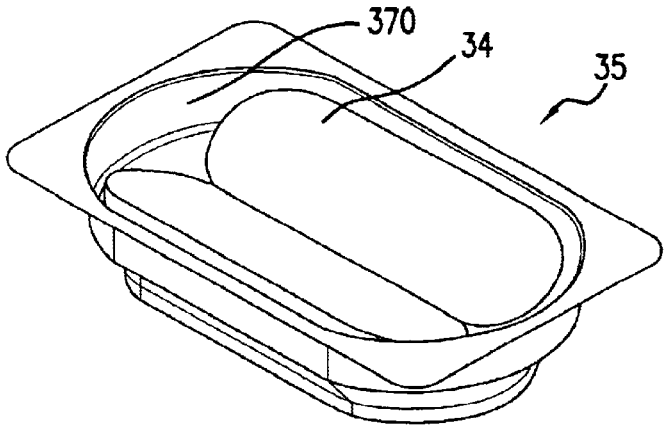
Figure 49:
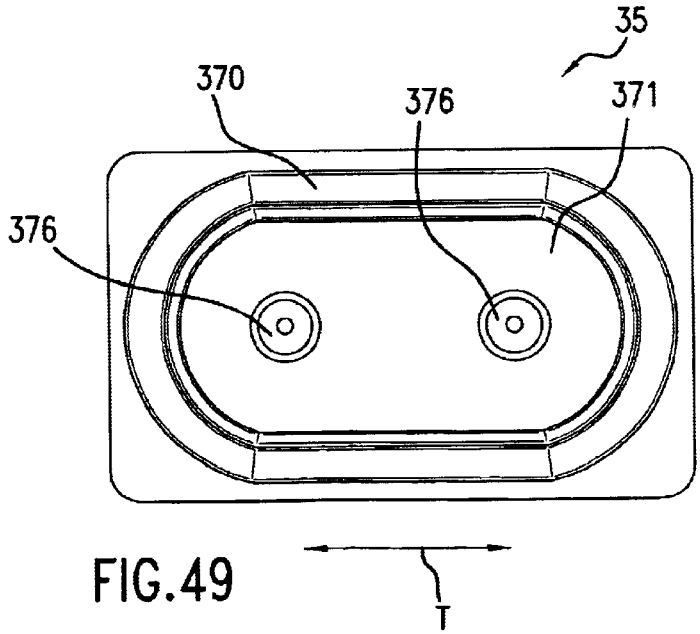
Figure 50:
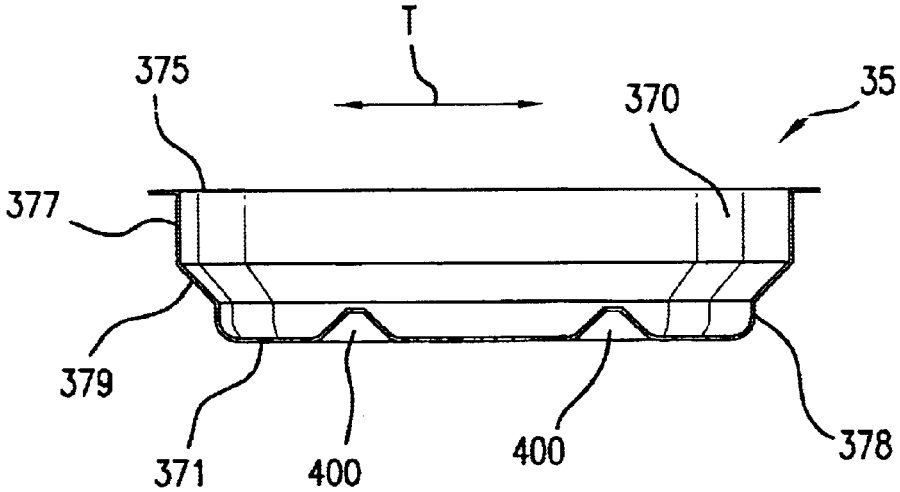

FIGS. 47–52 present various views of the second food portion container, in accordance with embodiments of the present invention, as described further below and as further described in applicant's copending U.S. patent application Ser. No. 09/953,744 filed Sep. 17, 2001 of Leonid Leykin, et al., which is hereby incorporated by reference. As shown in FIGS. 47–51, in one embodiment, the container 35 includes peripheral walls 370, which, together with a bottom 371, forms an inner cavity 374 for accommodating a second food portion 34, as shown in FIG. 48. As shown in FIG. 50, the container 35 has an open side 375, which is opposite to the bottom 371. As shown in FIGS. 47–51, the container 35 is somewhat elongated in a first direction T, as shown in FIGS. 49 and 50, and has rounded wall portions at the longitudinal ends of the inner cavity 374 in the first direction.

One or more projecting structures 376 are further provided in the container 35. In an embodiment of the present invention, the projecting structures 376 are formed on the bottom 371 of the container and extend into the inner cavity 374 of the container 35. As most clearly shown in FIG. 49, in an embodiment of the present invention, the one or more projections 376 are located substantially along a line parallel to the direction of the long axis T of the container 35. In one embodiment of the present invention, the one or more projections 376 support a second food portion 34, such as a bun, and the side walls 370 of the container 35 are situated relative to the bottom and the one or more projections 376 such that the second food portion 34, such as a bun, is also supported by the side walls 370. In an embodiment of the present invention, the side walls 370 are partially curved in a manner corresponding to the second food portion 35, such as a bun.

Figure 51:
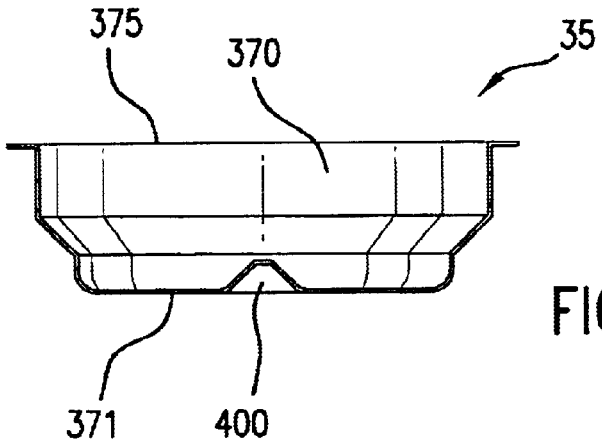

As is further shown in FIGS. 50 and 51, in an embodiment of the present invention, vertical upper portions 377 of the side walls 370 are connected with vertical lower portions 378 of the side walls 370 by intermediate inclined wall portions 379. In an embodiment of the present invention, parts of the second food portion 34, such as bun halves, are partially supported by the intermediate inclined wall portions 379 of the side walls 370 of the container 35. In an embodiment of the present invention, the projections 376 are hollow and each define one or more lower openings 400, as shown in FIGS. 50 and 51.

Figure 52:
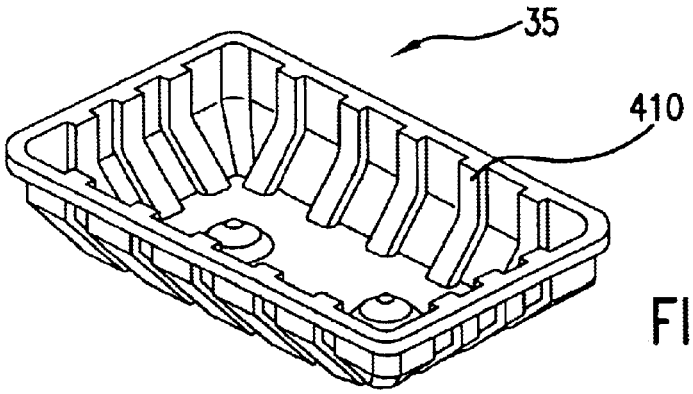
FIG. 52 presents another example second food portion container, in accordance with an embodiment of the present invention.

FIG. 52 presents another example second food portion container 35, in accordance with an embodiment of the present invention. The container 35 of the embodiment of FIG. 2 includes rib features 410 to provide side strength for the container 35.

Figure 53:
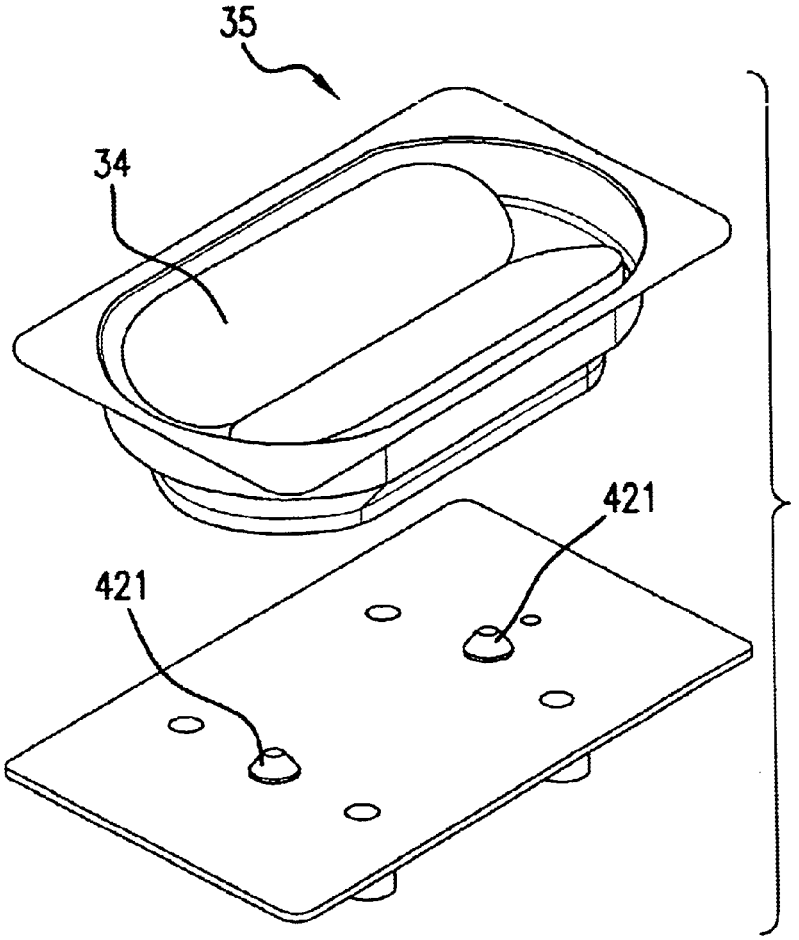
FIGS. 53 and 54 show views of the container securably placed on the tray, in accordance with an embodiment of the present invention.
Figure 54:
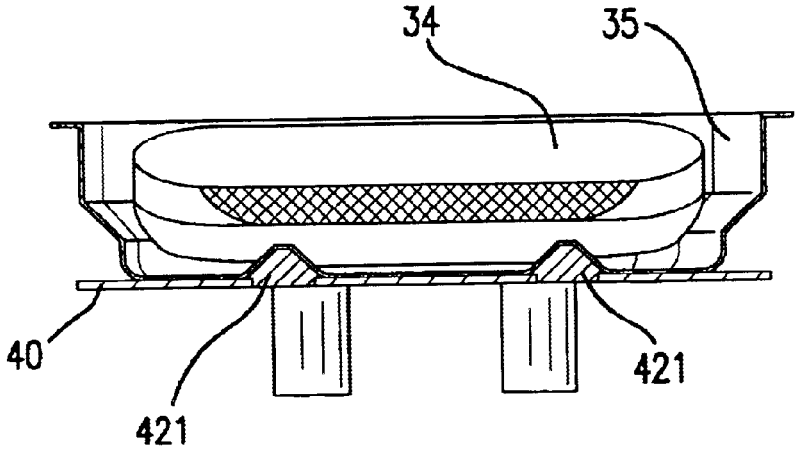

As shown in FIGS. 53 and 54, in an embodiment of the present invention, the container 35 is securably placeable on the tray 40 via one or more tray projections 421, which are fittable into the one or more lower openings 400 of the container 35.

Figure 55:
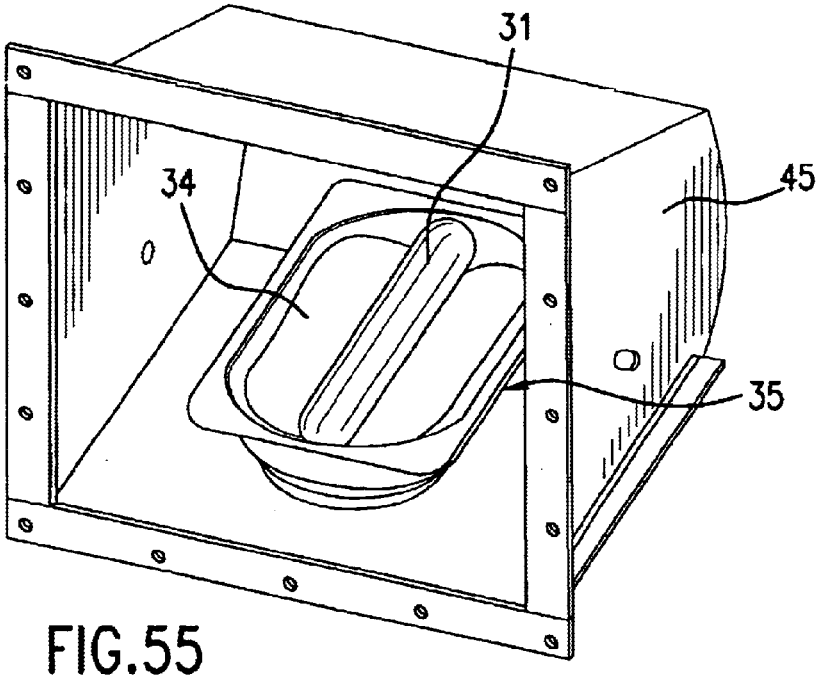
FIGS. 55 and 56 present illustrative embodiments showing use of the tray projections, in accordance with embodiments of the present invention.
Figure 56:
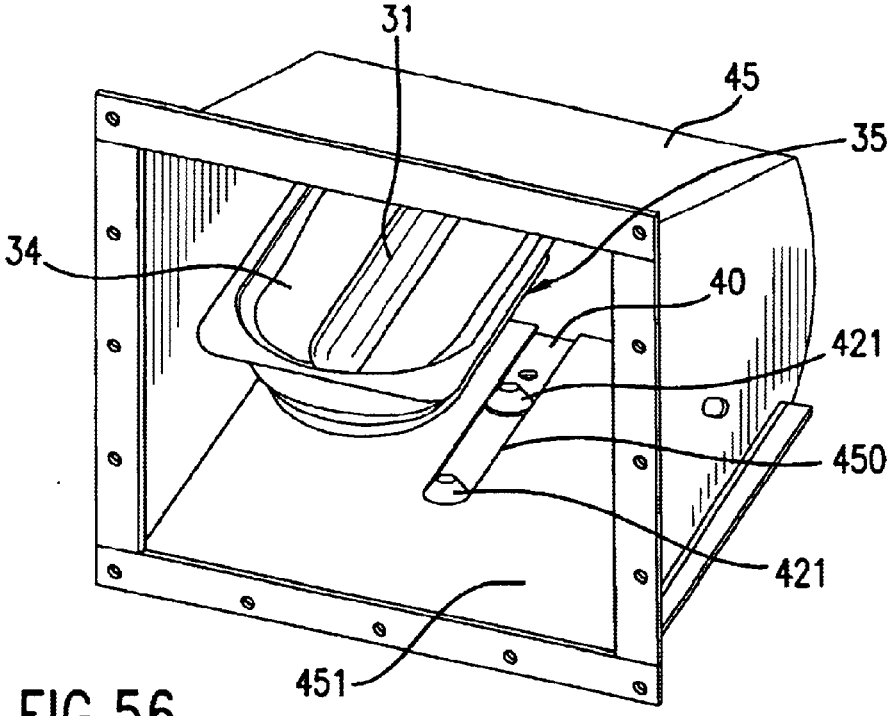

Use of the securable fitting of the tray 40 and the container 35 is illustrated in FIGS. 55 and 56. FIG. 55 shows a view of the food delivery compartment 45 with the container 35, containing a combined second food portion 34 and first food portion 31 for removal, for example, by a customer. As shown in FIG. 56, lifting of the container 35 with the contained second food portion 34 and first food portion 31 clearly shows the tray 40 and one or more tray projections 421 extending into a slot 450 in the bottom 451 of the food delivery compartment 45. In the illustrative embodiment shown in FIGS. 55 and 56, the one or more tray projections 421 extend through the slot 450 so as to be receivable in the lower openings 400 of the container 35, as shown in FIG. 54.

Figure 57:
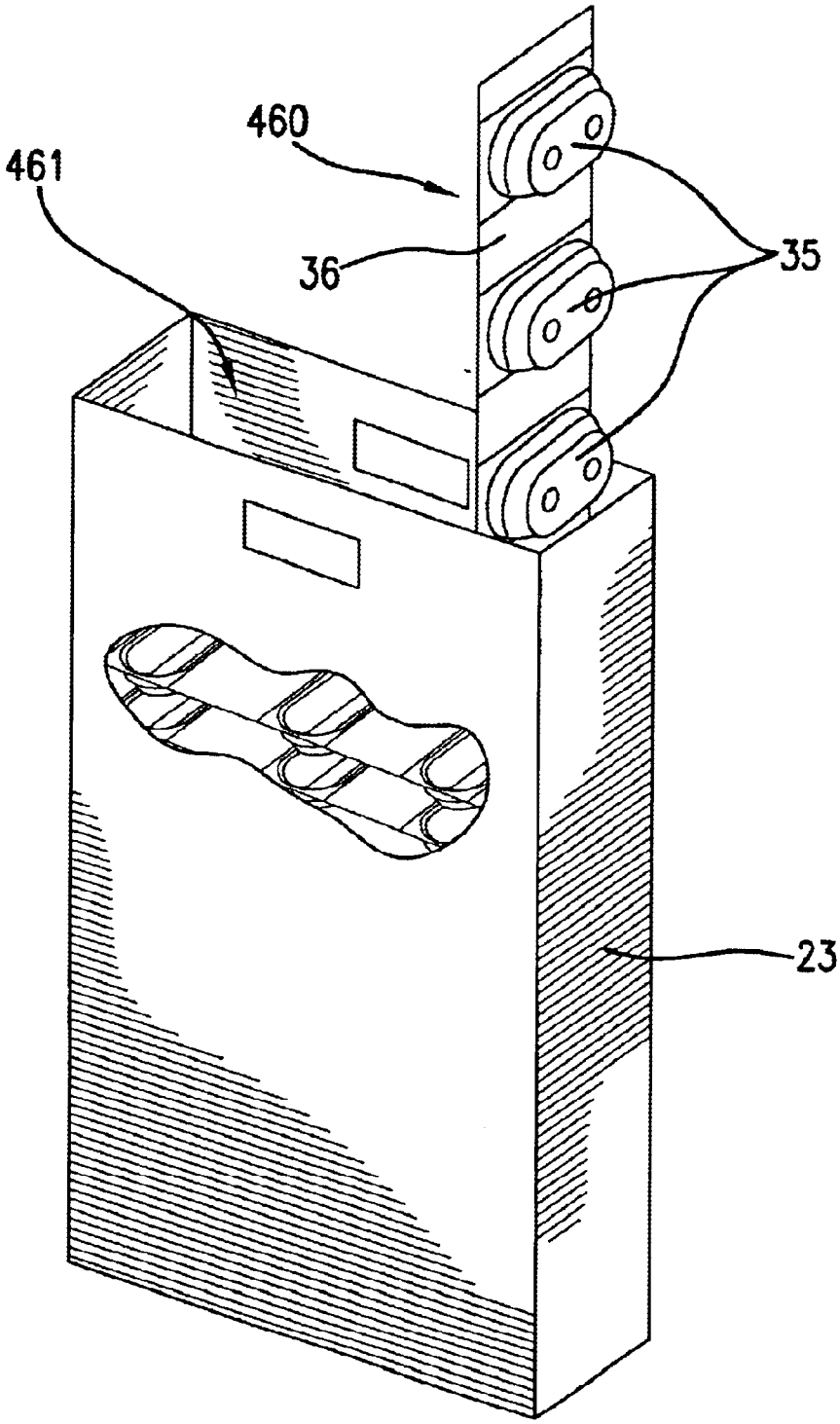
FIG. 57 is a perspective view of an example dispensing device for second food portions, in accordance with embodiments of the present invention.

FIG. 57 is a perspective view of an example dispensing device for second food portions, in accordance with embodiments of the present invention. The dispensing device 23 contains the chain of second food portions 460, which are dispensed from the device 23, such as via a top end 461 of the device 23.

Figure 58:
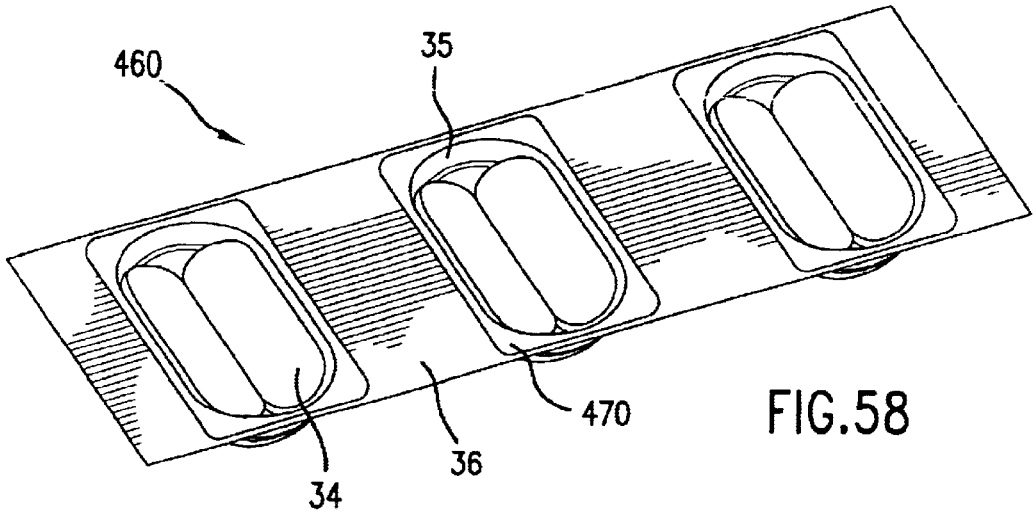
FIG. 58 contains a closeup of a portion of an example second food portion chain, in accordance with an embodiment of the present invention.
Figure 59:
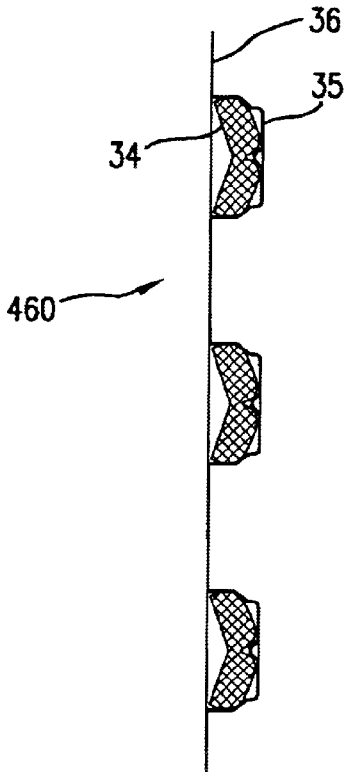
FIG. 59 presents a side view of the example portion of the chain of second food portions of FIG. 58.

FIG. 58 contains a closeup of a portion of an example second food portion chain, in accordance with an embodiment of the present invention. As shown in FIG. 58, each second food portion container 35 contains a second food portion 34, such as a bun for accepting hot dogs or sausages. Each container 35 is attached to the film 36 of the chain 460 via a lip 470 of the container 35. For example, in embodiments of the present invention, each container 35 is attached to the film 36 by, for example, gluing or heat welding the container 35 to the film 36 at the lip 470. FIG. 59 presents a side view of the example portion of the chain of second food portions of FIG. 58.

Figure 60:
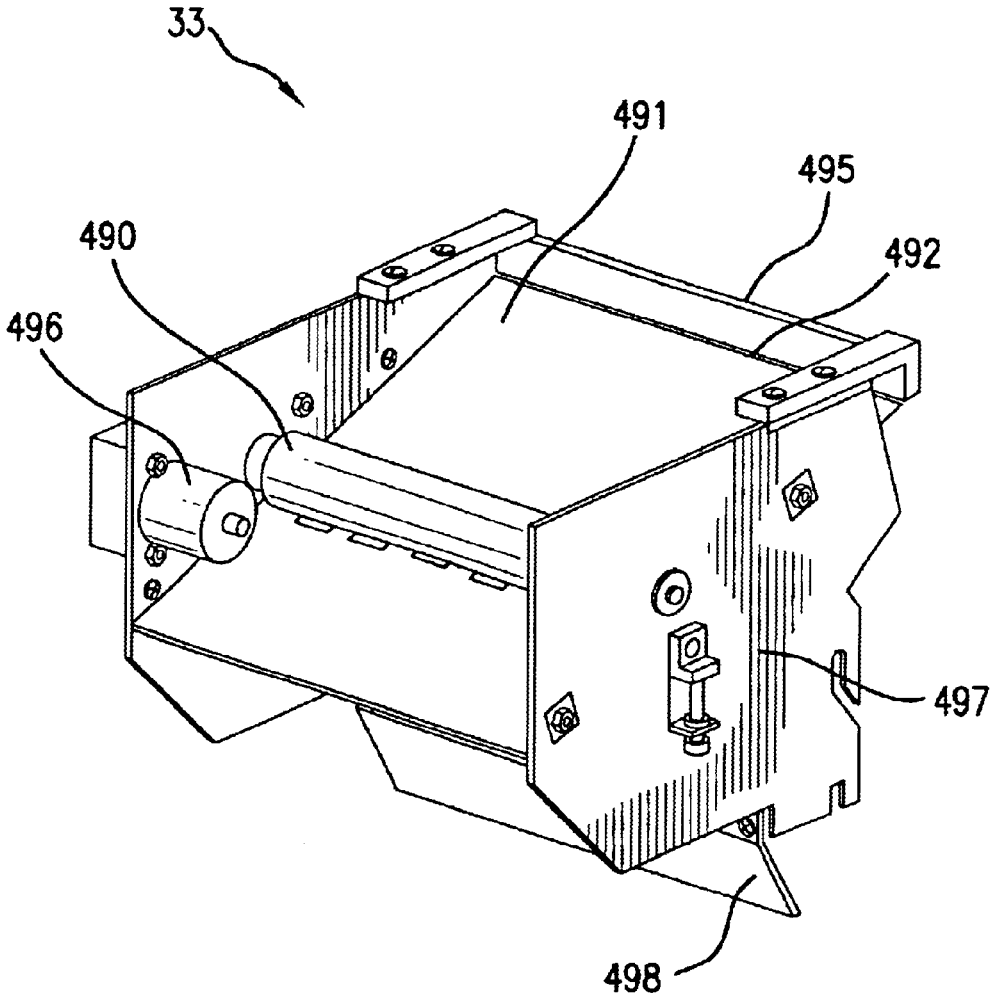
FIG. 60 shows an example second food portion deployment device, in accordance with an embodiment of the present invention.

FIGS. 60–68 show example second food portion deployment devices, in accordance with an embodiment of the present invention. As shown in FIG. 60, the second food portion deployment device 33 includes a first pulling feature 490, such as a cylindrically shaped roller, a plate 491 having an edge 492, a bar portion 495, a pulling feature driver 496, such as a motor, including a coupler for transmitting rotation motion of the motor to the pulling feature 490, a housing 497, and a guard 498. In an embodiment of the present invention, the first pulling feature 490 also includes a second pulling feature 520, as more clearly shown in FIG. 63, such as a second cylindrically shaped roller frictionally contacting the first pulling feature 490. In an embodiment of the present invention, at least one of the first pulling feature 490 and the second pulling feature 520 have a flexible surface, such as a rubberized surface for pulling the film 36, to which second food portion containers 35 are attached, as further discussed below with respect to FIGS. 63–68.

Figure 61:
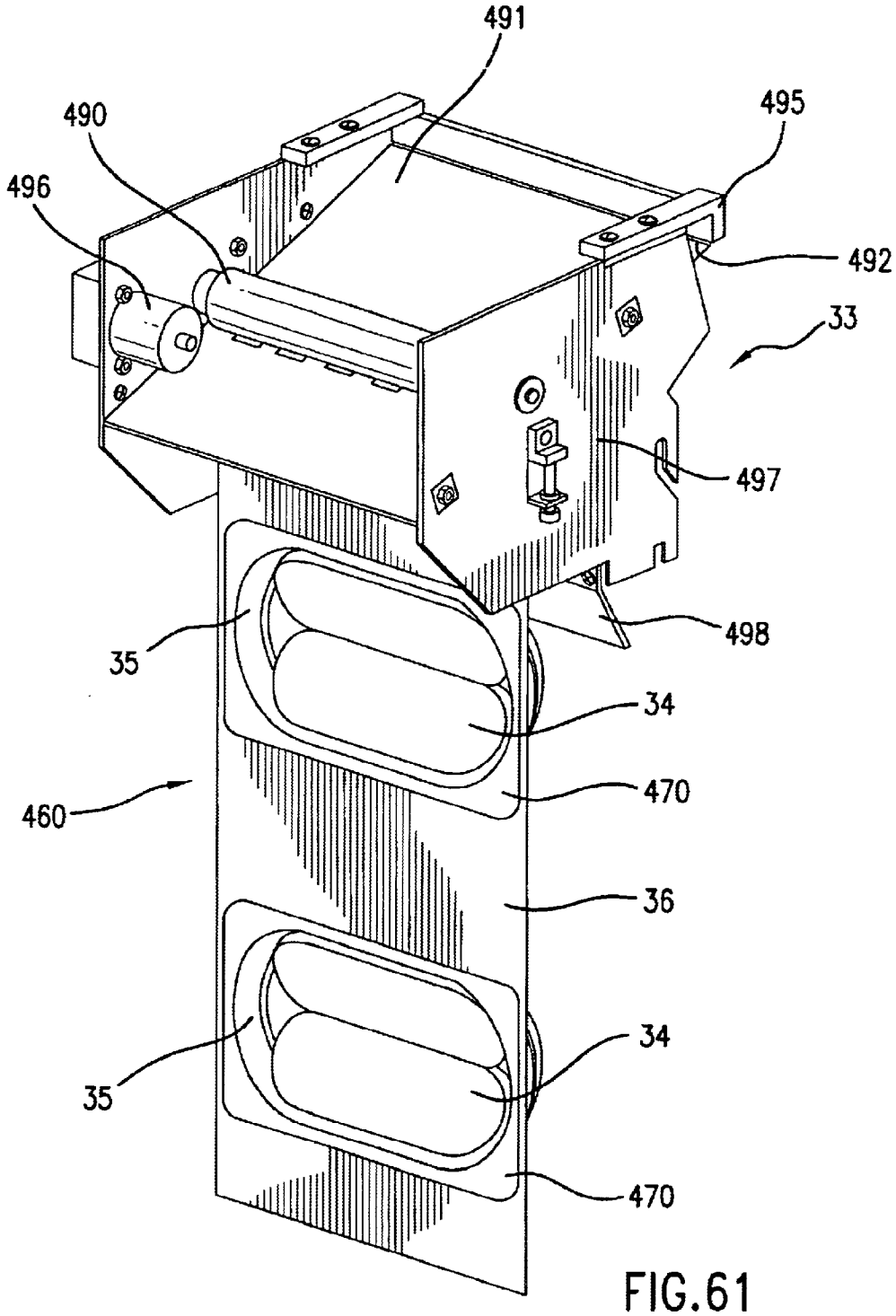
FIG. 61 is a perspective view of an example second food portion deployment device, in accordance with an embodiment of the present invention.
Figure 62:
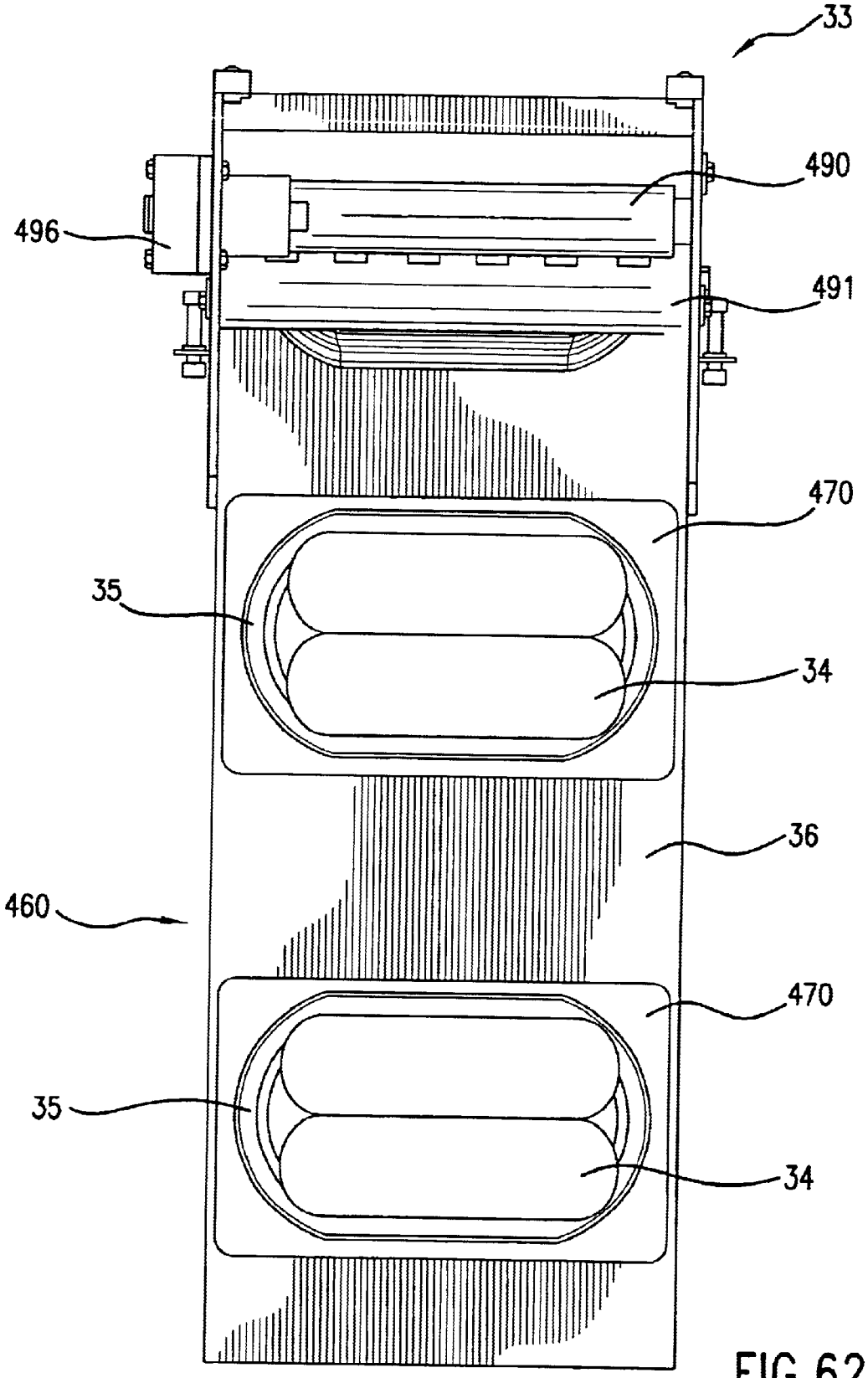
FIG. 62 contains an end view of the second food portion deployment device and pulled chain of second food portion containers, in accordance with an embodiment of the present invention.

As shown in the perspective view of the second food portion deployment device 33 presented in FIG. 61, and as is further discussed further below with respect to FIGS. 63–68, the chain of second food portion containers 460 is pulled into the second food portion deployment device 33 via the first pulling device 490 and the driver 496. FIG. 62 contains an end view of the second food portion deployment device 33 and pulled chain of second food portion containers 460.

Figure 63:
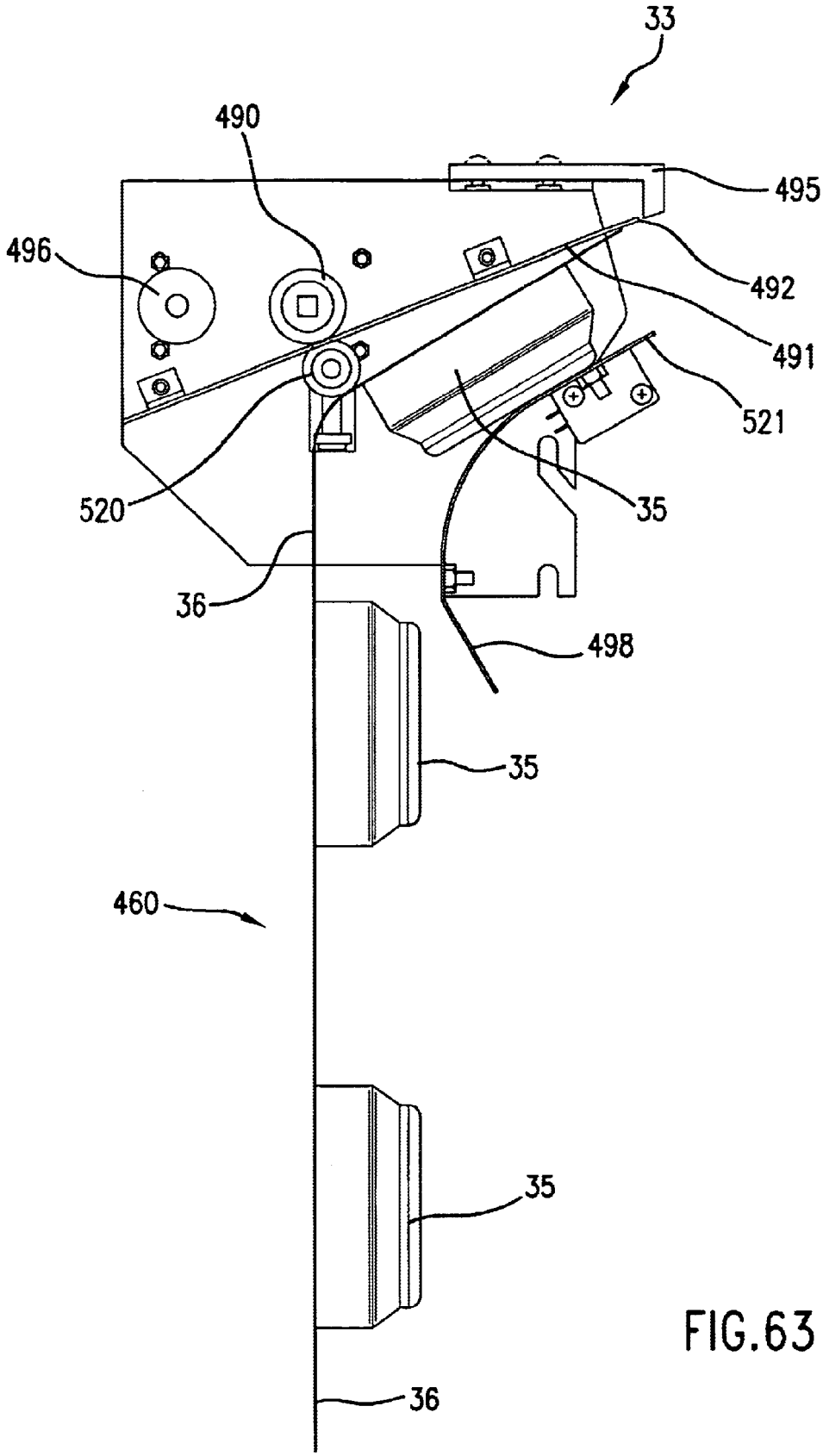
FIG. 63 is a side view of a first example embodiment of a second food portion deployment device, in accordance with an embodiment of the present invention.

FIG. 63 is a side view of a first example embodiment of a second food portion deployment device 33, in which the second food portion containers 35 are oriented along their longer axes in the direction of pull of the film 36. As shown in FIG. 63, the chain of second food portion containers 460 is drawn past the guard 498. The film 36 is pulled by the first and second pulling devices 490, 520 via motion transmitted by the driver 496, such as by the film 36 being drawn between the first and second pulling devices 490, 520, each frictionally contacting the film 36. The film 36 is drawn about the edge 492 of the plate 491, such that the film 36 generally reverses direction, being drawn generally from left to right below the plate 491, as shown in FIG. 63, and generally from right to left above the plate 491, as shown in FIG. 63.

As is further shown in FIG. 63, the bar 495 is positioned in close proximity to the edge 492 of the plate 491, such that a slot is formed therebetween, and the film 36 is drawn through the slot formed by the bar 495 and the edge 492 of the plate 491. As also shown in FIG. 63, the second food portion deployment device 33, in an embodiment of the present invention, also includes an automatic control mechanism 521, such as a switch triggered by, for example, passage of each second food portion container 35 between the automatic control mechanism 521 and the plate 492. In an embodiment of the present invention, motion of the automatic control mechanism 521 caused by the passage of each container 35 causes the driver 496 to cycle on and off, so as to cause only a single container 35 to pass the mechanism 521, such that a single serving is cycled.

Figure 64:
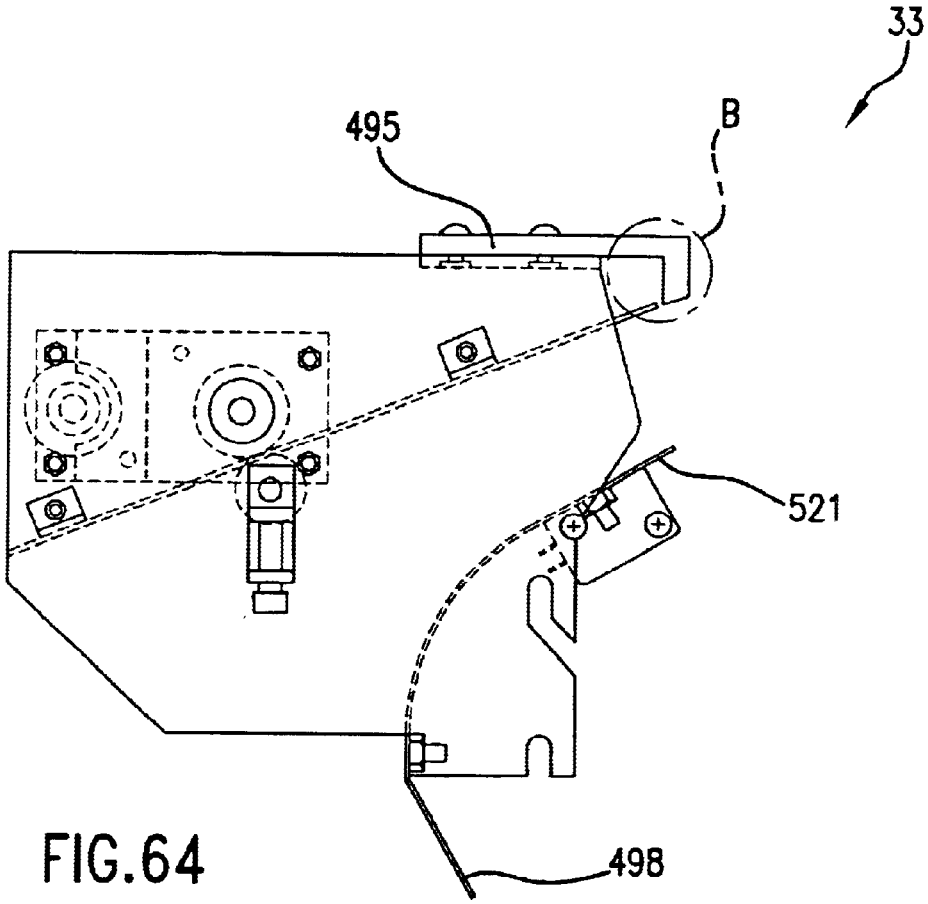
FIGS. 64 and 65 contain closeup views of the interaction of the film, the plate, and the bar, in accordance with embodiments of the present invention.
Figure 65:
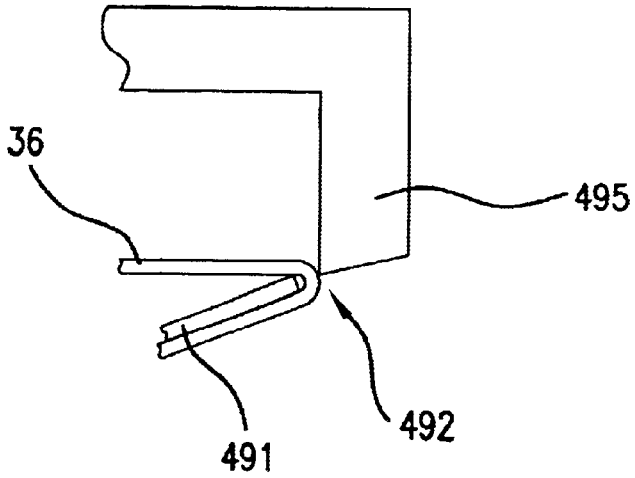

FIGS. 64 and 65 contain closeup views of the interaction of the film 36, the plate 491, and the bar 495, in accordance with embodiments of the present invention. As shown in FIG. 64 and the closeup view B of the area about the slot formed between the plate 49 land the bar 495 presented in FIG. 65, the film 36 reversibly passes the edge 492 of the bar 495 as it is pulled by the first and second pulling mechanisms 490, 520 and the driver 496, as described in conjunction with, for example, FIG. 63.

Figure 66:
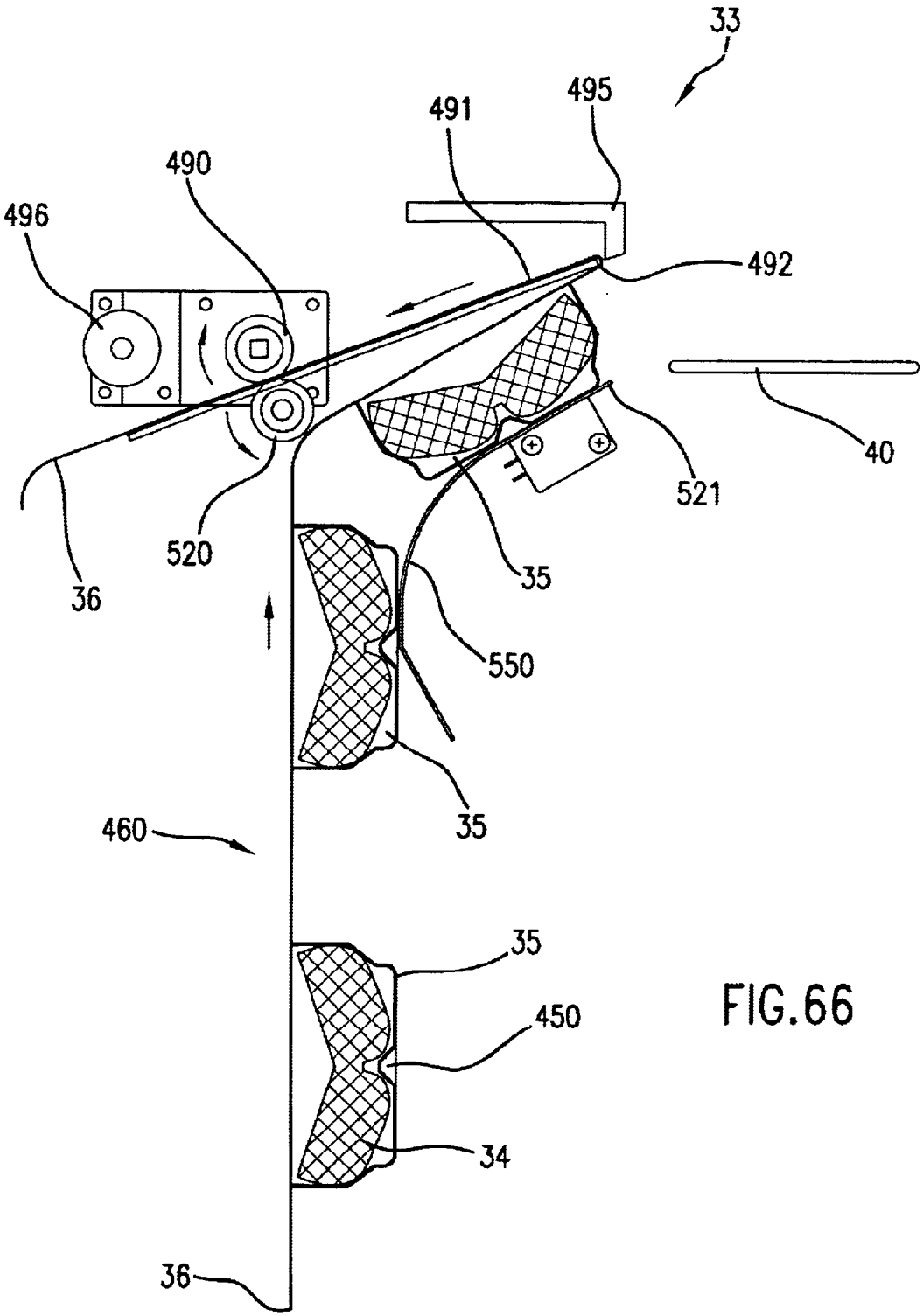
FIG. 66 shows a side view of a second example embodiment of a second food portion deployment device, in accordance with an embodiment of the present invention.

FIG. 66 shows a side view of a second example embodiment of a second food portion deployment device 33, in which the second food portion containers 35 are oriented along their shorter axes, perpendicular to the direction of the film 36. Similarly to as shown in FIG. 63, in FIG. 66, the chain of second food portion containers 460 is drawn by the first and second pulling devices 490, 520 via motion transmitted by the driver 496, such as by the film 36 being drawn between the first and second pulling devices 490, 520, each frictionally contacting the film 36. The film 36 is drawn about the edge 492 of the plate 491, such that the film 36 generally reverses direction as the film 36 passes the edge 492. The pulling of the chain 460 draws the containers 35 generally along the guide 550.

As shown in FIG. 66, the bar 495 is positioned in close proximity to the edge 492 of the plate 491, such that a slot is formed therebetween, and the film 36 is drawn through the slot formed by the bar 495 and the edge 492 of the plate 491. As also shown in FIG. 66, the second food portion deployment device 33, in an embodiment of the present invention, also includes an automatic control mechanism 521, such as a switch triggered by, for example, passage of each second food portion container 35 between the automatic control mechanism 521 and the plate 492, such that a single serving is cycled.

Figure 67:
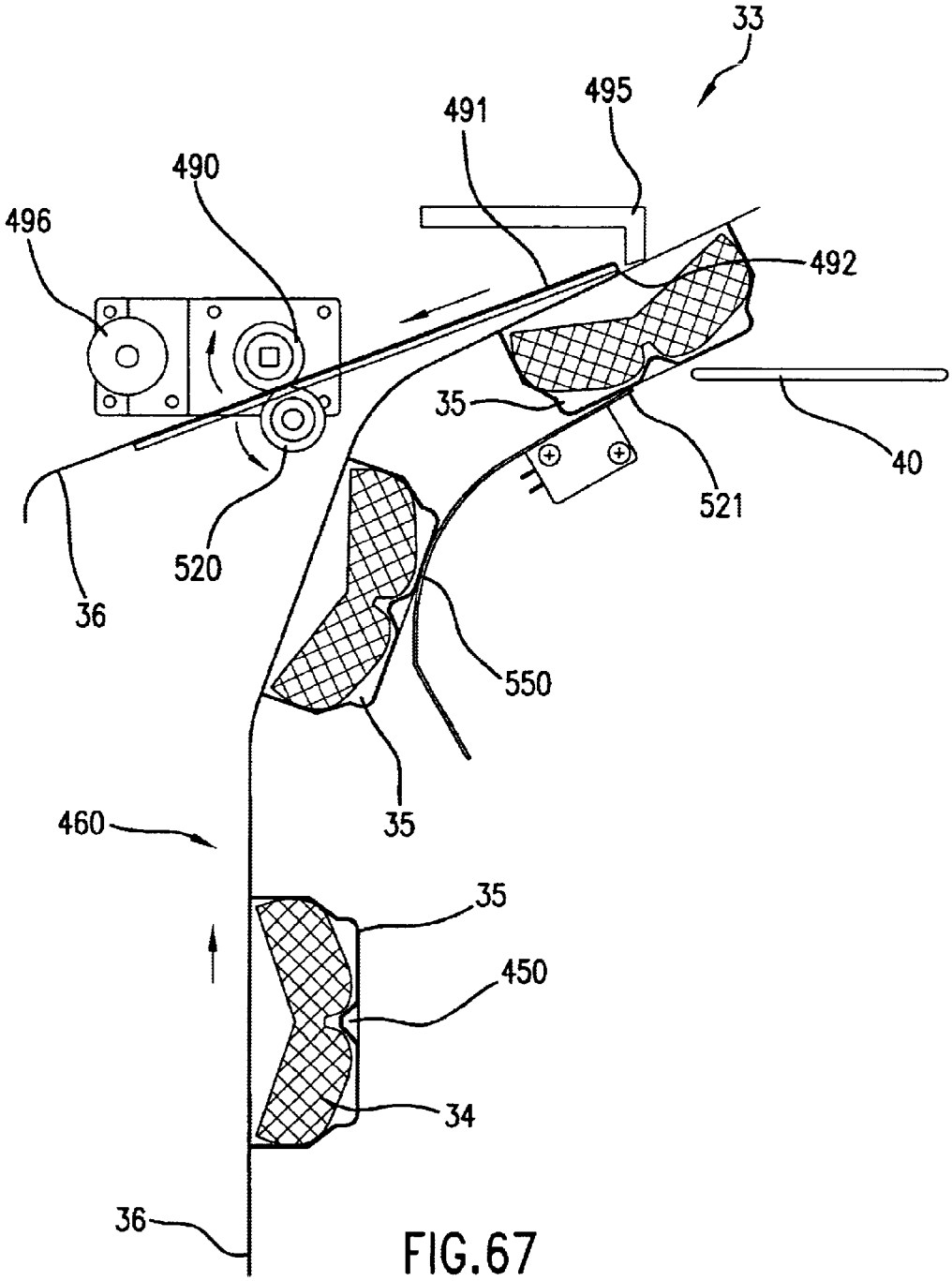
FIGS. 67 and 68 show the passage of the second food portion container between the automatic control mechanism and the plate, in accordance with an embodiment of the present invention.

FIG. 67 further shows the passage of the second food portion container 35 between the automatic control mechanism 521 and the plate 492, the passing container 35 frictionally contacting the automatic control mechanism 521 during passage. As is also shown in FIG. 67, as the container 35 passes the slot formed by the edge 492 of the plate 491 and the bar 495, the film 36 being drawn through the slot and generally reversing direction causes the film 36 to be separated from the container 35.

Figure 68:
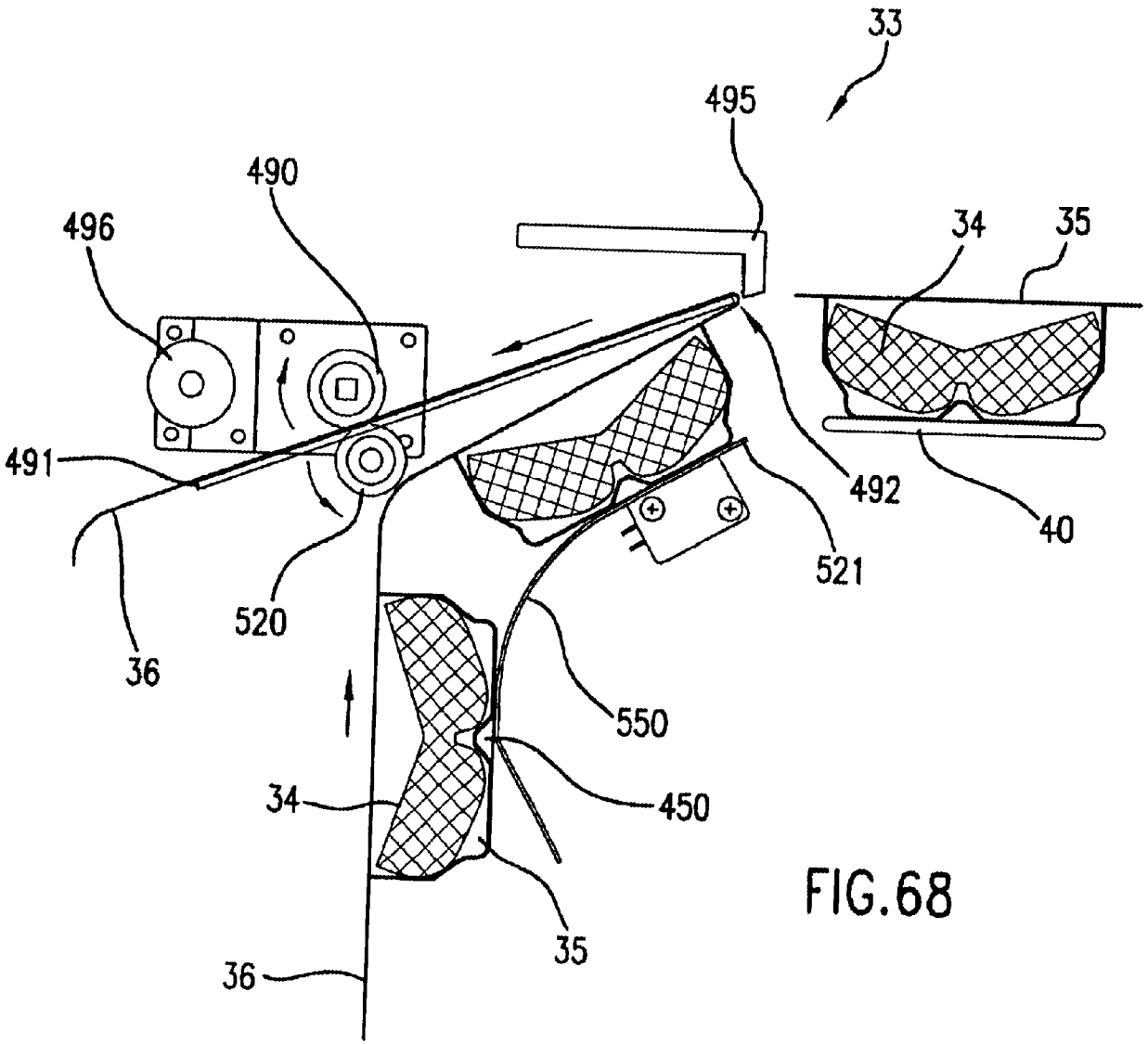

In FIG. 68, a second food portion container 35 has fully passed the automatic control mechanism 521, has fully been separated from the film 36, and has been transported onto an adjacently placed tray 40.

Figure 69:
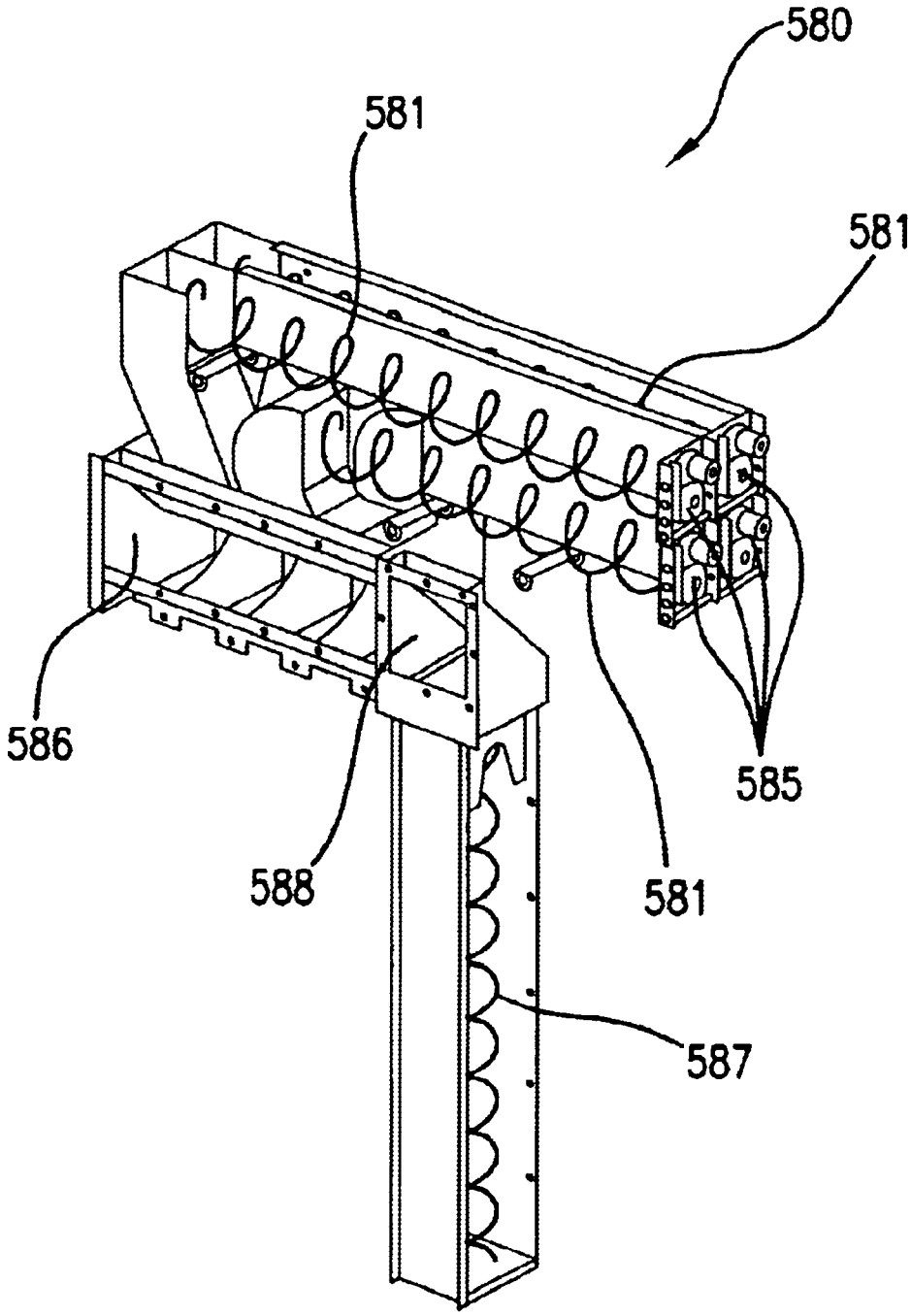
FIG. 69 presents an example condiments delivery device, in accordance with an embodiment of the present invention.

FIG. 69 presents an example condiments delivery device, in accordance with an embodiment of the present invention. In the example condiments delivery device 580 shown in FIG. 69, condiments, such as in packs, are arranged between curls of a condiment moving mechanism 581, such as a spring or coils rotationally driven by rotators 585, such as motors. When the rotators are activated, the condiment moving mechanism rotates and displaces the packs of the condiments to chutes through which the condiments slide into condiment dispensing compartments 586 located, for example, adjacent the condiment port 5, as shown in FIG. 1. In an embodiment of the present invention, supplemental items, such as napkins are similarly placed in a supplemental delivery mechanism 587, which drives the supplemental items vertically, as shown in FIG. 69, such that the items enter a supplemental dispensing chamber 588, located, for example, adjacent the supplemental port 6, as shown in FIG. 1.

Figure 70:
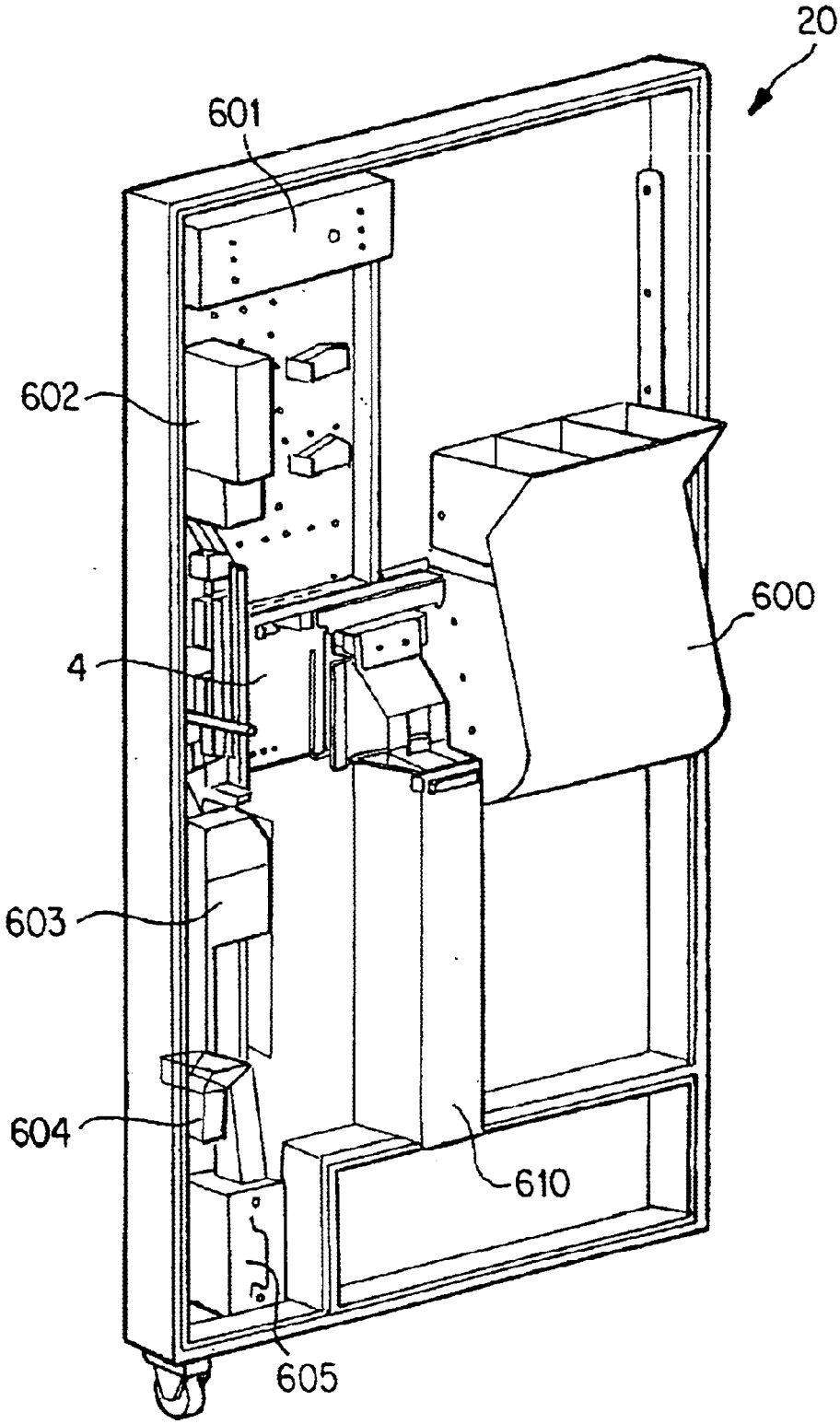
FIG. 70 shows an example gravity feed delivery device for condiments, in accordance with another embodiment of the present invention.
Figure 71:
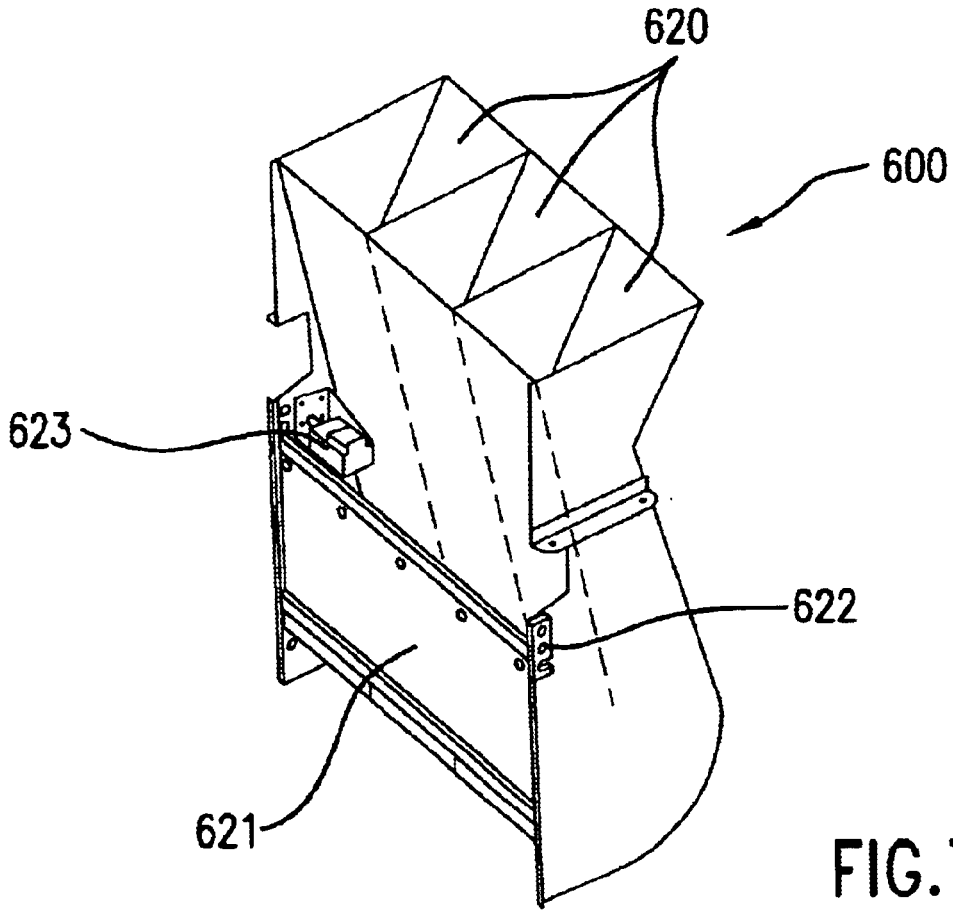
FIG. 71 is a closeup of components of the gravity feed delivery device for condiments of FIG. 70.

FIG. 70 shows an example gravity feed delivery device for condiments, in accordance with another embodiment of the present invention. FIG. 71 is a closeup of components of the gravity feed delivery device for condiments of FIG. 70. In the embodiment of the present invention shown in FIG. 70, condiments are dispensed to condiment dispensing compartments by gravity feed from containers of condiments situated above the condiment dispensing compartments.

As shown in FIG. 70, the gravity feed condiment delivery device 600 is attached to the door 20. In the embodiment shown in FIG. 70, also shown attached to the door 20 are a light 601, a validator 602 (e.g., bill and coin acceptance and validation device), the food dispensing port 4, a coin processing mechanism 603 (e.g., for receiving coins and dispensing change), a change dispensing port 604, a cash box 605, and a napkins dispensing mechanism 610.

As shown in FIG. 71, the gravity feed condiment delivery device 600 includes one or more condiment compartments 620, a door portion 621, such as a transparent door closing a port for receiving condiments, a pivoting mechanism 622, such as a hinge for allowing the door portion 621 to pivotably be moved to allow access to the port for receiving condiments, and an access control device 623, such as or including a solenoid, for selectively controlling access to condiments, such as by selectively allowing pivoting of the door portion 621 (e.g., solenoid activation causes movement of locking pin to an unlocked position upon receipt of money by machine 1; pin normally in locked position prevents access to condiment port by mechanically blocking door portion 621 in unpivoted position).

Example embodiments of the present invention have now been described in accordance with the above advantages. It will be appreciated that these examples are merely illustrative of the invention. Many variations and modifications will be apparent to those skilled in the art.

What is claimed is:

1. A food dispensing device, comprising:

a first food portion dispenser;

a first deployment mechanism for deploying food portions dispensed from the first food portion dispenser;

a first heating mechanism;

a first conveyance mechanism for receiving the first food portions, for transporting the first food portions to the first heating mechanism, and for transporting the heated first food portions to a food combining location;

a second food portion dispenser;

a second deployment mechanism for deploying food portions dispensed from the second food portion dispenser;

a second heating mechanism; and a second conveyance mechanism for receiving the second food portions, for transporting the second food portions to the second heating mechanism, for transporting the heated deployed second food portions to a food combining location, and for transporting the combined heated first and second food portions to a dispensing location.

2. The device of claim 1, further comprising:

a housing for containing the first food portion dispenser, the first deployment mechanism, the first heating mechanism, the first conveyance mechanism, the second food portion dispenser, the second deployment mechanism, the second heating mechanism, and the second conveyance mechanism.

3. The device of claim 2, wherein the housing includes a door.

4. The device of claim 2, further comprising:

a food product selection mechanism.

5. The device of claim 2, further comprising:

a mechanism for receiving payment.

6. The device of claim 5, further comprising:

a change dispenser.

7. The device of claim 2, further comprising:

a condiments dispenser.

8. The device of claim 7, further comprising a condiments delivery device for delivering condiments to the condiments dispenser.

9. The device of claim 8, wherein the condiments delivery device includes a condiment moving mechanism for moving the condiments to the condiments dispenser.

10. The device of claim 8, wherein the condiments delivery device delivers the condiments to the condiments dispenser via gravity feed.

11. The device of claim 1, wherein the first food portion dispenser dispenses a chain of first food portions.

12. The device of claim 11, wherein the chain of first food portions is formed by enclosing each of the first food portions in a first film.

13. The device of claim 11, wherein the first food portion dispenser is replaceable upon dispensing all of first food portions.

14. The device of claim 12, wherein the first deployment mechanism includes:

a pulling mechanism for pulling the first film enclosing the chain of first food portions;

a projection past which the pulling mechanism pulls the first film, such that the first film generally reverses in direction past the projection; and a cutter adjustably positionable adjacent the first film;

wherein the cutter cuts the first film adjacent each of the first food portions in the chain; and wherein the reversing in the direction of the first film past the projection expels each of the first food portions from the chain.

15. The device of claim 12, wherein the first deployment mechanism includes a pulling mechanism, and wherein the pulling mechanism comprises:

a first roller;

a second roller contacting the first roller; and a motor coupled to the first roller for rotating the first roller.

16. The device of claim 15, wherein the second roller is spool shaped.

17. The device of claim 15, wherein the first roller has first roller teeth on an external surface of the first roller, wherein the second roller has second roller teeth on an external surface of the second roller, and wherein the second roller contacts the first roller via meshed engagement of the first roller teeth with the second roller teeth.

18. The device of claim 1, wherein the first heating mechanism includes a chamber for receiving the first food portion, the chamber including an opening for receiving the food portion and at least one radiation opening for receiving radiation.

19. The device of claim 18, wherein the first conveyance mechanism includes an first food portion receiving mechanism; wherein the first food portion is rotatable via the receiving mechanism; wherein the receiving mechanism and the received first food portion are insertable into the chamber while the first food portion is rotatable; and wherein radiation is receivable within the chamber while the first food portion is inserted into the chamber.

20. The device of claim 19, wherein the radiation includes microwave radiation.

21. The device of claim 19, wherein the radiation includes infrared radiation.

22. The device of claim 20, wherein the receiving mechanism comprises a microwave heatable material, wherein the received microwave radiation produces heat in the receiving mechanism, and wherein the heat produced in the receiving mechanism is transferred to the first food portion.

23. The device of claim 22, wherein the microwave heatable material comprises a ferrite material.

24. The device of claim 18, wherein the first heating mechanism further includes a door for closing the chamber opening.

25. The device of claim 24, wherein the door is slidably closable.

26. The device of claim 24, wherein the door is pivotably closable.

27. The device of claim 24, wherein the door includes at least one curved recess abuttably fittable with receiving mechanism.

28. The device of claim 19, wherein the receiving mechanism includes a pair of cylindrical projections.

29. The device of claim 28, wherein the first food portion is rotated by the receiving mechanism via rotation of the pair of cylindrical projections.

30. The device of claim 28, wherein each of the pair of cylindrical projections includes a frictional surface portion for frictionally interacting with the received first food portion.

31. The device of claim 30, wherein each of the cylindrical projections has a cylindrical surface, and wherein the frictional surface portion includes grooves in the cylindrical surface.

32. The device of claim 18, wherein the first heating mechanism further includes:

a waste collection container.

33. The device of claim 32, wherein the waste collection container is removable from the first heating mechanism.

34. The device of claim 1, wherein the first conveyance mechanism includes a conveying component.

35. The device of claim 34, wherein the conveying component includes two rotatable cylindrical projections for receiving the first food portions.

36. The device of claim 34, wherein the first conveyance mechanism includes a track portion, and wherein the conveying component is movable via the track portion.

37. The device of claim 36, wherein the track portion has a first axis, wherein the conveyance mechanism is movable along the first axis of the track portion, and wherein conveying component is movable relative to the track portion in a second axis, the second axis being generally perpendicular to the first axis.

38. The device of claim 1, wherein the second food portion dispenser dispenses a chain of second food portions.

39. The device of claim 38, wherein the chain of second food portions is formed by abuttably sealing a plurality of second food containers with a second film, each of the plurality of second food containers containing one of the second food portions.

40. The device of claim 38, wherein the second food portion dispenser is replaceable upon dispensing all of second food portions.

41. The device of claim 1, further comprising a second food portion dispenser holder for holding the second food portion dispenser.

42. The device of claim 41, wherein the second food portion dispenser is movable from at least a first position to a second position.

43. The device of claim 38, wherein the second deployment mechanism includes:

a guide for guiding the second film having the attached containers, the guide having an edge, wherein the second film has a first side, and wherein the attached containers are attached to the first side of the second film;

a bracket located adjacent the guide edge, wherein the bracket and the guide edge from a slot opening;

a film pulling mechanism for pulling the second film through the slot opening; and a container guide for guiding the second film and the attached containers;

wherein the second film and the attached containers slidably pass the container guide in a first direction;

wherein the second film passes through the slot edge, such that the second film approximately reversed direction relative to the first direction; and wherein the slot and the bracket working in conjunction separate each of the attached containers from the second film.

44. The device of claim 43, wherein the film pulling mechanism includes:

a first roller;

a second roller frictionally contacting the first roller; and a motor coupled to the first roller for rotating the first roller.

45. The device of claim 44, wherein the first roller has a first roller diameter, wherein the second roller has a second roller diameter, wherein the first roller diameter is greater than the second roller diameter, and wherein the second film, following separation of the containers, wrappably winds about the first roller.

46. The device of claim 43, wherein the second deployment mechanism further includes:

an automatic control mechanism for controlling starting and stopping of the film pulling mechanism for pulling the second film through the slot opening.

47. The device of claim 1, wherein the second deployment mechanism is attached to a frame.

48. The device of claim 47, wherein the frame with the attached second deployment mechanism is swingably movable.

49. The device of claim 1, wherein the second heating mechanism includes a chamber for receiving the second food portion, the chamber including an opening for receiving the second food portion and at least one radiation opening for receiving radiation.

50. The device of claim 49, wherein each of the second food portions is contained in a container; wherein the second conveyance mechanism includes a tray for holding the container with the contained first food portion; and wherein the tray holding the container and the contained first food portion is receivable in the chamber of the second heating mechanism.

51. The device of claim 50, wherein radiation is received in the chamber of the second heating mechanism via the radiation opening, and wherein the radiation includes microwave radiation.

52. The device of claim 50, wherein the tray is fittably received in the opening in the chamber for receiving the second food portion.

53. The device of claim 1, wherein the second conveyance mechanism includes:

a first transporting component having an attached tray for receiving containers containing the second food portions; and a second transporting component, the second transporting component including a track, wherein the first transporting component is movable via the track of the second transporting component.

54. The device of claim 53, wherein the first transporting component is extendable, and wherein the attached tray is movable via extension of the first transport component.

55. The device of claim 1, further comprising:

a test operations control panel.

56. The device of claim 55, wherein the device includes an interior, and wherein the test operations control panel movably attached to within the interior of the device.

57. A food dispensing machine, comprising:

a housing;

a first food portion dispenser located in the housing for dispensing a chain of first food portions;

a first food portion deployment device for expelling each of the first food portions onto a receiving component;

a first food portion conveyance device for conveying each first food portion via the receiving component;

a first heating device for heating each conveyed first food portion;

a second food portion dispenser located in the housing for dispensing a chain of second food portions, wherein each of the second food portions is contained in a container;

a second food deployment device for separating each container and for delivering each container to a transporting tray;

a second food portion conveyance device for conveying each second food portion via the transporting tray; and a second heating device for heating each conveyed second food portion;

wherein the first food portion conveying device conveys each heated first food portion to a food combining location; wherein the second food portion conveying device conveys each heated food portion to the food combining location; and wherein each heated first food portion and each heated second food portion are combined.

58. A method for dispensing food, comprising:

dispensing a first food portion from a first dispenser;

a first deployment device expelling the first food portion to a receiving component;

a first conveyance conveying the first food portion to a first heating device;

heating the first food portion;

dispensing a second food portion from a second dispenser;

a second deployment device expelling the second food portion to a tray;

a second conveyance for conveying the second food portion to a second heating device;

heating the second food portion;

combining the heated first and second food portions; and dispensing the heated combined first and second food portions.

59. A system for dispensing food, comprising:

means for dispensing a first food portion from a first dispenser;

a first deployment means for expelling the first food portion to a receiving component;

a first conveyance means for conveying the first food portion to a first heating device;

means for heating the first food portion;

means for dispensing an second food portion from a second dispenser;

a second deployment means for expelling the second food portion to a tray;

a second conveyance means for conveying the second food portion to a second heating device;

means for heating the second food portion;

means for combining the heated first and second food portions; and means for dispensing the heated combined first and second food portions.

60. A food dispensing device, comprising:

a pulling mechanism for pulling a film enclosing a chain of food items;

a projection past which the pulling mechanism pulls the film, such that the film generally reverses in direction past the projection; and a cutter adjustably positionable adjacent the film;

wherein the cutter cuts the film adjacent each of the food items in the chain of food items; and wherein the reversing in the direction of the film past the projection expels each of the food items having cut adjacent film from the enclosing film.

61. The device of claim 60, wherein the food items are hot dogs.

62. The device of claim 60, wherein the food items are sausages.

63. The device of claim 60, wherein the pulling mechanism includes at least one rotating wheel.

64. The device of claim 63, wherein the at least one rotating wheel includes an engageable pair of toothed wheels.

65. The device of claim 63, wherein the pulling mechanism includes a motor for rotating the at least one rotating wheel.

66. The device of claim 60, wherein the pulling mechanism includes two frictionally engaged wheels, one of the two wheels being spool shaped.

67. The device of claim 66, wherein the spool shaped wheel wrappably winds the film.

68. The device of claim 60, wherein the cutter includes a slicing portion.

69. The device of claim 68, wherein the slicing portion includes a knife holder.

70. The device of claim 69, wherein the knife holder includes a ramp portion, wherein each of the food items slidably passes the ramp portion as the cutter cuts the film adjacent to the food item.

71. The device of claim 70, wherein the food items are hot dogs, and wherein the ramp portion is arced for each hot dog to slidably pass the ramp portion.

72. The device of claim 68, wherein the cutter includes an arm attached to the slicing portion.

73. The device of claim 72, wherein the arm is pivotably attached to a pivot point, and wherein the cutter is adjustably positionable adjacent the film via pivoting of the arm about the pivot point.

74. The device of claim 72, wherein the arm is pivotably attached to a pivot point, and wherein the arm biasedly contacts the film.

75. The device of claim 74, wherein the arm biasedly contacts the film via a spring attached to the arm.

76. The device of claim 60, wherein the film includes a first film portion and a second film portion, and wherein the first film portion is sealably attached to the second film portion about each of the food items so as to form the chain of food items.

77. A method for dispensing food items, comprising:

pulling a film enclosing the food items, wherein the film and the enclosed food items form a chain of food items;

passing the film past a projection, such that the film generally reverses direction as the film is pulled past the projection;

selectively cutting the film adjacent each of the food items as each of the food items is pulled toward the projection; and expelling each of the food items from the film as the film passes the projection.

78. The method of claim 77, wherein the film is pulled passed past the projection following selectively cutting the film adjacent each of the food items, the pulling of the film past the projection pulling the film from each of the food items.

* * * * *